US007091924B1

(12) United States Patent
Chiao

(10) Patent No.: US 7,091,924 B1
(45) Date of Patent: Aug. 15, 2006

(54) MEMS TRANSMISSION AND CIRCUIT COMPONENTS

(75) Inventor: Jung-Chih Chiao, Garland, TX (US)

(73) Assignee: University of Hawaii, Honolulu, HI (US)

( * ) Notice: Subject to any disclaimer, the term of this patent is extended or adjusted under 35 U.S.C. 154(b) by 326 days.

(21) Appl. No.: 10/009,986

(22) PCT Filed: Jun. 9, 2000

(86) PCT No.: PCT/US00/16021

§ 371 (c)(1),
(2), (4) Date: Dec. 11, 2001

(87) PCT Pub. No.: WO00/77877

PCT Pub. Date: Dec. 21, 2000

(51) Int. Cl.
*H01P 1/00* (2006.01)

(52) U.S. Cl. ..... 343/805; 343/881

(58) Field of Classification Search ..... 343/915, 343/805

See application file for complete search history.

(56) References Cited

U.S. PATENT DOCUMENTS

| | | | | |
|---|---|---|---|---|
| 3,665,477 A * | 5/1972 | Burdrow | 343/714 |
| 5,652,671 A * | 7/1997 | Knipe et al. | 359/291 |
| 6,023,209 A * | 2/2000 | Faulkner et al. | 333/238 |
| 6,198,460 B1 * | 3/2001 | Brankovic | 343/879 |

* cited by examiner

*Primary Examiner*—James Vannucci
(74) *Attorney, Agent, or Firm*—Dorsey & Whitney LLP

(57) ABSTRACT

An Rf device (100) that comprises unique MEMS RF transmission and circuit components (104–106) that are integrated together on a semiconductor chip (101) to form the RF device (100). These MEMS components (104–106) are monolithically formed on the chip (101) and are also reconfigurable on the chip (101).

10 Claims, 43 Drawing Sheets

100

200

MEMS TRANSMISSION AND CIRCUIT COMPONENTS

CROSS REFERENCE TO RELATED APPLICATIONS

This patent application is related to copending PCT Patent Applications Ser. Nos. PCT/US00/16023 and PCT/US00/16024, with respective titles MEMS OPTICAL COMPONENTS and RECONFIGURABLE QUASI-OPTICAL UNIT CELLS, and filed on Jun. 9, 2000. These copending applications are hereby incorporated by reference.

TECHNICAL FIELD OF THE INVENTION

The present invention relates generally to MEMS (micro-electro-mechanical system) devices. In particular, the present invention pertains to unique MEMS components that are integrated together on a semiconductor chip to form an RF device. These MEMS components are monolithically formed on the chip and are also reconfigurable on the chip.

BACKGROUND OF THE INVENTION

Recent progress in monolithically fabricated RF devices has made it possible for implementation of chip-scale integrated RF devices. However, due to the low output power of solid-state sources and high losses in tuning and switching components, achievement of high-power or high-sensitivity RF devices is still a challenge. To develop complete RF devices, reconfigurable RF components and circuit components with low losses and high Q-factors are needed. Since MEMS components provide fast actuation due to their small size, low insertion losses, and high Q-factors due to their direct electrical connections, they have become an increasingly attractive option for constructing RF devices.

SUMMARY OF THE INVENTION

Figure 1:
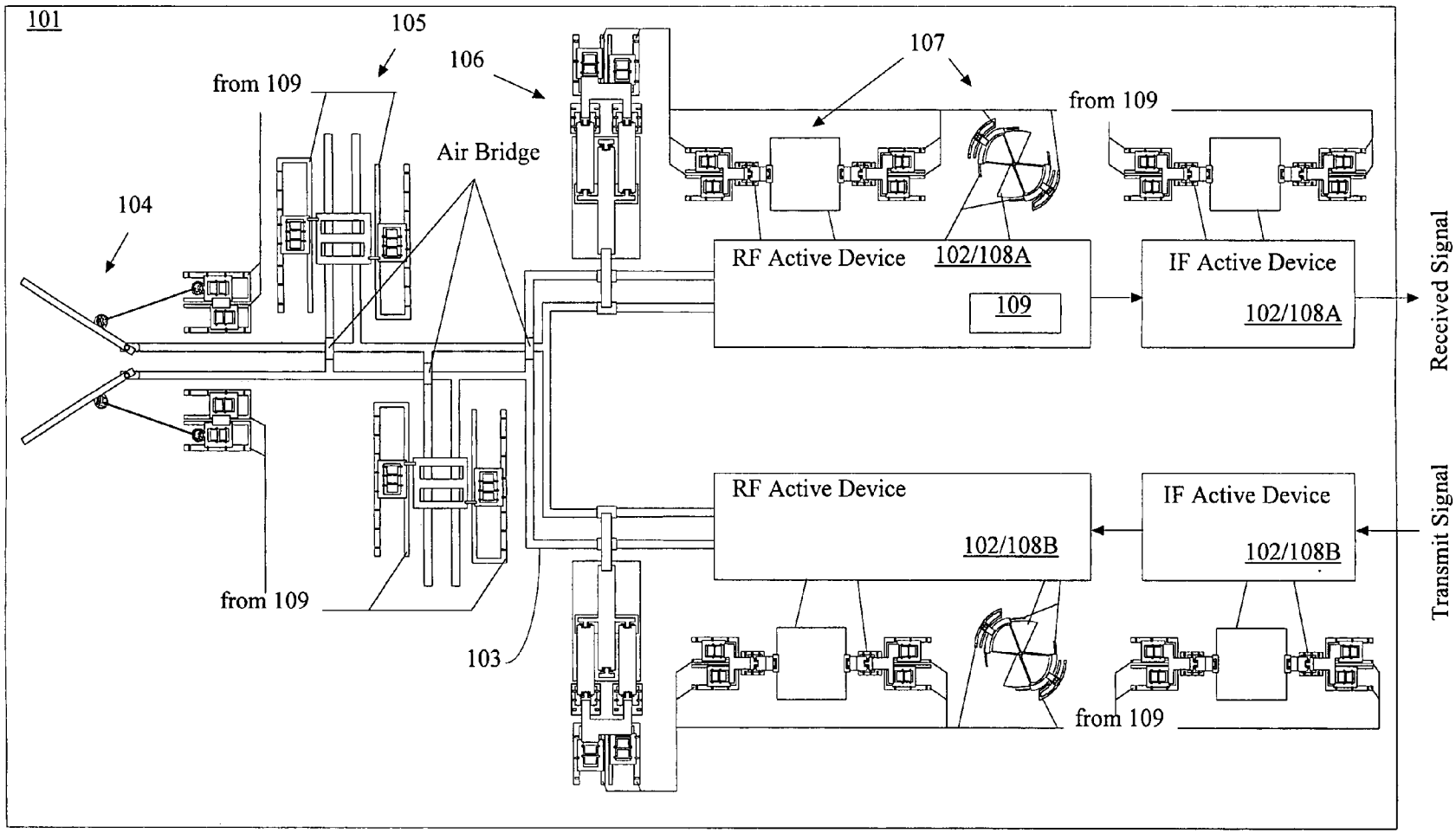
FIG. 1 shows a CPS (coplanar strip) transmission line configuration of a MEMS reconfigurable RF transceiver.

In summary, the present invention comprises an RF device that comprises unique MEMS RF transmission and circuit components that are integrated together on a semiconductor chip to form the RF device. These MEMS components are monolithically formed on the chip and are also reconfigurable on the chip.

In one embodiment, the present invention comprises a micro-mechanical hinge. This hinge comprises a lower bracket, an upper bracket, a middle section with an opening in a plane, and a hinge pin that is normal to the horizontal plane and sized to closely fit within the opening. The upper and lower brackets are fixedly coupled to corresponding opposite ends of the pin on opposite sides of the middle section and have dimensions within the plane that are greater than the size of the opening. Movement of the middle section relative to the upper and lower brackets and the pin is limited to rotation in the plane and bracketed by the lower and upper brackets.

In another embodiment, the present invention comprises another micro-mechanical hinge. This hinge comprises a base ring, a rotation ring disposed within the base ring, a hinge pin disposed within the rotation ring, one or more attachment arms that fixedly couple the hinge pin to the base ring and guide the rotation ring as it rotates about the hinge pin's axis and within the base ring, and a support arm having (a) a first end fixedly coupled to the rotation ring, and (b) a second end that rotates about the hinge pin's axis when the rotation ring rotates.

In still another embodiment, the present invention comprises a micro-mechanical pivot hinge. This hinge comprises a first hinge plate with an opening, a pivot pin disposed in the opening of the base plate, a second hinge plate fixedly coupled to the pivot pin, and at least one extension arm fixedly coupled to the first hinge plate and extending over the opening of the first hinge plate and the pivot pin. The at least one extension arm and the second hinge plate are configured to act in conjunction to lock the pivot pin in the opening so that one of the first and the second hinge plates pivots about the pivot pin's axis.

In another embodiment, the present invention comprises a MEMS vee antenna. The antenna comprises a transmission line end, antenna arms, actuator mechanisms, and support arms. The transmission line comprises conductors. Each of the antenna arms is rotatably coupled to a corresponding one of the conductors. Each of the support arms has one end rotatably coupled to a corresponding one of the antenna arms and the other end rotatably coupled to a corresponding one of the actuator mechanisms. For each of the actuator mechanisms, when the actuator mechanism is controlled to move linearly forward, the corresponding support arm pushes on the corresponding antenna arm so as rotate the corresponding antenna arm inward. Conversely, when the actuator mechanism is controlled to move linearly backward, the corresponding support arm pulls on the corresponding antenna arm so as rotate the corresponding antenna arm outward.

In another embodiment, the present invention comprises a MEMS docking switch. This switch comprises a first conductor, an opposing second conductor, a moveable insulating plate, an electrical contact fixedly coupled to the underside of the moveable insulating plate, actuator mechanisms, and support arms. Each of the support arms has one end laterally moveably and rotatably coupled to a corresponding one of the actuator mechanisms and the other end vertically moveably and rotatably coupled to the moveable insulating plate. When the actuator mechanisms are controlled to move backward, the support arms pull the moveable insulating plate down until the electrical contact is laid down on and contacts the conductors. Conversely, when the actuator mechanisms are controlled to move forward, the support arms push the moveable insulating plate up until the electrical contact is lifted up from and no longer contacts the conductors.

In another embodiment, the present invention comprises a MEMS derrick switch. This switch comprises an insulating layer, a first conductor fixedly coupled to the insulating layer, an opposing second conductor fixedly coupled to the insulating layer, a pivot arm having a first end rotatably coupled to the insulating layer so that a second end of the pivot arm pivots about the first end, an actuator mechanism, a support arm having a first end rotatably coupled to the second end of the pivot arm and a second end laterally moveably and rotatably coupled to the actuator mechanism, an insulating attachment arm fixedly coupled to the second end of the pivot arm, and an electrical contact fixedly coupled to the underside of the insulating attachment arm. When the actuator mechanism is controlled to move forward, the support arm pushes the second end of the pivot arm down until the electrical contact is laid down on and contacts the conductors. Conversely, when the actuator mechanism is controlled to move backward, the support arm pulls the second end of the pivot arm up until the electrical contact is lifted up from and no longer contacts the conductors.

In still another embodiment, the present invention comprises a MEMS see-saw. This switch comprises an insulating layer, a first conductor fixedly coupled to the insulating layer, an opposing second conductor fixedly coupled to the insulating layer, a first electrode fixedly coupled to the insulating layer, a second electrode fixedly coupled to the insulating layer, a conductive pivot arm having a first end over the first electrode, a second end over the second electrode, and a center rotatably coupled to the insulating layer so that a first end and a second end of the pivot arm can pivot about a rotation axis at the center of the pivot arm, an insulating attachment arm fixedly coupled to the second end of the pivot arm, and an electrical contact fixedly coupled to the underside of the insulating attachment arm. When a voltage is applied between the first electrode and the pivot arm, the first end of the pivot arm is pulled down until the electrical contact is laid down on and contacts the conductors. Conversely, when a voltage is applied between the second electrode and the pivot arm, the second end of the pivot arm is pulled down until the electrical contact is lifted up from and no longer contacts the conductors.

In another embodiment, the present invention comprises a reconfigurable capacitor. The capacitor comprises a stationary first plate, a moveable second plate, actuator mechanisms, and support arms. Each of the support arms having one end laterally moveably and rotatably coupled to a corresponding one of the actuator mechanisms and the other end vertically moveably and rotatably coupled to the moveable second plate. When the actuator mechanisms are controlled to move backward, the support arms pull the moveable second plate down to change the capacitance of the capacitor. Conversely, when the actuator mechanisms are controlled to move forward, the support arms push the moveable second plate up to change the capacitance of the capacitor.

In another embodiment, the present invention comprises a MEMS microstrip transmission line element. The transmission line element comprises a stationary planar conductor, a moveable planar conductor, first actuator mechanisms, second actuator assembies, and first and second support arms. Each of the first support arms has one end laterally moveably and rotatably coupled to a corresponding one of the first actuator mechanisms and the other end vertically moveably and rotatably coupled to a first end of the moveable planar conductor. Each of the second support arms has one end laterally moveably and rotatably coupled to a corresponding one of the second actuator mechanisms and the other end vertically moveably and rotatably coupled to a second end of the moveable planar conductor. When the first actuator mechanisms are controlled to move backward or forward, the first support arms pull or push the first end of the moveable planar conductor down or up to change the impedance of the microstrip transmission line element at the first end. Conversely, when the second actuator mechanisms are controlled to move backward or forward, the second support arms pull or push the second end of the moveable planar conductor down or up to change the impedance of the microstrip transmission line element at the second end.

In another embodiment, the present invention comprises a MEMS transmission line element. The transmission line element comprises moveable coplanar conductors, first actuator mechanisms, second actuator mechanisms, insulating attachment arms. Each of the insulating attachment arms has one end fixedly coupled to a corresponding one of the actuator mechanisms and the other end fixedly coupled to a corresponding one of the moveable planar conductors. When the actuator mechanisms are controlled to move backward or forward, the insulating attachment arms pull or push the moveable planar conductors out or in to change the impedance of the transmission line element.

In still another embodiment, the present invention comprises a MEMS impedance tuner for changing the impedance of a transmission line. The impedance tuner comprises a transmission line branch for shunt connection to the transmission line, a moveable conductive plate suspended over the transmission line branch, actuator mechanisms, and insulating attachment arms. Each of the insulating attachment arms has one end fixedly coupled to a corresponding one of the actuator mechanisms and the other end fixedly coupled to a corresponding side of the moveable conductive plate so as to suspend the moveable conductive plate over the transmission line branch. When the actuator mechanisms are controlled to move backward or forward, the moveable conductive plate is moved backward or forward over the transmission line branch to change the impedance of the transmission line.

DETAILED DESCRIPTION OF THE INVENTION

Referring to FIG. 1, there is shown a CPS (coplanar strip) transmission line configuration of a MEMS RF transceiver 100. The transceiver 100 comprises an integrated MEMS chip 101 and at least one IC (integrated circuit) flip-chip 102.

The MEMS chip 101 comprises a CPS transmission line 103 and MEMS RF transmission components 104 to 106 that are connected together by and configured for the CPS transmission line 103. The RF transmission components 104 to 106 include a CPS MEMS vee antenna 104, CPS MEMS transmission line components 105, and CPS MEMS switches 106. The transmission line 103, the vee antenna 104, the transmission line components 105, and the switches 106 are integrated together on the MEMS chip 101. In fact, the vee antenna 104, the transmission line components 105, and the switches 106 are all monolithically fabricated on the MEMS chip. Furthermore, the vee antenna 104, the transmission line components 105, and the switches 106 are reconfigurable on the MEMS chip 101.

The MEMS chip 101 also comprises MEMS circuit components 107 that are integrated together on the MEMS chip 101. Like the RF transmission components 104 to 106, the circuit components 107 are all monolithically fabricated on the MEMS chip 101. The circuit components are reconfigurable on the MEMS chip 101 and are used by the flip-chip 102.

The flip-chip 102 comprises RF/IF (radio frequency/intermediate frequency) receive and transmit ICs (integrated circuits) 108*a* and 108*b* for processing and generating the signals that are received and transmitted using the vee antenna 104, the transmission line components 105, and the switches 106. The receive and transmit ICs 108*a* and 108*b* use the circuit components 107 for this purpose. The flip-chip 102 further comprises a control circuit 109 for controlling the reconfigurability of the vee antenna 104, the transmission line components 105, the switches 106, and the circuit components 107. The control circuit 109 controls the operation of the switches 106 in properly switching between receiving RF signals for processing by the receive IC 108*a* and generating RF signals by the transmit IC 108*b* for transmission by controlling the reconfigurablity of the switches 106.

Figure 2:
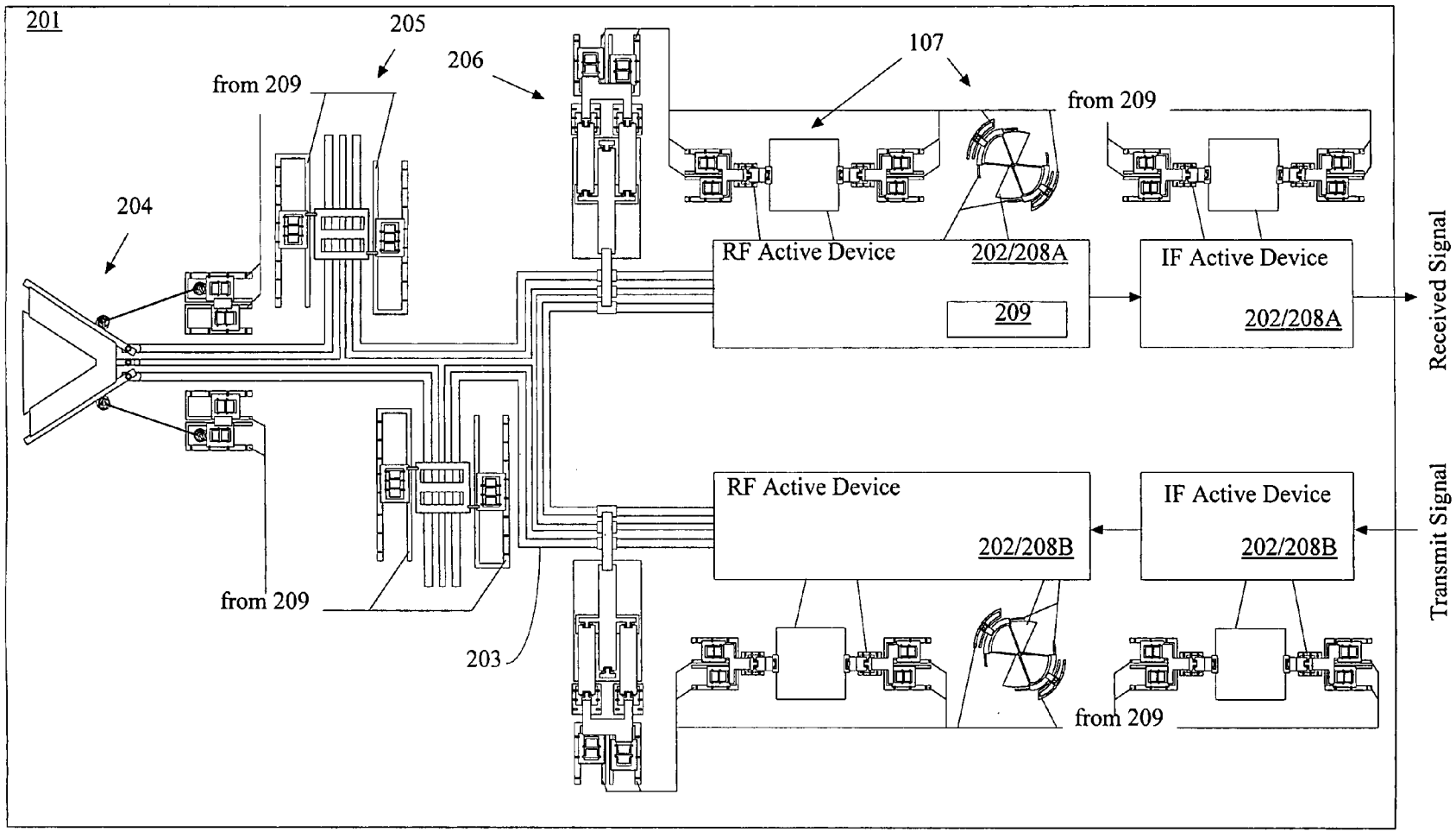
FIG. 2 shows a CPW (coplanar waveguide) transmission line configuration of a MEMS reconfigurable RF transceiver.

Turning to FIG. 2, there is shown a CPW (coplanar waveguide) transmission line configuration of a MEMS transceiver 200. The configuration of the transceiver 200 is similar to that of the transceiver 100 in FIG. 1. Here, however, the MEMS chip 201 of the transceiver 200 comprises MEMS RF transmission components 204 to 206 that are connected together by and configured for a CPW main transmission line 203 of the transceiver 200. These transmission components 204 to 206 include a CPW MEMS vee antenna 204, CPW MEMS transmission line components 205, and CPW MEMS switches 206. Like the transceiver 100, the transceiver 200 also comprises circuit components 107 that are integrated on the MEMS chip 201 The vee antenna 204, the transmission line components 205, the switches 206, and the circuit components 107 are all monolithically fabricated on the MEMS chip 201.

Similar to the receive and transmit ICs 108*a* and 108*b* in FIG. 1 of the flip-chip 102 of the transceiver 100, the RF/IF receive and transmit ICs 208*a* and 208*b* of the flip-chip 202 of the transceiver use the circuit components 107 of the MEMS chip 201 for processing and generating the RF signals that are received and transmitted using the vee antenna 204, the transmission line components 205, and the switches 206. The control circuit 209 of the flip-chip 202 controls the reconfigurability of the vee antenna 204, the transmission line components 205, the switches 206, and the circuit components 107 in a similar manner to the way in which the control circuit of FIG. 1 controls the reconfigurablity of the vee antenna 104, the transmission line components 105, the switches 106, and the circuit components 107.

CPS MEMS Vee Antenna 104

Figure 3:
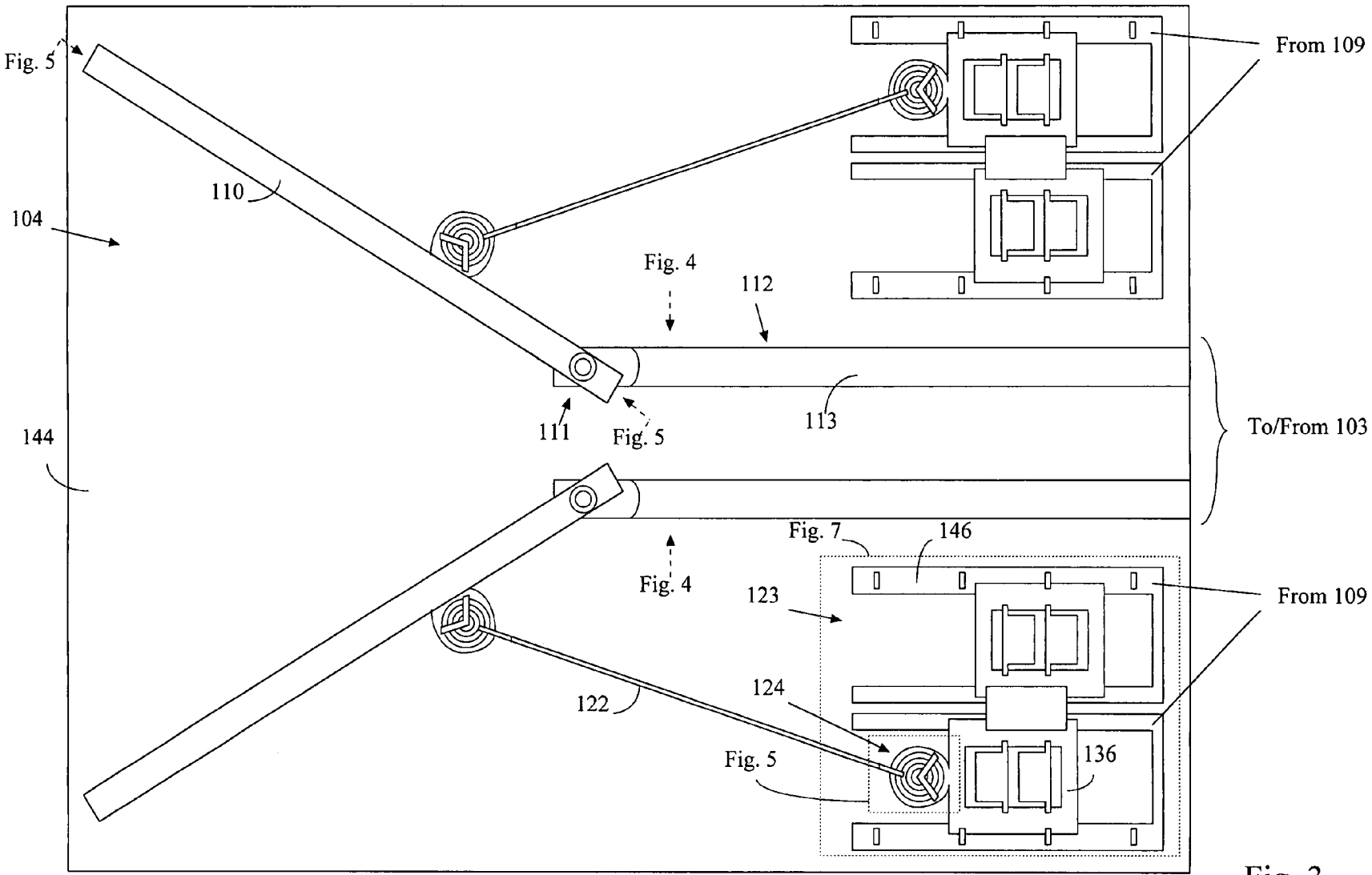
FIGS. 3 to 10 show a MEMS reconfigurable CPS vee antenna of the transceiver of FIG. 1 and various components thereof

Turning to FIG. 3, the CPS MEMS vee antenna 104 of FIG. 1 is connected in series to a corresponding end portion of the CPS main transmission line 103. It comprises the semiconductor substrate 143 and the insulating layer 144 of the MEMS chip 101 of FIG. 1. It also comprises rotatable antenna arms 110, micro-mechanical hinges 111, and a CPS transmission line end 112.

The CPS transmission line end 112 is electrically connected to the corresponding end portion of the CPS main transmission line 103, and like the CPS main transmission line 103, comprises coplanar conductors 113 formed on the insulating layer 144. Each of the conductors 113 is electrically connected to a corresponding conductor of the CPS main transmission line 103. The insulating layer 144 is itself formed on the substrate 143. Each antenna arm 110 is electrically connected and rotatably coupled to a corresponding conductor 113 by a corresponding hinge 111.

Figure 4:
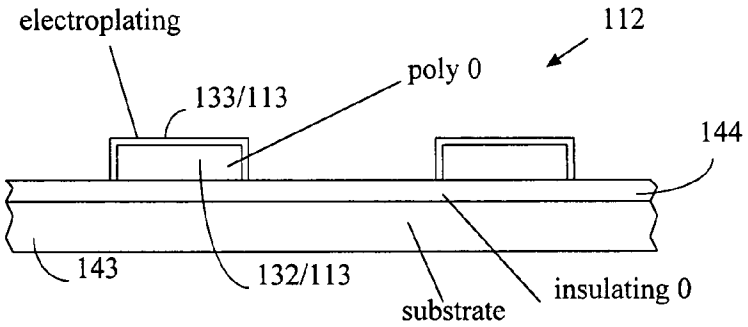

FIG. 4 shows the configuration of the conductors 113 of the transmission line end 112. Like each conductor of the CPS main transmission line 103, each conductor 113 comprises a semiconductor strip 132 and a metal plating 133. The metal plating 133 is used to reduce the resistivity of the conductor 113 so as to avoid losses at RF frequencies due to the resistivity of the semiconductor strip 132.

Figure 5:
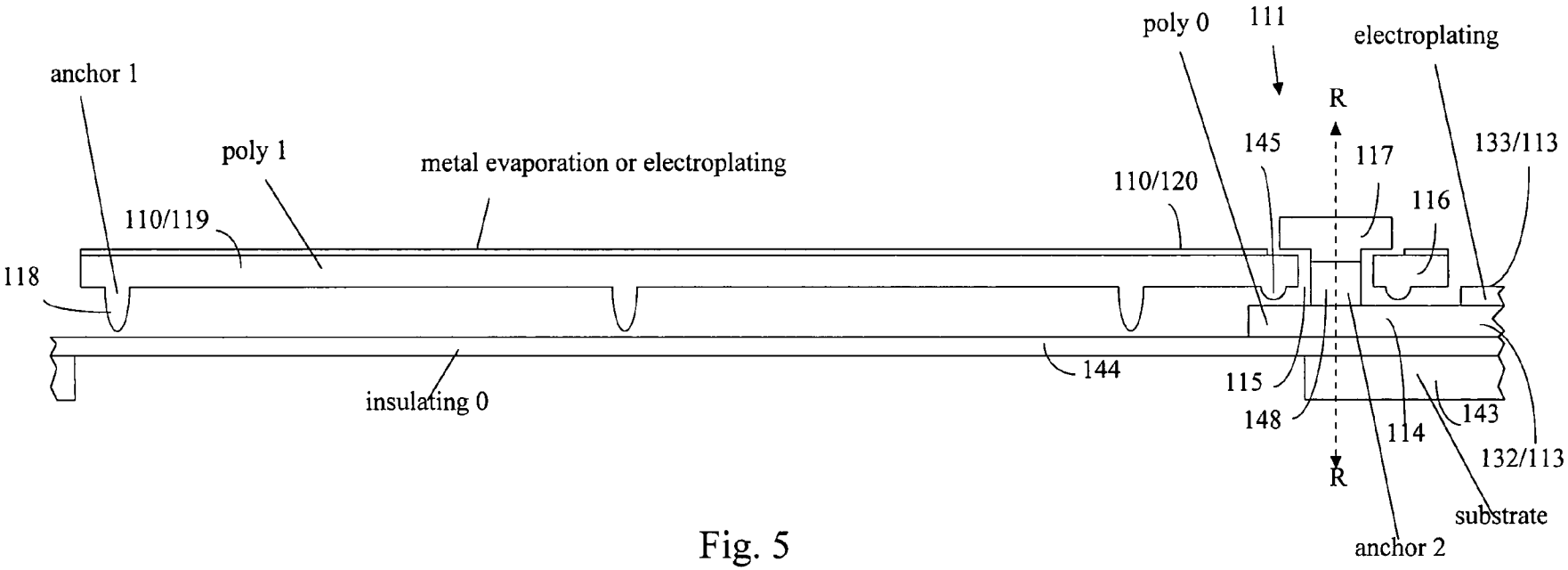

FIG. 5 shows the configuration of each hinge 111. The hinge 226 comprises a lower bracket 114, a middle section 116, an anchor 148, and an upper bracket 117. The lower bracket 114 is fixedly coupled to the insulating layer 144. The middle section 116 is oriented in a horizontal plane and also has an opening 115 that is oriented in the horizontal plane. The anchor 148 is located within the opening 115 and extends down along the rotation axis R of the hinge 111. This anchor 148 fixedly couples the lower and upper brackets 114 and 117 together. The upper and lower brackets 114 and 117 are oriented parallel to the horizontal plane and have dimensions (i.e., cross sectional widths) parallel to the plane that are greater than the dimension (i.e., diameter) of the opening 115. As a result, the movement of the middle section 116 relative to the lower and upper brackets 114 and 117 is limited to rotation in the horizontal plane about the rotation axis R and bracketed by the upper and lower brackets 117 and 114. Thus, the anchor 148 serves as the hinge pin of the hinge 111. The middle section 116 includes a rail 145 that is fixedly coupled to and patterned on the lower surface of the middle section 116 and, in fact, may be integrally formed with it. The rail 145 allows the middle section 116 to rotatably slide on the lower bracket 114 with minimal stiction and friction.

FIG. 5 also shows the configuration of each antenna arm 110. Each antenna arm 110 comprises a semiconductor strip 119 and a metal plating 120 formed on the semiconductor strip 119. The semiconductor strip 119 is fixedly coupled to the middle section 116 of the corresponding hinge 111. Furthermore, the semiconductor strip 132 of the corresponding conductor 113 is fixedly coupled to the lower bracket 114 of the corresponding hinge 111. As a result, the pivoting end of the semiconductor strip 119 (and the entire antenna arm 110) can pivot about the rotation axis R so that its (and the entire antenna arm's) free end can be rotated radially in and out. In addition, since the lower bracket 114, the upper bracket 117, the middle section 116, and the anchor 148 of the hinge 111 are all conductive, the semiconductor strip 119 (and therefore the entire antenna arm 110) is also electrically connected to the semiconductor strip 132 (and therefore the entire conductor 113).

Each antenna arm 110 also includes one or more support ridges 1118. These support ridges 118 may be integrally formed with the semiconductor strip 119. The ridges 118 support the antenna arm 110 as it rotates over the insulating layer 144. This also prevents the antenna arm 110 from sticking to the insulating layer 144 when the vee antenna 104 of FIG. 3 is being operated in a moist environment. Since the portion of the substrate 143 underneath the antenna arms 110 is removed, electrostatic interaction between the antenna arm 110 and the substrate 143 is avoided and does not interfere with the operation of the vee antenna 104 of FIG. 3.

Referring back to FIG. 3, the CPS vee antenna 104 also comprises two support arms 122, two actuator mechanisms 123, and four micro-mechanical hinges 124. Each antenna arm 110 is moveably coupled to a corresponding actuator mechanism 123 with a corresponding support arm 122 and two corresponding hinges 124. One hinge 124 is fixedly coupled to the antenna arm 110 and the support arm 122 and moveably and rotatably couples them together. Similarly, the other hinge 124 is fixedly coupled to the support arm 122 and a corresponding actuator sub-mechanism 134 of the actuator mechanism 123. This hinge 124 moveably and rotatably couples the support arm 123 and the actuator sub-mechanism 134 together. As a result, the hinges 124 and support arms 122 enable the linear forward and backward movement of the actuator mechanisms 123 to be translated into radial in and out rotation of the antenna arms 110.

Figure 6:
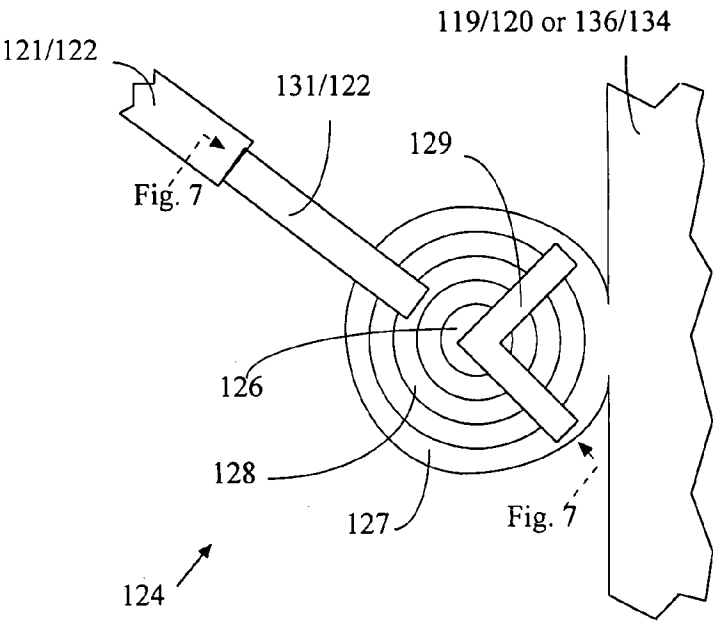
Figure 7:
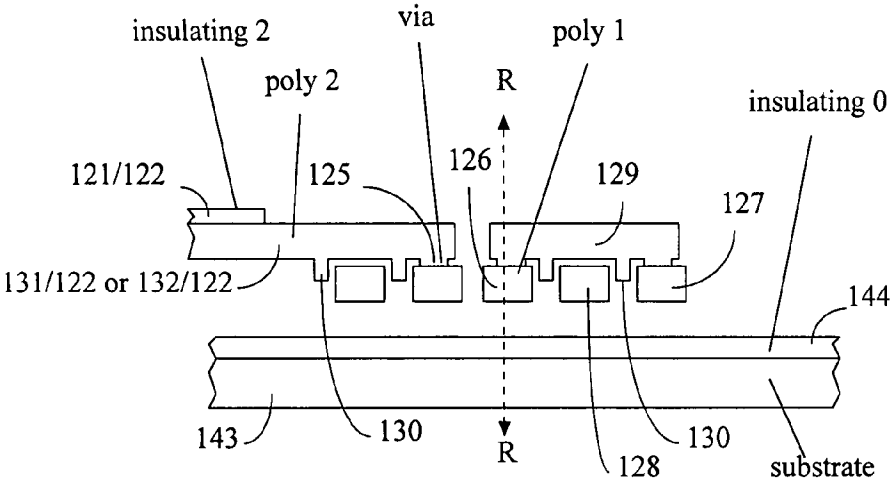

FIGS. 6 and 7 show the configuration of each hinge 124. Each hinge 124 comprises a hinge pin 126 and a fixed ring 127. The fixed ring 127 is fixedly coupled and may be integrally formed with the semiconductor strip 119 of the corresponding antenna arm 110 (with the metal plating 120 of FIG. 4 not being shown in FIG. 5 for illustration purposes) or the support frame 136 of the corresponding actuator sub-mechanism 134. Around the hinge pin 126 and within the fixed ring 127 is a rotatable ring 128 of the hinge 124. The rotatable ring 128 floats and rotates about the rotation axis R of the hinge 124 between the hinge pin 126 and the fixed ring 127. One or more attachment arms 129 of the hinge 124 are each fixedly coupled to the fixed ring 127 and the hinge pin 126 by vias 125 of the hinge 124. The attachment arms 129 include guide rails 130 to guide the rotatable ring 128 so that it rotates about the rotation axis R between the hinge pin 126 and the fixed ring 127.

One end 131 of the corresponding attachment arm 122 is fixedly coupled to the rotatable ring 128 by another via 125 of the hinge 124. Like the attachment arms 129, this end 131 includes guide rails 130 to guide the end 131 so that it rotates around the fixed ring 127. Depending on whether the hinge 124 is fixedly coupled to a corresponding antenna arm 110 in FIG. 3 or a corresponding actuator mechanism 123 in FIG. 3, this end 131 is rotatably and moveably coupled to the antenna arm 110 or the actuator mechanism 123 by the hinge 124. Specifically, in the case where the hinge 124 is fixedly coupled to a corresponding antenna arm 110, the end 131 pivots about the rotation axis R as the support arm 122 is pushed forward or pulled backward and the free end of the antenna arm 120 moves radially in or out. And, in the case where the hinge 124 is fixedly coupled to a corresponding actuator mechanism 123, the end 131 pivots about the rotation axis R when the support arm 122 is pushed forward or pulled backward by the actuator mechanism 123. The other end 131 of the support arm 122 is similarly rotatably and moveably coupled to a corresponding actuator mechanism 123 or a corresponding antenna arm 110 by a corresponding hinge 124.

As is also shown in FIGS. 6 and 7, each support arm 122 comprises an insulating arm 121 that is fixedly coupled to both attachment arms 131 of the support arm 122. This insulating strip 121 provides electrical isolation for the corresponding antenna arm 110 and actuator mechanism 123 to which the support arm 122 is coupled via the corresponding hinges 124.

Figure 8:
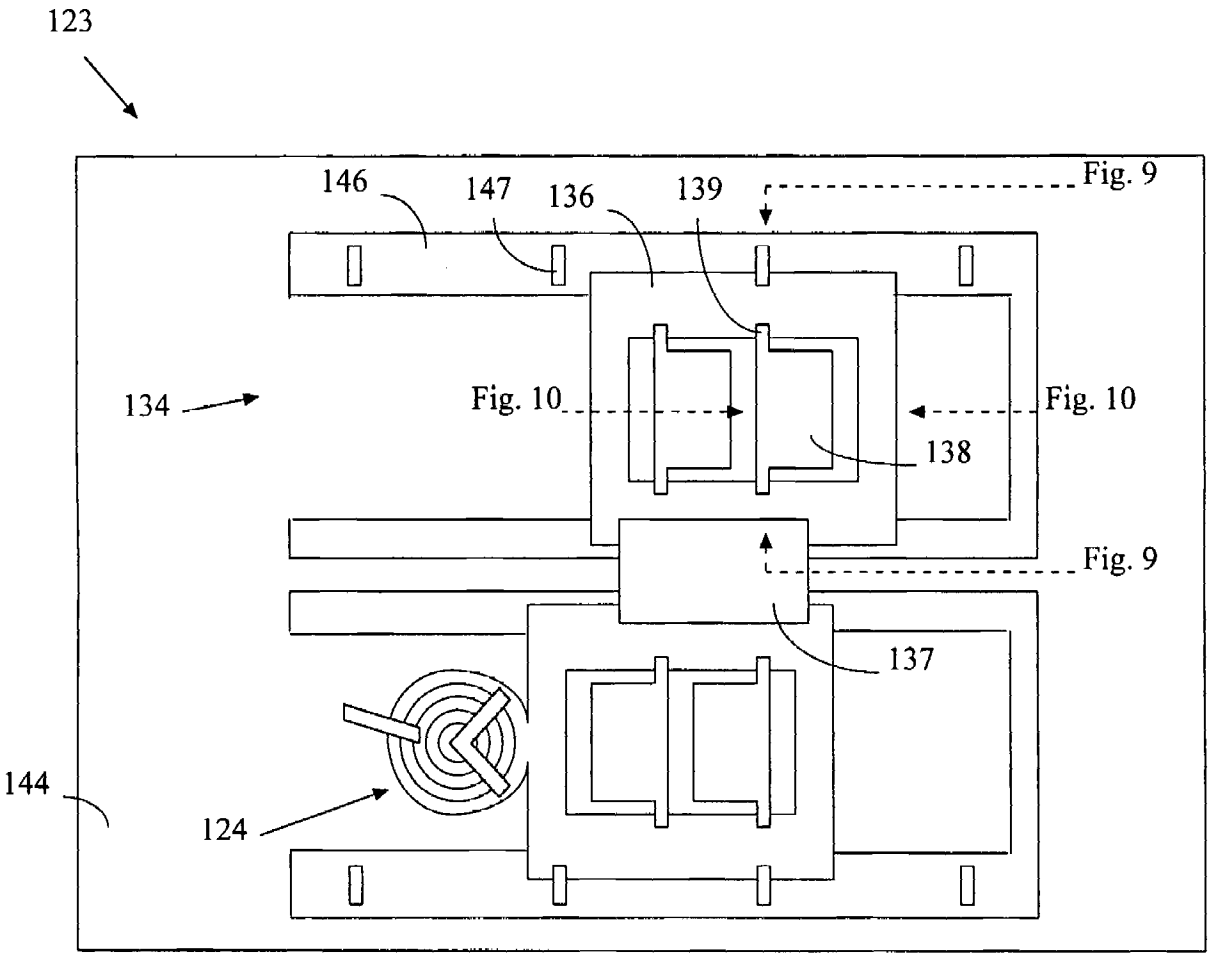

Referring to FIG. 8, each actuator mechanism 123 comprises actuator sub-mechanisms 134. At least one of the actuator sub-mechanisms 134 is used for forward movement and at least one is used for backward movement. Each actuator sub-mechanism 134 comprises a conductive support frame 136 that is fixedly coupled to the support frame 136 of another actuator sub-mechanism 134. This is done with an insulating attachment bridge (or arm) 137 of the actuator mechanism 123 that fixedly couples, but electrically isolates, the support frames 136 (and the actuator sub-mechanisms 134 as well).

Figure 9:
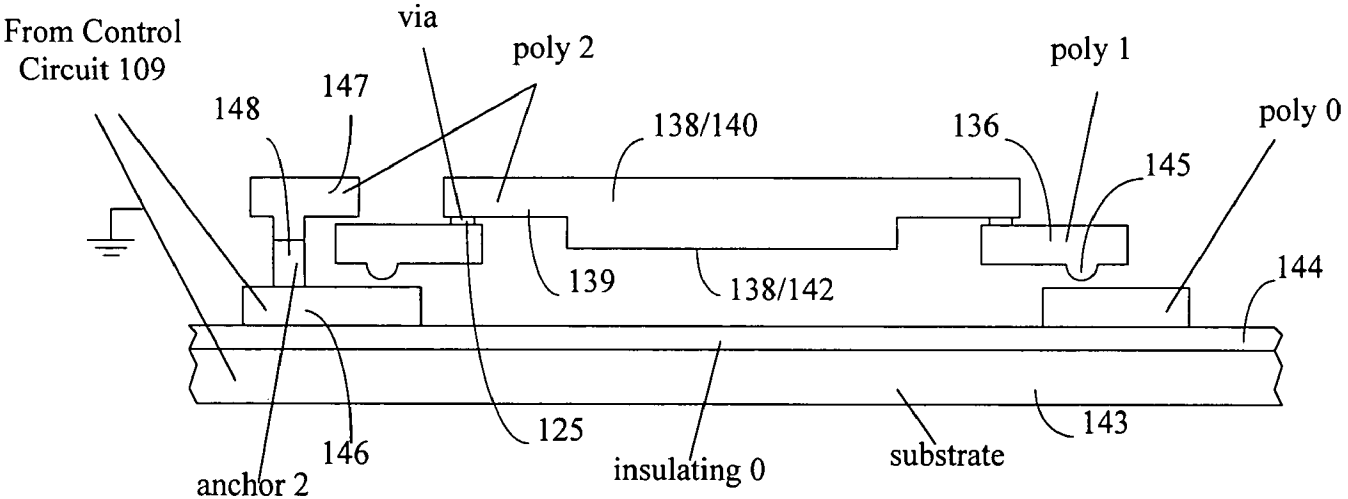
Figure 10:
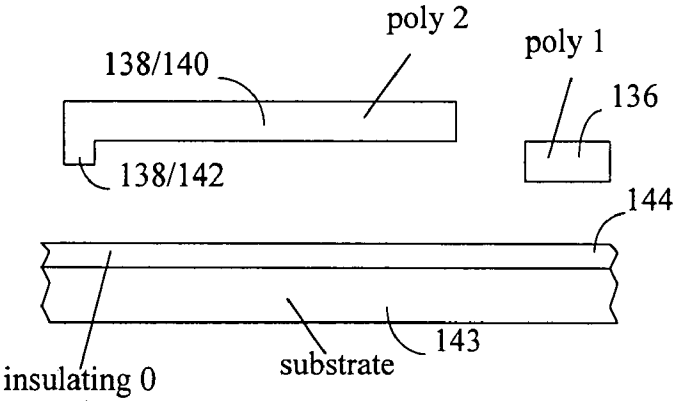

Each actuator sub-mechanism 134 also comprises an array of SDAs (scratch-drive actuators) 138 and conductive flexible attachment arms 139. As shown in FIGS. 9 and 10, each SDA 138 comprises a corresponding plate 140 and a corresponding bushing 142. The plate 140 is fixedly coupled and electrically connected to corresponding attachment arms 139 and may be integrally formed with these attachment arms 139. The attachment arms 139 are themselves fixedly coupled and electrically connected to the support frame 136 of the actuator mechanism 134 by vias 125 of the actuator sub-mechanism 134. The SDAs 138 are aligned for forward or backward movement depending on whether the corresponding actuator sub-mechanism 134 is for forward or backward movement. The SDAs 138 are of the type described in T. Akiyama and K. Shono, "Controlled Stepwise Motion in Polysilicon Microstructures", J. of MEMS, Vol. 2, No. 3, pp. 106, September 1993, and T. Aiyama and H. Fujita, "A Quantative Analysis of Scratch Drive Actuator Using Buckling Motion", IEEE Micro Electro Mechanical Systems, pp. 310–315, 1995. These articles are hereby incorporated by reference.

Each actuator sub-mechanism mechanism 134 also comprises conductive contact rails 145 and conductive lines 146. The contact rails 145 are fixedly coupled to and patterned on the lower surface of the support frame 136 of the actuator sub-mechanism 134 and, in fact, may be integrally formed with the support frame 136. The contact rails 145 are also electrically connected to the support frame 136. The bias lines 146 are fixedly coupled to and patterned on the insulating layer 144. The contact rails 145 moveably slide on and electrically contact the bias lines 146.

The conductive plates 140 of the SDAs 138 of each actuator sub-mechanism 134 are electrically connected to the bias lines 146 of the the actuator sub-mechanism 134 via the contact rails 145, support frame 136, and attachment arms 139 of the actuator sub-mechanism 134. Thus, when a periodic square wave bias signal is applied to the bias lines 146 by the control circuit 109 of FIG. 1, this signal is provided to the plates 140. Since the substrate 143 is grounded, this causes the plates 140 to be pulled down toward the insulating layer 144 each time the signal reaches a high voltage. The plates 140 are pulled down because of the flexure in the flexible conductive attachment arms 139. Each time this occurs, the bushings 142 of the SDAs 138 reach out and contact the insulating layer 144. Then, each time the signal goes to a low voltage, the plates 140 return to their original positions and the bushings 142 pull the entire actuator mechanism 123 forward or backward a step depending on whether the actuator sub-mechanism 134 is for forward or backward movement. In this way, the entire actuator mechanism 123 moves forward or backward in a stepwise fashion.

Each actuator mechanism 123 also comprises guiding overhangs 147 that are fixedly coupled to the outer bias lines 146 of the actuator sub-mechanisms 134. Each guiding overhang 147 is fixedly coupled to a corresponding bias line 146 by an anchor 148 of the corresponding actuator sub-mechanism 134. This enables the guiding overhang 147 to extend up from the corresponding bias line 146 along the outer surface and over the upper surface of the support frame 136 of the actuator sub-mechanism 134. Together, the guiding overhangs 147 collectively guide the entire actuator mechanism 123 as it moves forward or backward.

Referring now to FIG. 3, each antenna arm 110 can therefore be moved individually by appropriately controlling the corresponding actuator mechanism 123. Specifically, when the control circuit 109 of FIG. 1 applies a forward movement bias signal to the bias lines 146 of each actuator sub-mechanism 134 used for forward movement, the entire actuator mechanism 123 moves linearly forward. This in turn causes the corresponding support arm 122 to push on the antenna arm 110 via the corresponding hinges 124. This results in the antenna arm 110 rotating inward via the hinge 111. Similarly, when the control circuit 109 applies a backward movement bias voltage to the bias lines 146 of each actuator sub-mechanism 134 used for backward movement, the entire actuator mechanism 123 moves backward so that the support arm 122, via the corresponding hinges 124, pulls on the antenna arm 110 and the antenna arm rotates outward via the hinge 111.

Thus, by applying appropriate bias signals to the bias lines 146 and a ground to the substrate 143, the control circuit 109 of FIG. 1 can cause the antenna arms 110 to rotate so as to shape and/or steer an RF signal beam being transmitted by the vee antenna 104. For example, if both antenna arms 110 are rotated in the same direction in the same amount, the vee angle between the antenna arms 110 remains the same but the direction of the vee angle is changed. This results in the beam being steered in the direction of the vee angle. If the antenna arms 110 are rotated in opposite directions in the same amount, then the vee angle between them is changed and so is the shape of the beam.

In an alternative embodiment, each actuator mechanism 123 could comprise an array of side-drive actuators, such as those described in L. Fan, Y. C. Tai, and R. Muller, "IC Processed Electrostatic Micromotors", *Sensors and Actuators*, Vol. 20, pp. 41–47, November 1989. Or, each actuator mechanism 123 could comprise an array of comb-drive actuators, such as those described in W. Tang, T. Nguyen, and R. Howe, "Laterally Driven Polysilicon Resonant Microstructures", *Sensors and Actuators*, Vol. 20, pp. 25, November 1989. Both of these articles are hereby incorporated by reference. Additionally, thermal actuators, piezoelectric actuators, and electromagnetic actuators, or other types of actuators could also be used.

CPW MEMS Vee Antenna 204

Figure 11:
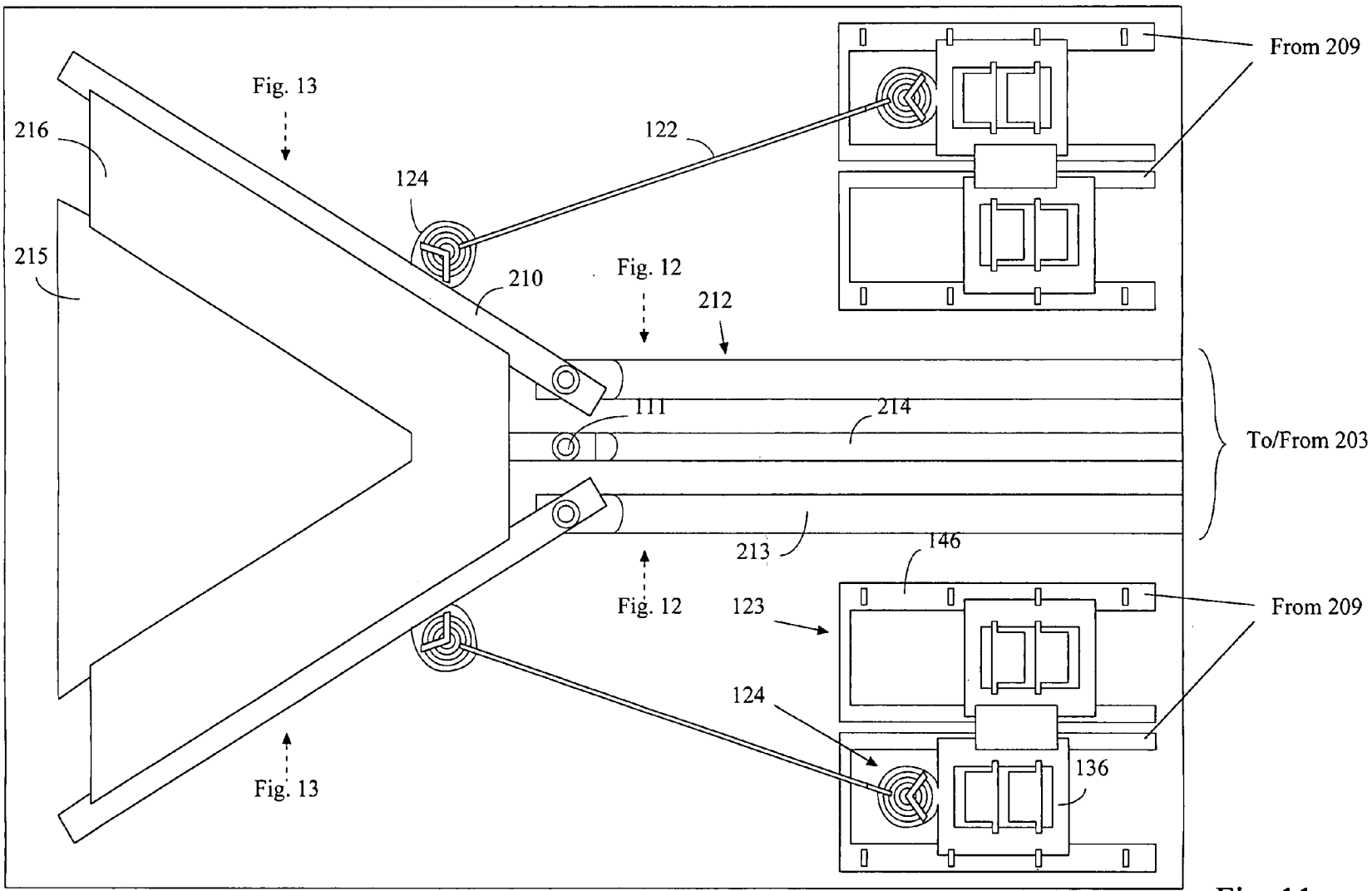
FIGS. 11 to 13 show a MEMS reconfigurable CPW vee antenna of the transceiver of FIG. 2 and various components thereof.

FIG. 11 shows the CPW MEMS vee antenna 204 of FIG. 2. It is electrically connected in series to a corresponding end portion of the CPW main transmission line 203 and is configured and operates similar to the MEMS reconfigurable CPS vee antenna 104 of FIG. 3. Thus, only the major differences will be discussed next.

Figure 12:
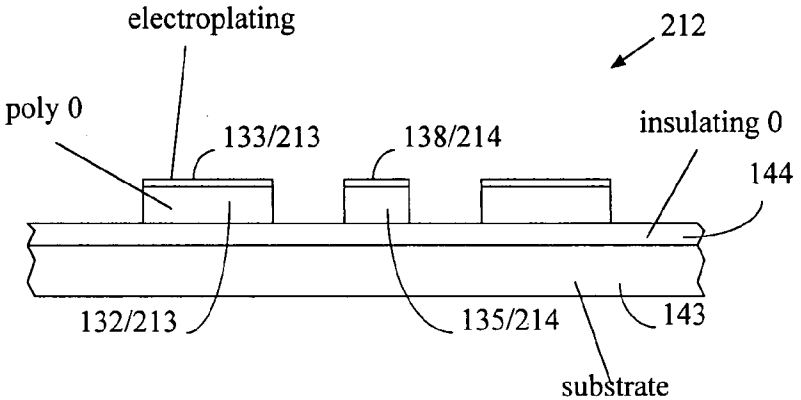

In this configuration, the vee antenna 204 is connected to the corresponding end portion of the CPW main transmission line 203 with the transmission line end 212 of the vee antenna 204. Like the main transmission line 203, the transmssion line end 212 comprises ground plane outer conductors 213 and a center conductor 214 between the ground plane outer conductors 213. As shown in FIG. 12, the ground plane outer conductors 213 are configured like the coplanar conductors 113 of the vee antenna 104 of FIG. 3 in that they each comprise a semiconductor strip 132 and a metal plating 133. The center conductor also comprises a semiconductor strip 135 and a metal plating 138. The conductors 213 and 214 are all coplanar and formed on the insulating layer 144.

Figure 13:
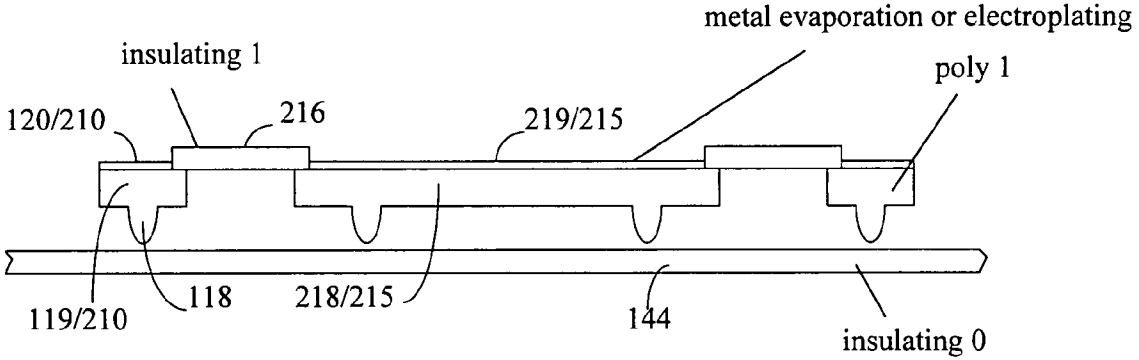

Referring back to FIG. 11, the vee antenna 204 comprises rotatable outer antenna arms 210. The antenna arms 210 are strip shaped and, as shown in FIG. 13, configured like the antenna arms 110 of the vee antenna 104 of FIG. 3 in that they each include a semiconductor strip 119 and a metal plating 120. Referring back to FIG. 11, each rotatable outer antenna arm 210 is electrically connected and rotatably coupled to a corresponding ground plane outer conductor 213 of the transmission line end 212 with a corresponding hinge 111. This is done in the same manner in which each antenna arm 110 of the vee antenna 104 of FIG. 3 is electrically connected and rotatably coupled to a corresponding conductor 113.

The vee antenna 204 also comprises a rotatable center antenna arm 215 between the rotatable outer antenna arms 210. The rotatable center antenna arm 215 is configured similar to the rotatable outer antenna arms 210 in that it includes semiconductor plate 218 and a metal plating 219, as shown in FIG. 13. However, the semiconductor plate 218 and the metal plating 219 are both triangular shaped. Thus, referring again to FIG. 11, the entire rotatable center antenna arm 215 is triangular shaped. The rotatable center antenna arm 215 is electrically connected and rotatably coupled to the center conductor 214 of the transmission line end 212 with a hinge 111. This is also done in the same manner in which each antenna arm 110 of the vee antenna 104 is electrically connected and rotatably coupled to a corresponding conductor 113.

The vee antenna 204 further comprises an insulating attachment bridge 216 that is vee shaped. As shown in FIG. 13, the insulating attachment bridge 216 is fixedly coupled to the semiconductor plate 218 of the rotatable center antenna arm 215 and the semiconductor strip 119 of each rotatable outer antenna arm 210. This maintains the gaps between the rotatable center antenna arm 215 and the rotatable outer antenna arms 210 when the rotatable outer antenna arms 210 are caused to be rotated. Rotation of the rotatable outer antenna arms 210 is peformed in the same manner and for the same purpose as is the rotation of the antenna arms 110 of the vee antenna 104 of FIG. 3.

CPS MEMS Impedance Tuner

Figure 14:
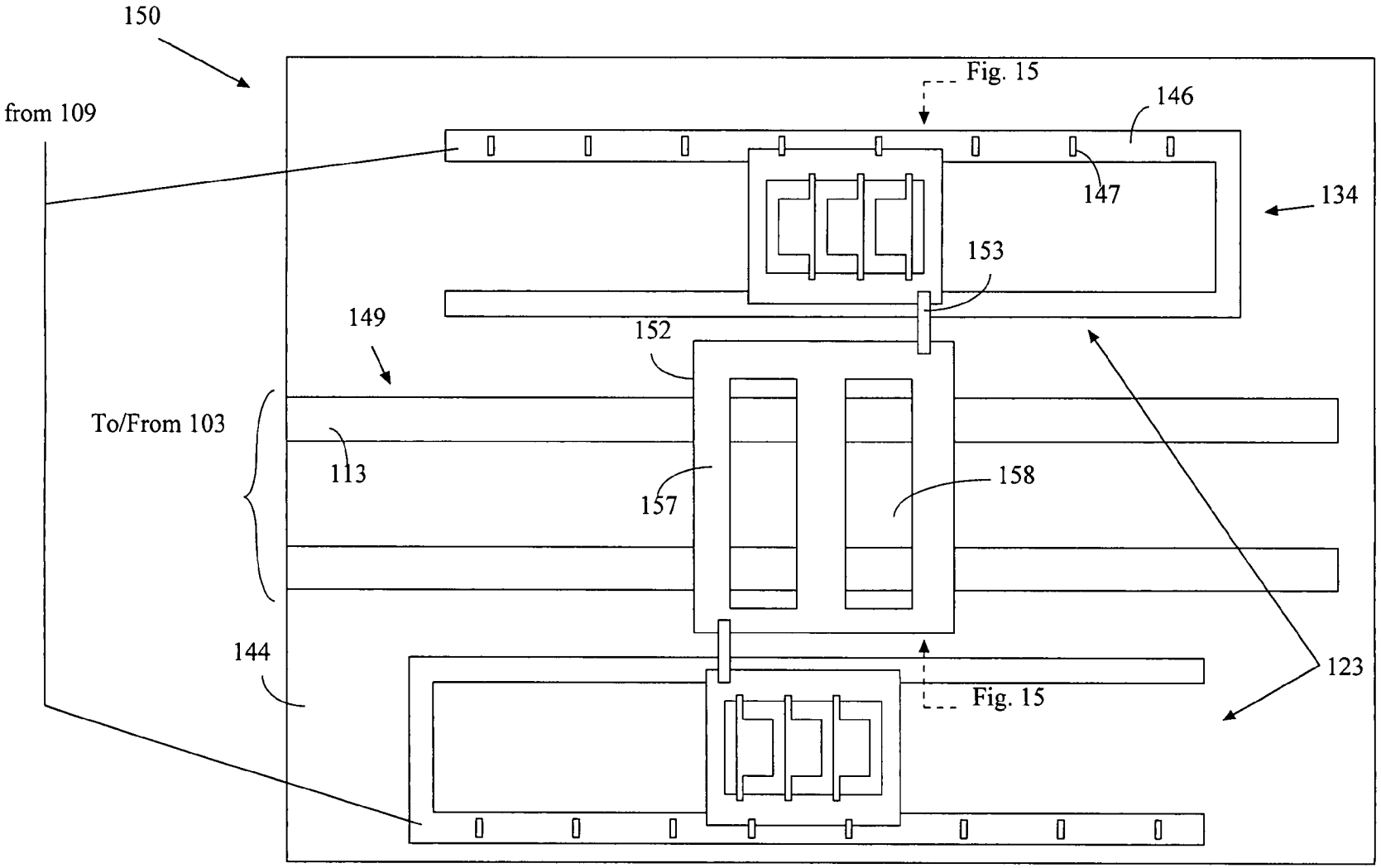
FIGS. 14 and 15 show a CPS MEMS impedance tuner of the transceiver of FIG. 1 and various components thereof.

Turning to FIG. 14, the CPS transmission line components 105 of FIG. 1 may include one or more CPS MEMS impedance tuners 150. In the transceiver 100 of FIG. 1, each impedance tuner 150 can be electrically connected in parallel with the CPS main transmission line 103 of the transceiver 100.

Referring back to FIG. 14, each impedance tuner 150 comprises the substrate 143 and the insulating layer 144 of the MEMS chip 101 of FIG. 1. Each impedance tuner 150 also comprises a CPS transmission line branch 149, a moveable conductive plate 152, insulating attachment arms 153, and an actuator mechanism 123.

One end of the CPS transmission line branch 149 is electrically connected to the CPS main transmission line 103 while the other end can be open or closed. The CPS transmission line branch 149 comprises coplanar conductors 113 configured like those in FIG. 4 for the CPS transmission line end 112 of the CPS vee antenna 104 of FIG. 3. One end of each conductor 113 of the CPS transmission line branch 149 is electrically connected to a corresponding conductor of the CPS main transmission line 103. In the case of one of the conductors 113, this can be done with an airbridge. The other end of each conductor 113 can be electrically unconnected so that the CPS transmission line branch 149 at this end is open. Or, the other end of each conductor 113 can be electrically connected to the same end of the other conductor 113 so that the CPS transmission line branch 149 at this end is closed.

Furthermore, the actuator mechanism 123 includes one actuator sub-mechanism 134 configured for forward movement and another actuator sub-mechanism 134 configured for backward movement. Each actuator mechanism 134 is configured and operates similar to the actuator sub-mechanism 134 in FIG. 8 for the vee antenna 104 of FIG. 3. Those skilled in the art will recognize that each actuator sub-mechanism 134 here could be replaced by an actuator mechanism 123 like that in FIG. 8 which has actuator sub-mechanisms 134 for both forward and backward movement.

Figure 15:
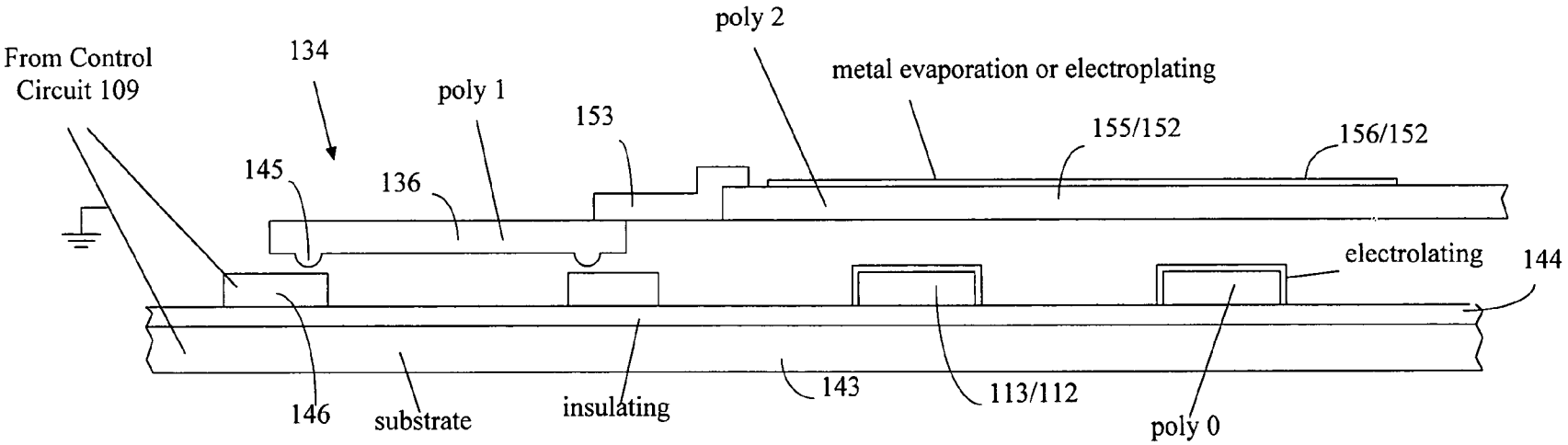

As shown in FIG. 15, the conductive plate 152 comprises a support plate 155 and a metal plate 156 formed on the support plate 155. The conductive plate 152 is fixedly coupled to each actuator mechanism by a corresponding insulating attachment arm 153. Each insulating attachment arm 153 is also fixedly coupled to the support frame 136 of a corresponding actuator mechanism 134. This could be done directly as shown or with an anchor or via. As a result, the conductive plate 152 is moveably suspended over the coplanar conductors 113 of the CPS transmission line branch 149 and a virtual short circuit is created at the front of the conductive plate 152. In an alternative configuration, the impedance tuner could include a stationary insulating or dielectric plate between the conductors 113 and the conductive plate 155.

Referring back to FIG. 14, by applying an appropriate bias signal to the bias lines 146 of an actuator mechanism 134 and a ground to the substrate 143, the control circuit 109 of FIG. 1 can cause the actuator mechanism 134 to move forward if it is configured for forward movement or backward if it is configured for backward movement. This in turn causes the conductive plate 152 to moveably slide over the conductors 113. By controlling the actuator mechanisms 134 in this way, the position of the conductive plate 152 can be changed so that the location of the virtual short circuit can be moved over a useful bandwidth. Since the transmission line branch 149 is electrically connected to the CPS main transmission line 103 in parallel, this changes the impedance of the CPS main transmission line 103. In this way, the impedance of the CPS main transmission line 103 can be selectively tuned.

The conductive plate 152 may have a cascade of several low impedance sections 157 separated by quarter wavelength openings 158 in the conductive plate 152 to increase the performance of the virtual short circuit. This increases the tuning range of the impedance tuner 150. The low impedance sections 157 extend completely over both conductors 113 of the CPS transmission line branch 149.

As shown in FIG. 1, two impedance tuners 150 can be each electrically connected in parallel with a portion of the CPS main transmission line 103 in the transceiver 100. In this way, the impedance of the CPS main transmission line 103 can be selectively tuned with full coverage inside the Smith Chart.

CPW MEMS Impedance Tuner

Figure 16:
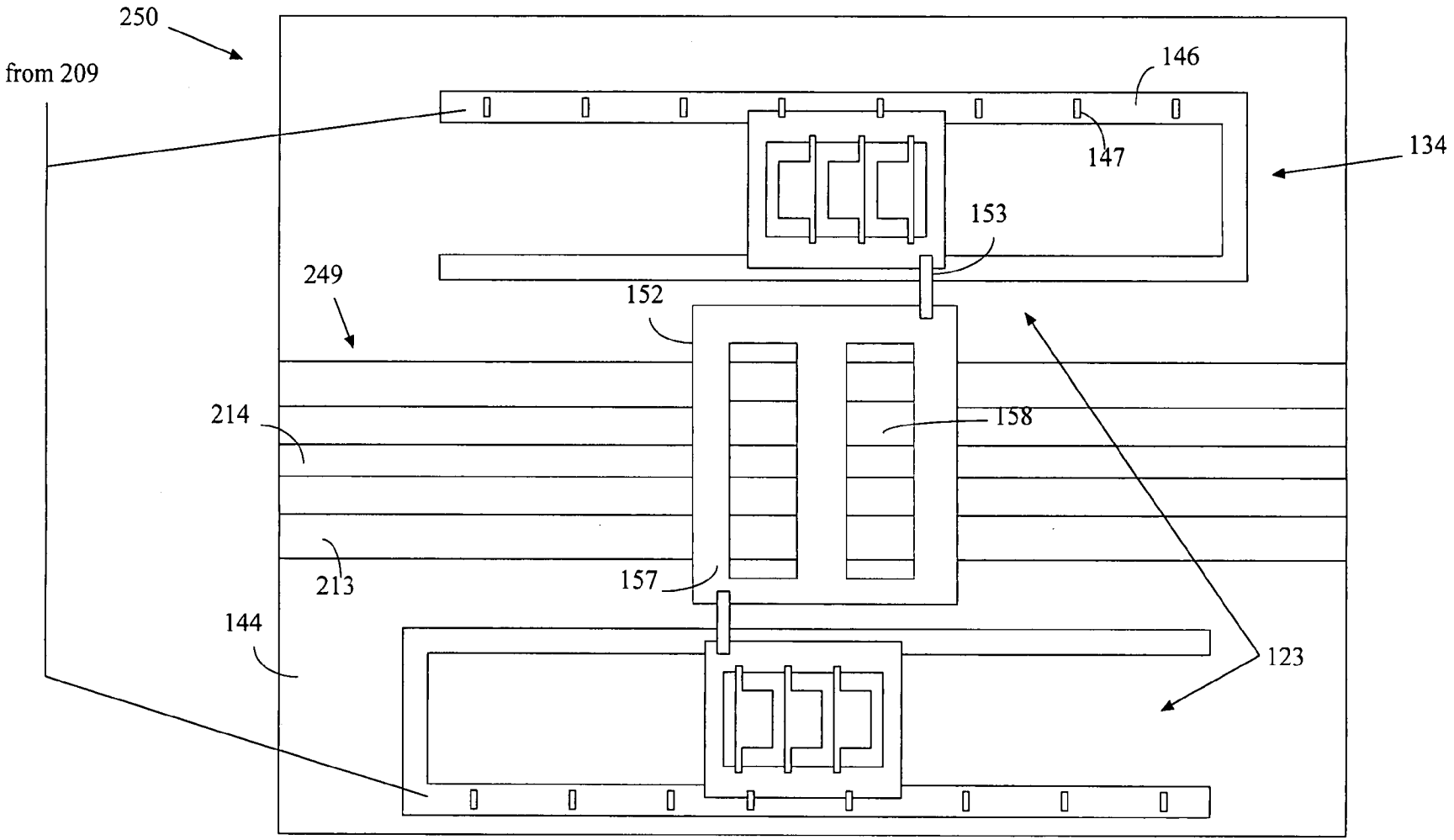
FIG. 16 shows a CPW MEMS impedance tuner of the transceiver of FIG. 2.

Turning to FIG. 16, the CPW transmission line components 205 of FIG. 2 may include one or more CPW MEMS impedance tuners 250 electrically connected in parallel with the CPW main transmission line 203. Each impedance tuner 250 is configured and operates similar to the impedance tuner 150 of FIG. 14, except for a few notable differences. Specifically, it comprises a CPW transmission line branch 249. As described for the vee antenna 204 of FIG. 11, the transmission line branch 249 comprises ground plane outer conductors 213 and a center conductor 214 that are all coplanar. The conductors 213 and 214 each have one end electrically connected to a corresponding conductor of the CPW main transmission line 203.

CPS MEMS Transmission Line Element

Figure 17:
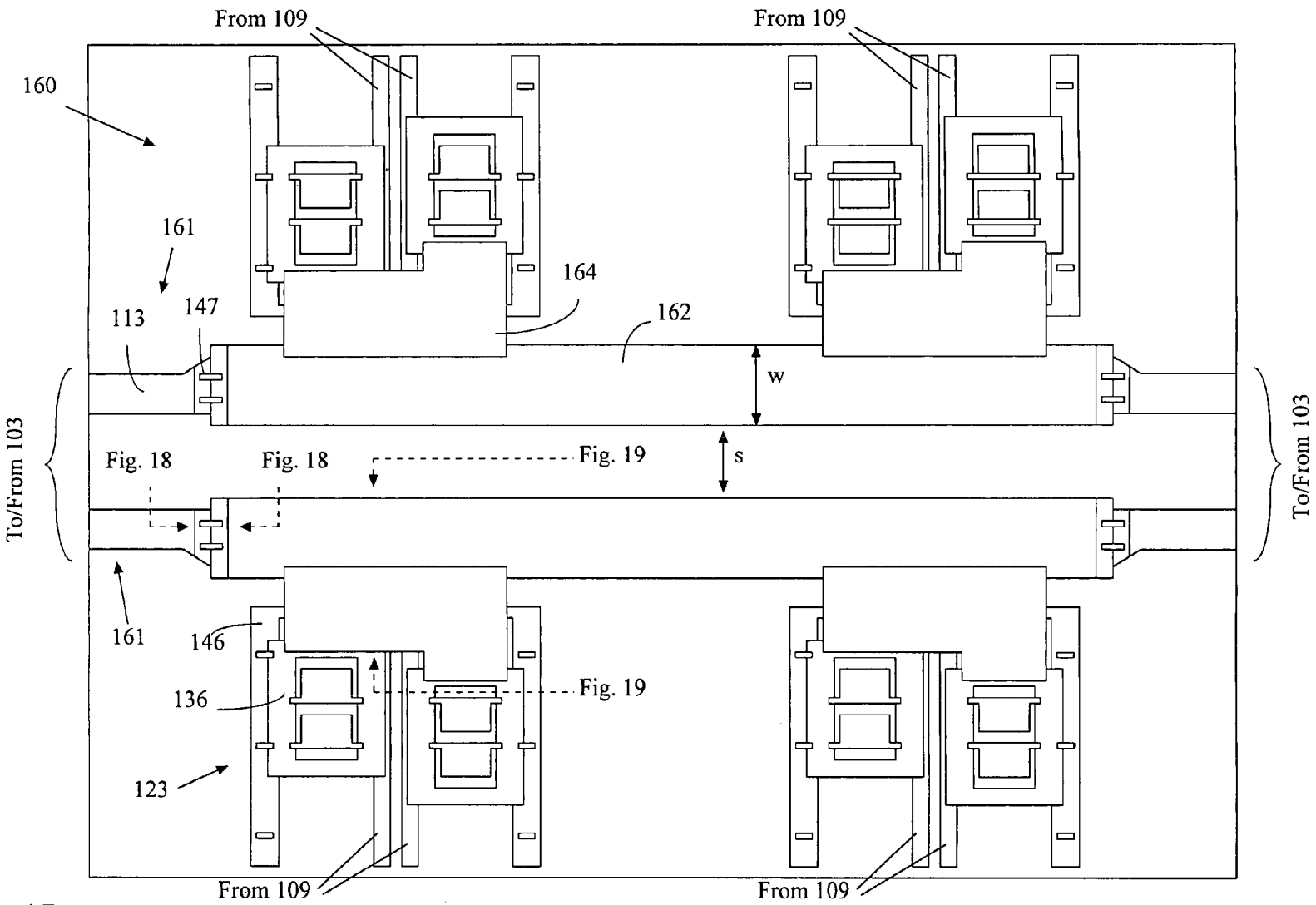
FIGS. 17 to 19 shows a MEMS reconfigurable CPS transmission line element of the transceiver of FIG. 1 and various components thereof.

The CPS MEMS transmission line components 105 of FIG. 1 may also include a MEMS reconfigurable CPS transmission line element 160 of the type shown in FIG. 17. In the transceiver 100 of FIG. 1, the transmission line element 160 could be electrically connected in parallel with the CPS main transmission line 103 of the transceiver 100 in a similar manner to that for the impedance tuner 150. Or, the transmission line element 160 could be electrically connected in series with and between two portions of the CPS main transmission line 103. The transmission line element 160 could be used instead of or in conjunction with the impedance tuner 150 of FIG. 13 in the transceiver 100 for impedance matching, impedance tuning, and/or filtering.

As shown in FIG. 17, the CPS transmission line element 160 comprises the substrate 143 and the insulating layer 144 of the MEMS chip 101 of FIG. 1. It also comprises CPS transmission line ends 161, moveable coplanar conductors 162, guiding overhangs 147, insulating attachment bridges 164, and actuator mechanisms 123.

The CPS tranmission line ends 161 are located on opposite sides of the transmission line element 160. Each CPS tranmission line end 161 can be electrically connected to a corresponding portion of the CPS main transmission line 103. Each CPS transmission line end 161 comprises coplanar conductors 113 that are configured like those in FIG. 4 for the transmission line end 112 of the vee antenna 104 of FIG. 3. Each coplanar conductor 113 is electrically connected to a corresponding coplanar conductor of the CPS main transmission line 103 and, as will be discussed next, serves as an electrical contact to a corresponding moveable coplanar conductor 162.

Figure 18:
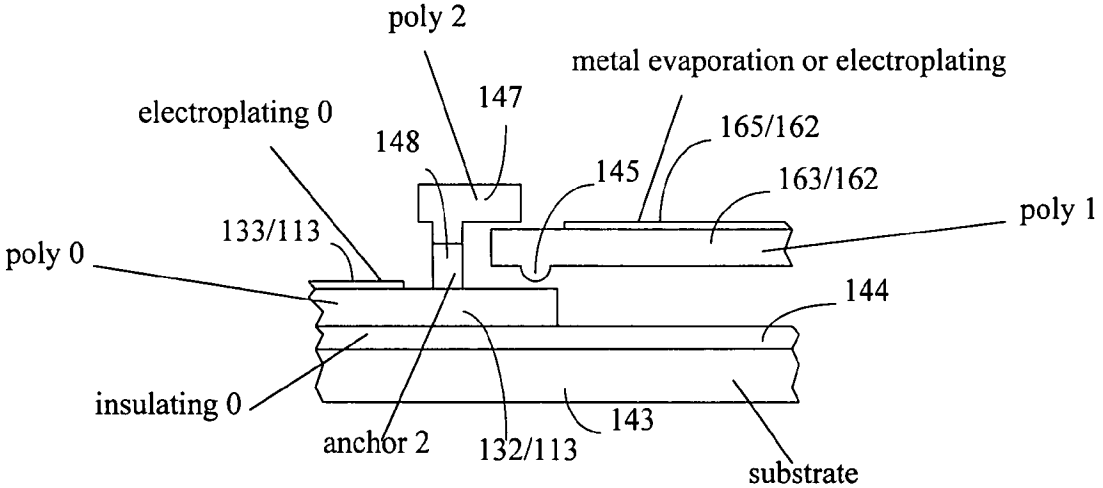

As shown in FIG. 18, at each end, each moveable coplanar conductor 162 is electrically connected to and slidably contacts a corresponding coplanar conductor 113 of a corresponding transmission line end 161. Each moveable coplanar conductor 162 comprises a semiconductor strip 163, a metal plating 165 formed on the semiconductor strip 163, and a contact rail 145 at each end. Each contact rail 145 is electrically connected and fixedly coupled to the semiconductor strip 163 and, in fact, may be integrally formed with the semiconductor strip 163. Each contact rail 145 slides on and electrically contacts the corresponding coplanar conductor 113. Referring to FIG. 17, in this way, each moveable coplanar conductor 162 is electrically connected between the corresponding coplanar conductors 113 of the two transmission line ends 161.

Referring back to FIG. 18, each guiding overhang 147 is configured like that shown in FIG. 9 and is fixedly coupled and electrically connected to the semiconductor strip 132 of a corresponding coplanar conductor 113. This is done with a corresponding anchor 148 of the transmission line element 160. Each guiding overhang 147 guides a corresponding moveable coplanar conductor 162 as it slides on the semiconductor strip 132 of the corresponding coplanar conductor 113.

Figure 19:
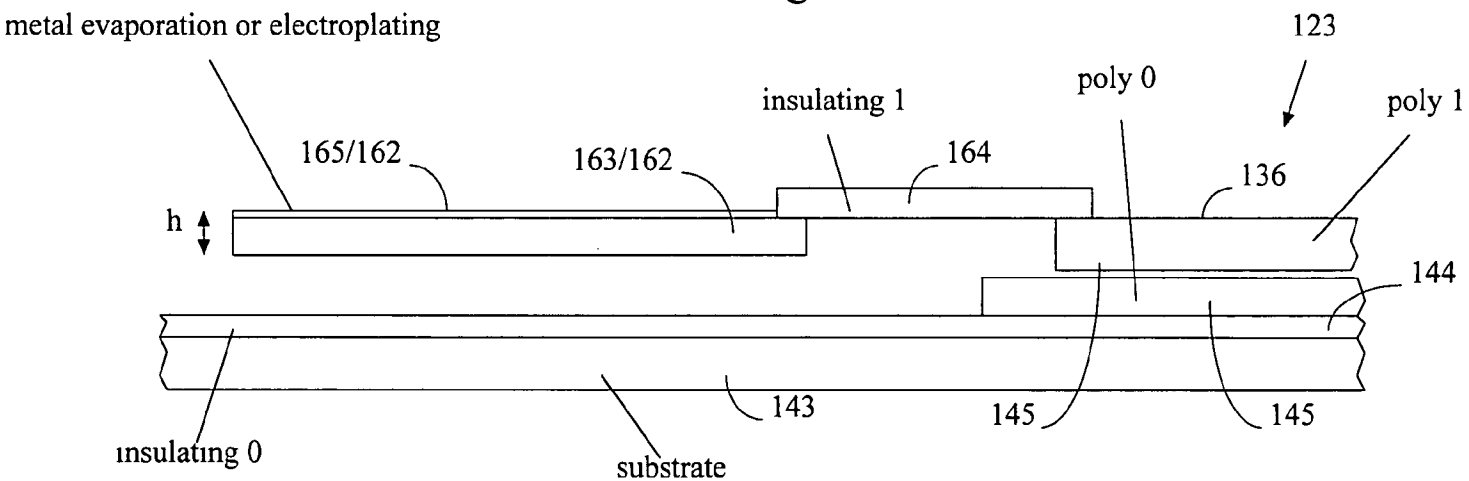

Turning back to FIG. 17, each moveable coplanar conductor 162 is moved using corresponding actuator mechanisms 123. Each actuator mechanism 123 is configured and operates similar to the one in FIG. 8 for the vee antenna 104 of FIG. 3. As shown in FIG. 19, a corresponding insulating attachment bridge 164 fixedly couples the support frame 136 of each actuator mechanism 123 to the semiconductor strip of the corresponding moveable coplanar conductor 162.

Referring back to FIG. 17, the impedance z of the transmission line element 160 is based on the gap spacing s between the moveable coplanar conductors 162 and the width w and height h of each moveable coplanar conductor 162. More specifically, the impedance z is given by:

$$z \cong \frac{120\pi}{\sqrt{\epsilon_{eff}}} \frac{K(k)}{K(k')} \quad \text{Eq. (1)}$$

where:

$$\epsilon_{eff} = 1 + \frac{\epsilon_r - 1}{2} \frac{K(k')}{K(k)} \frac{K(kl)}{K(kl')} \quad \text{Eq. (2)}$$

$$k = \frac{\frac{s}{2}}{\frac{s}{2} + w} \quad \text{Eq. (3)}$$

$$kl = \frac{\sin\left(\frac{\pi \frac{s}{2}}{2h}\right)}{\sinh\left(\frac{\pi\left(\frac{s}{2} + w\right)}{2h}\right)} \quad \text{Eq. (4)}$$

and K(k) and K(kl) are complete elliptic functions and K(k') and K(kl') are their respective complements, k and kl are the corresponding wave numbers, and $\epsilon_r$ is the characteristic dielectric constant of the gap.

The actuator mechanisms 123 can be controlled to change the position of the moveable coplanar conductors 162. Specifically, the control circuit 109 of FIG. 1 can cause the actuator mechanisms 123 to move forward or backward by applying appropriate bias signals to the bias lines 146 of the actuator mechanisms 123 and a ground to the substrate 143. This causes the moveable coplanar conductors 162 to move inward towards each other so that the gap spacing s is reduced or outward away from each other so that the gap spacing s is increased. Since the impedance z of the transmission line element 160 is dependent on the gap spacing s, changing the gap spacing s in the manner just described changes the impedance z. In this way the impedance z of the transmission line element 160 can be selectively adjusted for impedance tuning of the CPS main transmission line 103 or impedance matching of the two portions of the CPS main transmission line 103 that are electrically connected to the transmission line element 160.

CPW MEMS Transmission Line Element

Figure 20:
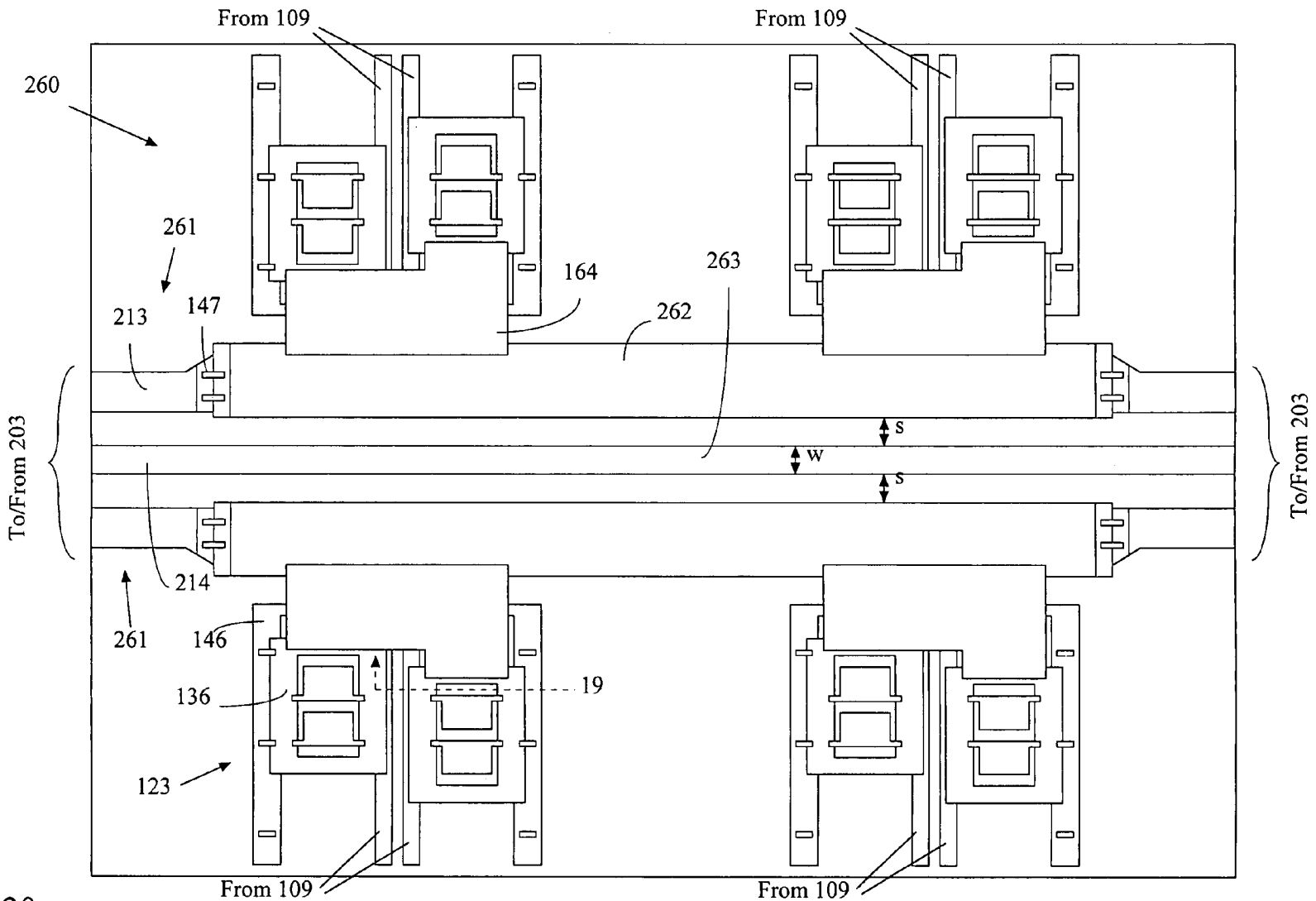
FIG. 20 shows a MEMS reconfigurable CPW transmission line element of the transceiver of FIG. 2.

Turning to FIG. 20, the CPW transmission line components 205 of FIG. 2 may also include a CPW MEMS transmission line element 260 connected in parallel with the CPW main transmission line 20 or in series with it between portions. The transmission line element 260 is configured and operates similar to the transmission line element 160 of FIG. 17, except that it comprises CPW transmission line ends 261, moveable coplanar conductors 262, and a stationary center conductor 263.

The CPW tranmission line ends 261 are located on opposite sides of the transmission line element 260. Each transmission line end 261 can be electrically connected to a corresponding portion of the CPW main transmission line 203. Like the CPW transmission line end 212 in FIG. 12 of the vee antenna 204 of FIG. 10, each CPW transmission line end 261 comprises ground plane outer conductors 213 and a center conductor 214 that are all coplanar.

The center conductors 214 of the transmission line ends 261 are fixedly coupled and electrically connected to the stationary center conductor 263 of the transmission line element 260. The stationary center conductor 263 is configured like each center conductor 214 because it comprises a semiconductor strip 135 and a metal plating 138 on the semiconductor strip 135. In fact, the stationary center conductor 263 may be integrally formed with the center conductors 214.

The ground plane conductors 213 of the transmission line ends 261 are each electrically connected to a corresponding ground plane conductor of the CPW main transmission line 203. Each serves as an electrical contact to a corresponding moveable ground plane conductor 262. Specifically, at each end, each moveable ground plane conductor 262 slidably contacts and is electrically connected to a corresponding ground plane conductor 213. Referring to FIG. 18, this is done in the same manner in which each moveable coplanar conductor 162 slidably contacts and is electrically connected at each end to a corresponding coplanar conductor 113. Each moveable ground plane conductor 262 is configured and moveable in the same manner as is each moveable coplanar conductor 162 of FIG. 19 of the CPS transmission line element 160.

Referring back to FIG. 20, the impedance z of the transmission line element 260 is similar to the impedance z given in Eqs. (1) to (4) for the CPS transmission line element 160 of FIG. 17. However, the impedance z in this case is based on the gap spacing s between the moveable coplanar conductors 262 and the stationary center conductor 263, the width w of the stationary center conductor 263, and the height h of each moveable coplanar conductor 262. The impedance z is given by:

$$z \cong \frac{30\pi}{\sqrt{\epsilon_{eff}}} \frac{K(k')}{K(k)} \quad \text{Eq. (5)}$$

where:

-continued $$\epsilon_{eff} = 1 + \frac{\epsilon_r - 1}{2} \frac{K(k')}{K(k)} \frac{K(kl)}{K(kl')} \quad \text{Eq. (6)}$$

$$k = \frac{\frac{w}{2}}{\frac{w}{2} + s} \quad \text{Eq. (7)}$$

$$kl = \frac{\sin\left(\frac{\pi \frac{w}{2}}{2h}\right)}{\sinh\left(\frac{\pi\left(\frac{w}{2} + s\right)}{2h}\right)} \quad \text{Eq. (8)}$$

The impedance z of the transmission line element 260 can therefore be selectively adjusted by changing the gap spacing s. This is done in a similar manner to that for the transmission line element 160 of FIG. 17 by causing the actuator mechanisms 123 to change the positions of the moveable coplanar conductors 262. And, similar to the transmission line element 160, this may be done for impedance tuning of the CPW main transmission line 203 or impedance matching of the two portions of the CPW main transmission line 203 that are electrically connected to the transmission line element 260.

CPS MEMS Transmission Line Element

Figure 21:
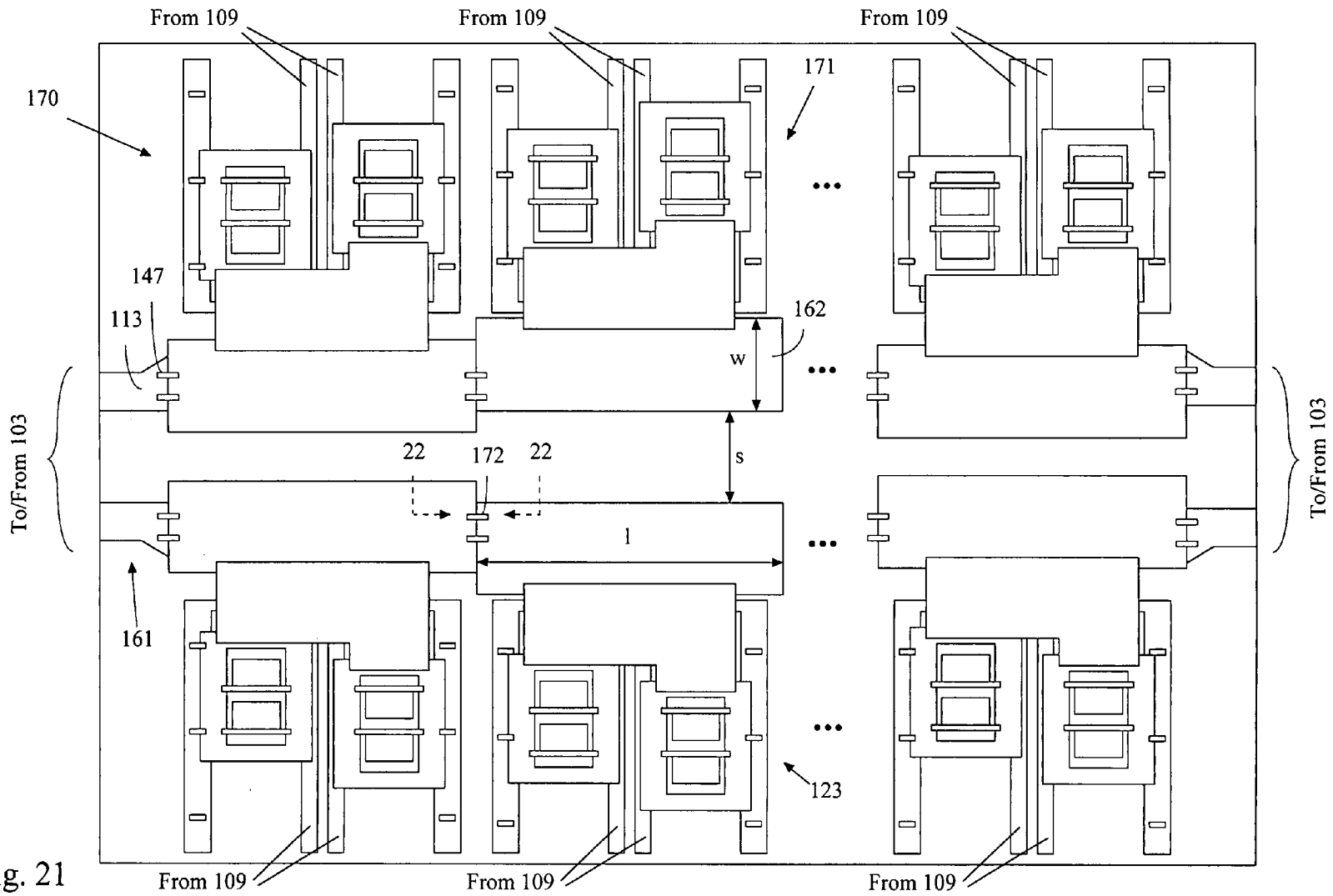
FIGS. 21 and 22 show another MEMS reconfigurable CPS transmission line element of the transceiver of FIG. 1 and various components thereof.

Referring now to FIG. 21, the CPS MEMS transmission line components 105 of FIG. 1 may include another CPS transmission line element 170 that may be used as a filter or an impedance matcher. Like the CPS transmission line element 160 of FIG. 17, the CPS transmission line filter 170 would be connected in series with and between portions of the CPS main transmission line 103 of FIG. 1. The CPS transmission line element 170 is electrically connected and configured and operates similar to the transmision line element 160, except that it comprises a cascade of at least two CPS MEMS transmission line sections (or sub-elements) 171.

Like the transmission line element 160, each transmission line section 171 comprises two moveable coplanar conductors 162, insulating attachment bridges 164, and actuator mechanisms 123. In the manner described earlier for the transmission line element 160, each moveable coplanar conductor 162 of a transmission line section 171 is fixedly coupled to a corresponding actuator mechanism 123 by a corresponding insulating attachment bridge 164 and can be moved inward or outward by the actuator mechanism 123.

The moveable coplanar conductors 162 of the first and last transmission line sections 171 are each electrically connected to a corresponding coplanar conductor 213 of the corresponding CPS transmission line end 161. This is done in the same manner as with the transmission line element 160.

Figure 22:
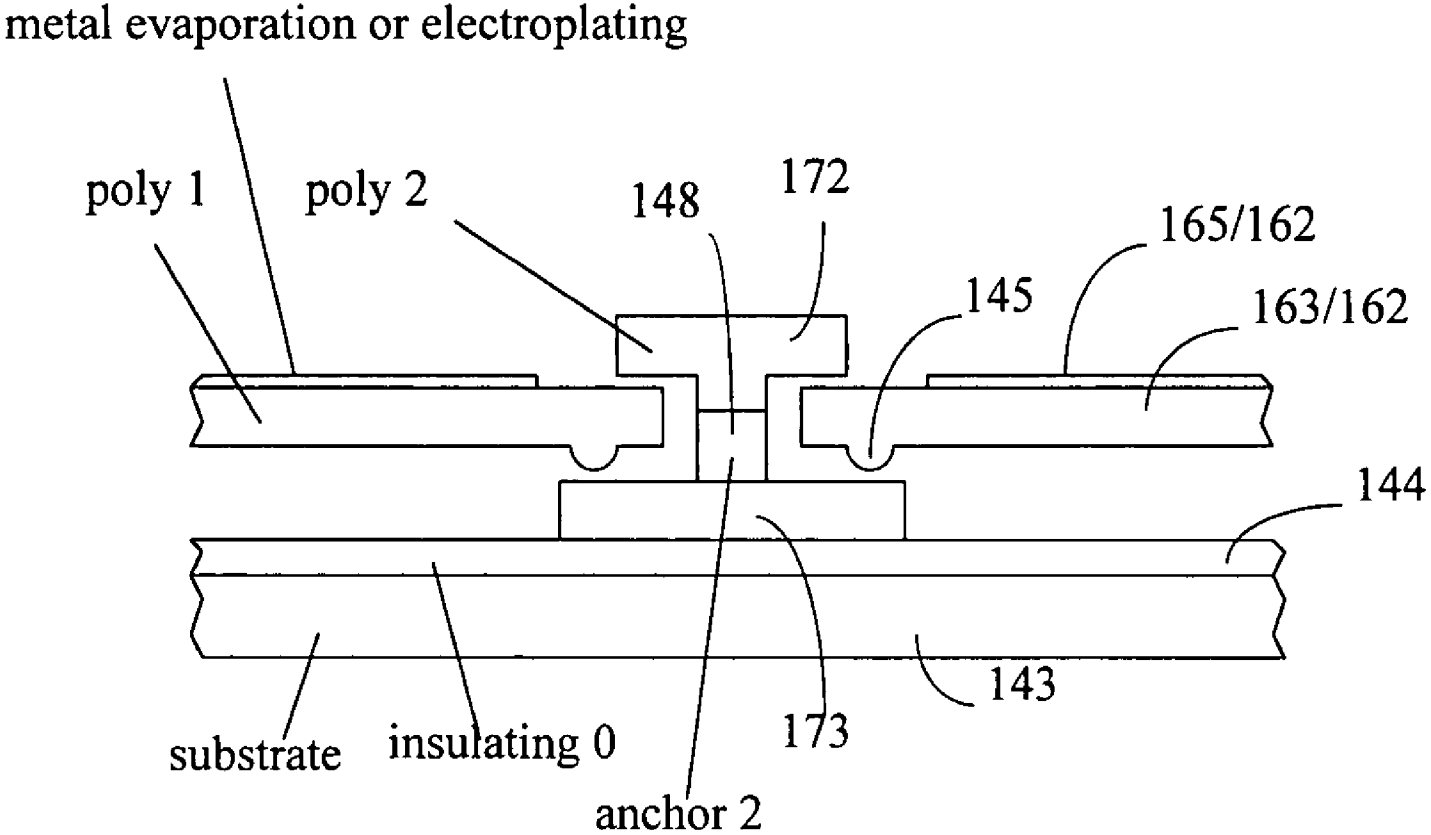

The transmission line element 170 also comprises dual guiding overhangs 172. Each dual guiding overhang 172 is located between and guides adjoining moveable coplanar conductors 162 of adjoining transmission line sections 171. As shown in FIG. 22, the dual guiding overhangs 172 are fixedly coupled and electrically connected to semiconductor electrical contacts 173 of the transmission line element 170. Each guiding overhang 172 extends up from a corresponding connection contact 173 along the outer surfaces and over the upper surfaces of adjacent moveable ground plane conductors 162.

Still referring to FIG. 22, the electrical contacts 173 are themselves fixedly coupled to and formed on the insulating layer 144 of the MEMS chip 101. Each electrical contact 173 serves as an electrical contact for electrically connecting adjoining moveable coplanar conductors 162 of adjoining CPS transmission line sections 171. Specifically, adjoining moveable coplanar conductors 162 each slidably contact the same electrical contact 173 and are therefore each electrically connected to this electrical contact 173.

The impedance z of each transmission line section 171 is dependent on the gap spacing s between its moveable coplanar conductors 161 and the width w and height h of its moveable coplanar conductors 162. This impedance z is therefore the same as that of the CPS transmission line element 160 of FIG. 17 and given by Eqs. 1 to 4. Like the transmission line element 160, the moveable coplanar conductors 162 of each transmission line section 171 can be moved inward or outward with the corresponding actuator mechanism 123 to change the gap spacing s and therefore the impedance z of the section. This is done in the same manner as described earlier for the transmission line element 160.

By dynamically adjusting the moveable coplanar conductors 162, a dynamically reconfigurable transmission line element 170 is achieved. The cascade of different impedances for the different transmission line sections 171 changes the overall frequency response of transmittance and reflectance. In this way, the transmission line element 170 can be reconfigured as an adjustable low-pass or band-pass filter, an adjustable impedance matcher for matching the impedances of the portions of the CPS main transmission line 103 electrically connected to the transmission line element 170, or an adjustable impedance tuner for adjusting the impedance of the CPS main transmission line 103.

Furthermore, the phase θ of each transmission line section 171 is based on the length 1 of the section. By making adjacent transmission line sections 171 have the same impedance, longer transmission line sections can be made with different phases. Thus, the phases can be changed as well as the impedances.

CPW MEMS Transmission Line Element

Figure 23:
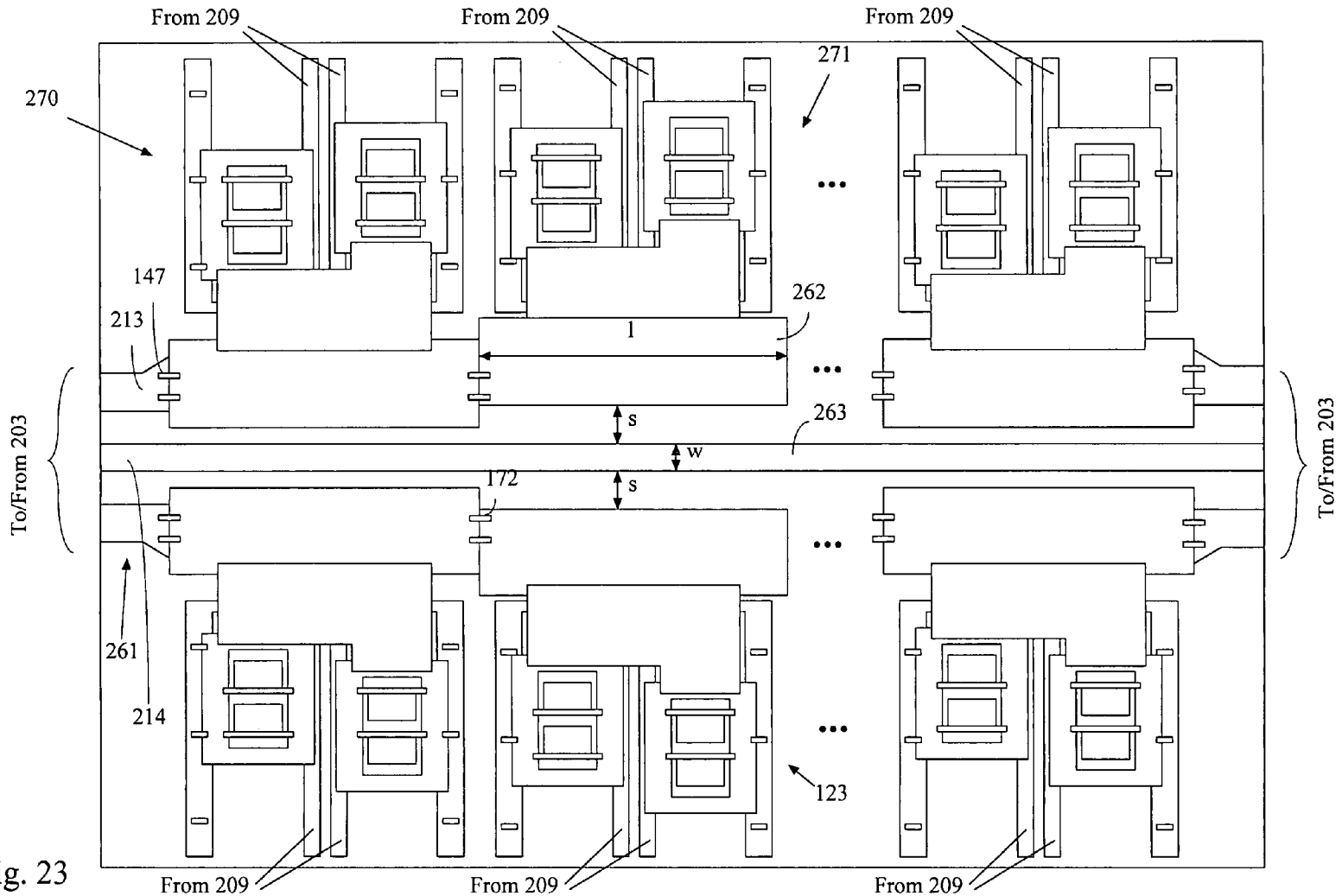
FIG. 23 shows another MEMS reconfigurable CPW transmission line element of the transceiver of FIG. 2.

Referring now to FIG. 23, the CPW transmission line components 205 of FIG. 2 may also include a CPW MEMS transmission line element 270 connected in series between portions of the CPW main transmission line 203 or in parallel with the CPW main transmission line 203. The transmission line element 270 is configured and operates similar to the transmission line element 170 of FIG. 22 and can also be used as a filter, impedance tuner, or impedance matcher. It, however, comprises a cascade of at least two CPW MEMS transmission line sections (or sub-elements) 271 and CPW transmission line ends 261.

Each transmission line end 261 can be electrically connected to a corresponding portion of the CPW main transmission line 203. And, each transmission line end 261 is configured like each of those of the transmission line element 260 of FIG. 20.

Each transmission line section 271 is electrically connected and configured and operates similar to a transmission line section 171 of the transmission line element 170 of FIG. 22, except that it comprises two moveable ground plane conductors 262, and a stationary center conductor 263. The moveable ground plane conductors 262 are like those of the transmission line element 270 of FIG. 23. Thus, adjoining moveable ground plane conductors 262 are electrically connected together with the same connection contact 173 and are guided by the same dual guiding overhangs 172 when they slide on the connection contact 173. And, the moveable ground plane conductors 262 of the first and last transmission line sections 271 are each electrically connected to a corresponding ground plane conductor 213 of a corresponding transmission line end 261. This is accomplished in the same manner as with the transmission line element 260.

The stationary center conductor 263 of each transmission line section 271 is configured like that of the transmission line element 260 of FIG. 20. Adjoining stationary center conductors 263 are fixedly coupled and electrically connected together. And, the stationary center conductors 263 of the first and last transmission line sections 271 are each fixedly coupled and electrically connected to the center conductor 214 of the corresponding CPW transmission line end 261. The center conductor 214 and the stationary center conductors 263 may be integrally formed together.

Like the transmission line element 260 of FIG. 20, the moveable coplanar conductors 262 of each transmission line section 271 can be moved inward or outward with the corresponding actuator mechanism 123 to change the gap spacing s and therefore the impedance z of the section. This is done in the same manner as described earlier for the transmission line element 260 for reconfiguring the transmission line element 270 as an adjustable low-pass or band-pass filter, an adjustable impedance matcher for matching the impedances of the portions of the CPW main transmission line 203 electrically connected to the transmission line element 270, or an adjustable impedance tuner for adjusting the impedance of the CPW main transmission line 203. The impedance z of each transmission line section 271 is the same as that given in Eqs. 5 to 8 for the transmission line element 260 of FIG. 20.

Moreover, longer transmission line sections can be made with different phases by combining adjacent transmission line sections 271. In doing so, adjacent transmission line sections 271 would be configured to have the same gap spacing s and therefore the same impedance. This forms a longer transmission line section with the same impedance as each individual transmission line section 271, but with a different phase.

Microstrip MEMS Transmission Line Element

Figure 24:
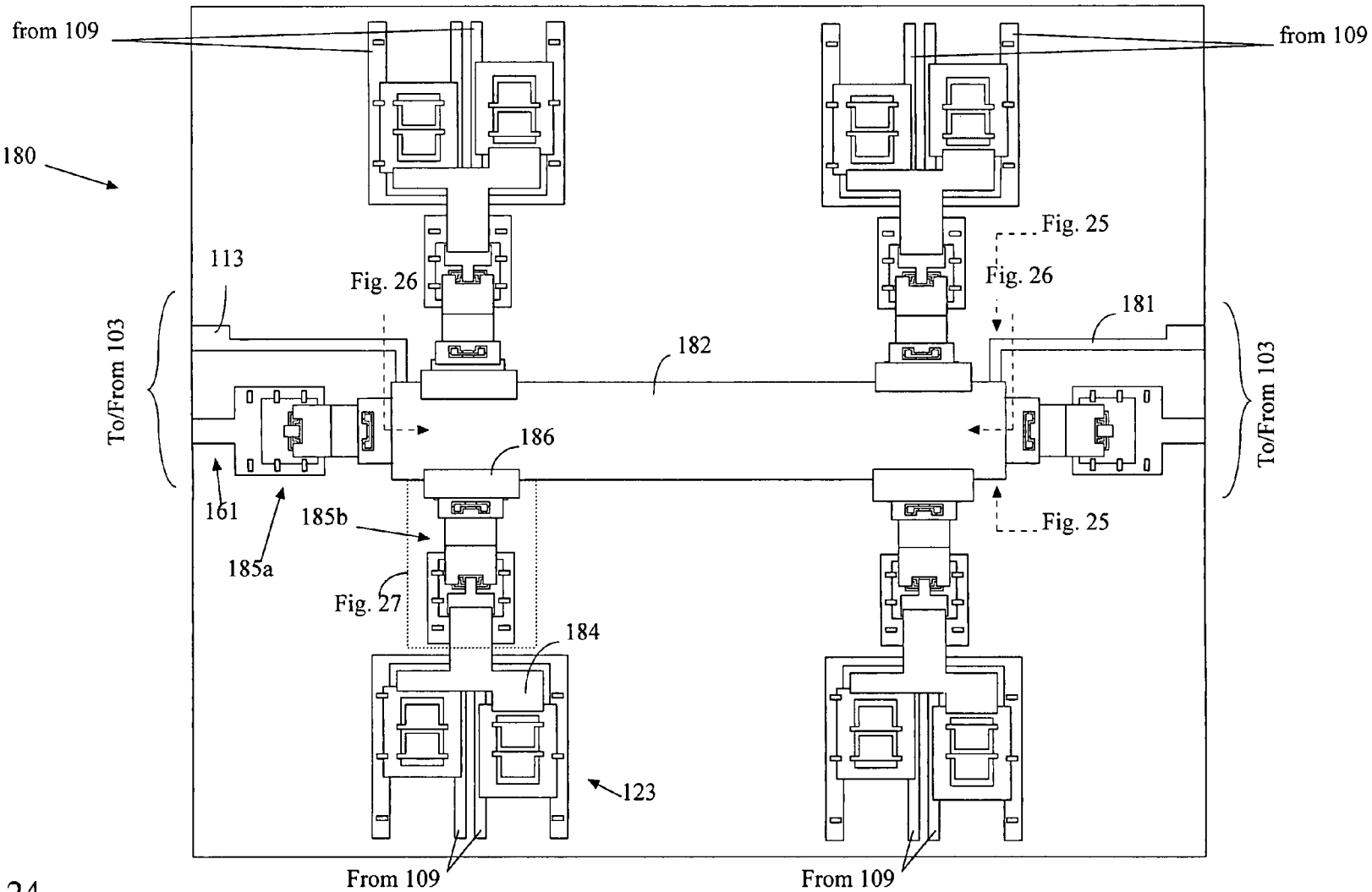
FIGS. 24 to 29 show a MEMS reconfigurable microstrip transmission line element of the transceiver of FIG. 1 and various components thereof.

FIG. 24 shows a microstrip MEMS transmission line element 180 which could be used instead of the transmission line element 160 of FIG. 17 as a adjustable impedance matcher. Thus, like the CPS transmission line element 160, the microstrip transmission line element 180 could be electrically connected in series with and between portions of the CPS main transmission line 103 of FIG. 1 or in parallel with the CPS main transmission line 103.

Figure 25:
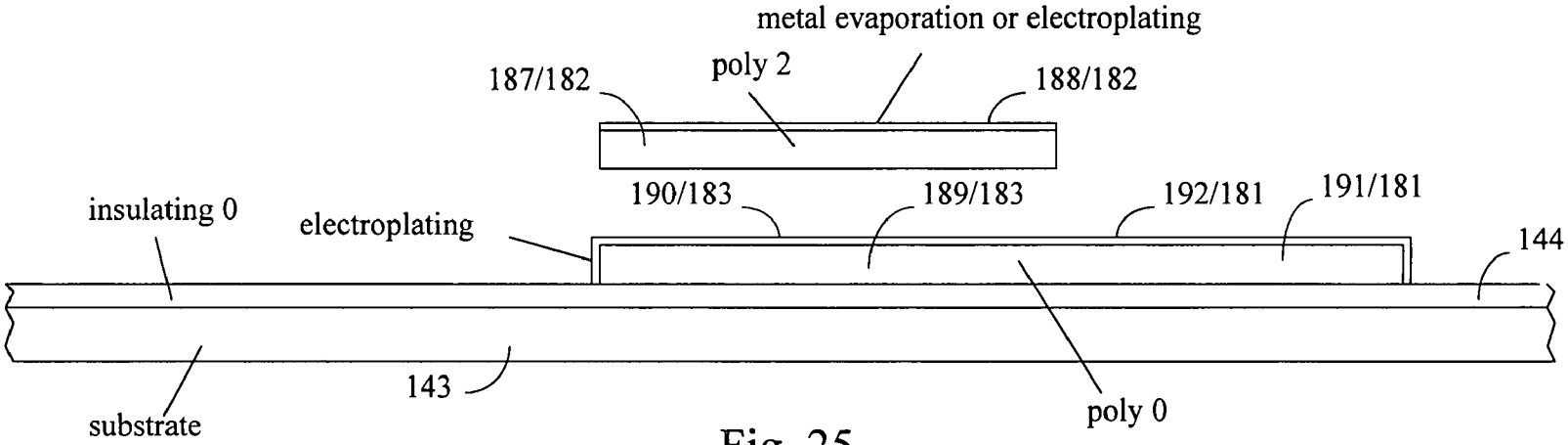
Figure 26:
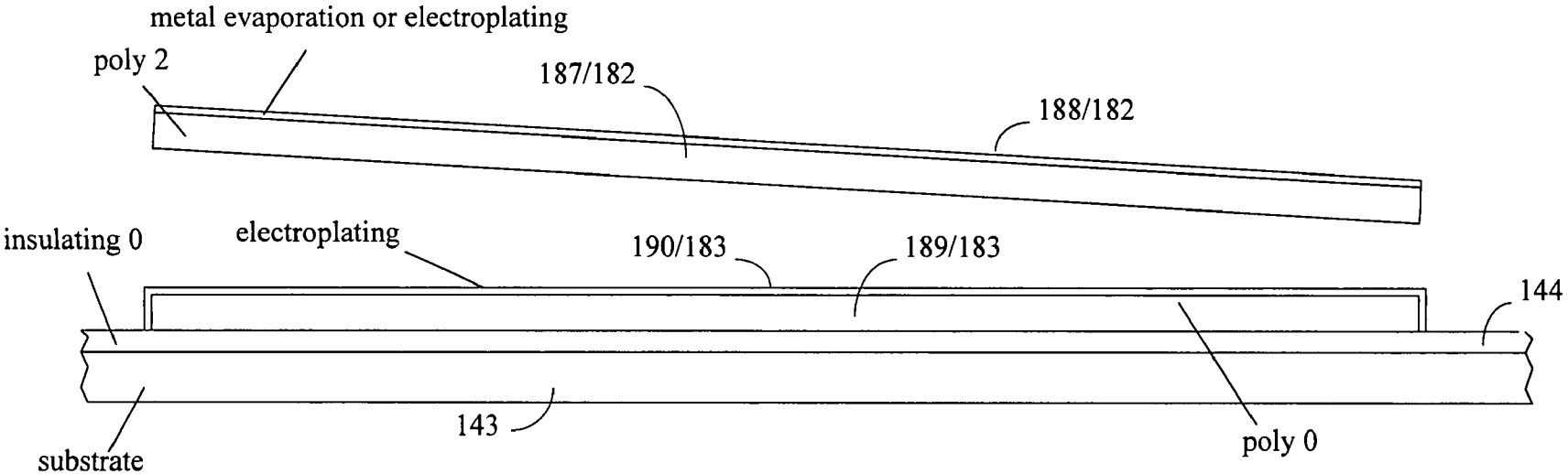

As shown in FIG. 24, the microstrip transmission line element 180 comprises CPS transmission line ends 161, interconnects 181, a moveable planar conductor 182, insulating attachment bridges 184 and 186, micro-mechanical moveable hinge assemblies 185, and actuator mechanisms 123. And, as shown in FIGS. 25 and 26, the microstrip transmission line element 180 additionally comprises a stationary planar conductor 183 below the moveable planar conductor 182 and the substrate 143 and insulating layer 144 of the MEMS chip 101 of FIG. 1.

Referring to FIG. 24, the CPS tranmission line ends 161 are located on opposite sides of the microstrip transmission line element 180 and are electrically connected to corresponding portions of the CPS main transmission line 103. The CPS transmission line ends 161 are configured like those of the CPS transmission line element 160 of FIG. 17. Thus, the coplanar conductors 113 of each CPS transmission line end 161 are each electrically connected to a corresponding coplanar conductor of the corresponding portion of the CPS main transmission line.

The ends of the stationary planar conductor 183 are fixedly coupled and electrically connected to the other coplanar conductors 113 of the CPS transmission line ends 161. Each end of the stationary planar conductor 183 is fixedly coupled and electrically connected to a corresponding coplanar conductor by a corresponding interconnect 181.

In contrast, each end of the moveable planar conductor 182 is moveably coupled and electrically connected to a corresponding coplanar conductor 113 of the corresponding CPS transmission line end 161 at that end of the moveable planar conductor 182. Specifically, each end of the moveable planar conductor 182 is moveably coupled and electrically connected to a corresponding coplanar conductor 113 by a corresponding moveable hinge assembly 185.

Each end of the moveable planar conductor 182 is also moveably coupled to corresponding actuator mechanisms 123 by corresponding moveable hinge assemblies 185 and corresponding insulating attachment bridges 184 and 186. These moveable hinge assemblies 185 translate the lateral forward and backward movement of the actuator mechanisms 123 into vertical up and down movement of the corresponding end of the moveable planar conductor 182.

Referring now to FIGS. 25 and 26, the moveable planar conductor 182 comprises a semiconductor strip 187 and a metal plating 188 formed on the semiconductor strip 187. Similarly, the stationary planar conductor 183 also comprises a semiconductor strip 189 and a metal plating 190 formed on the semiconductor strip 189. And, each interconnect 181 comprises a semiconductor strip 191 and a metal plating 192 formed on the semiconductor strip 191. The semiconductor strip 191 of each interconnect 181 fixedly coupled and electrically connected to the semiconductor strip 189 of the stationary planar conductor 183 and may be integrally formed with it. Similarly, the metal plating 192 of each interconnect 181 may be fixedly coupled and electrically connected to the metal plating 190 of the stationary planar conductor 183 and may be integrally formed with it.

Figure 27:
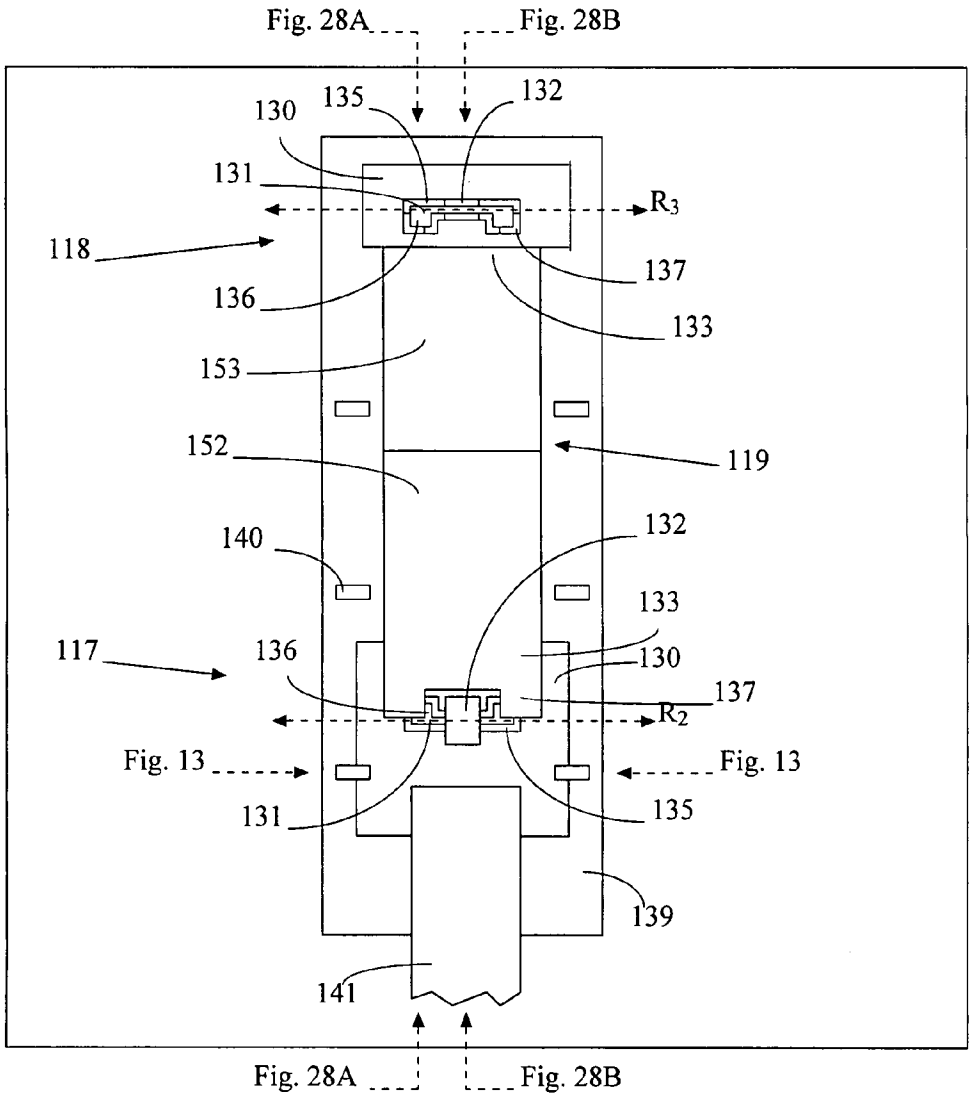
Figure 28A:
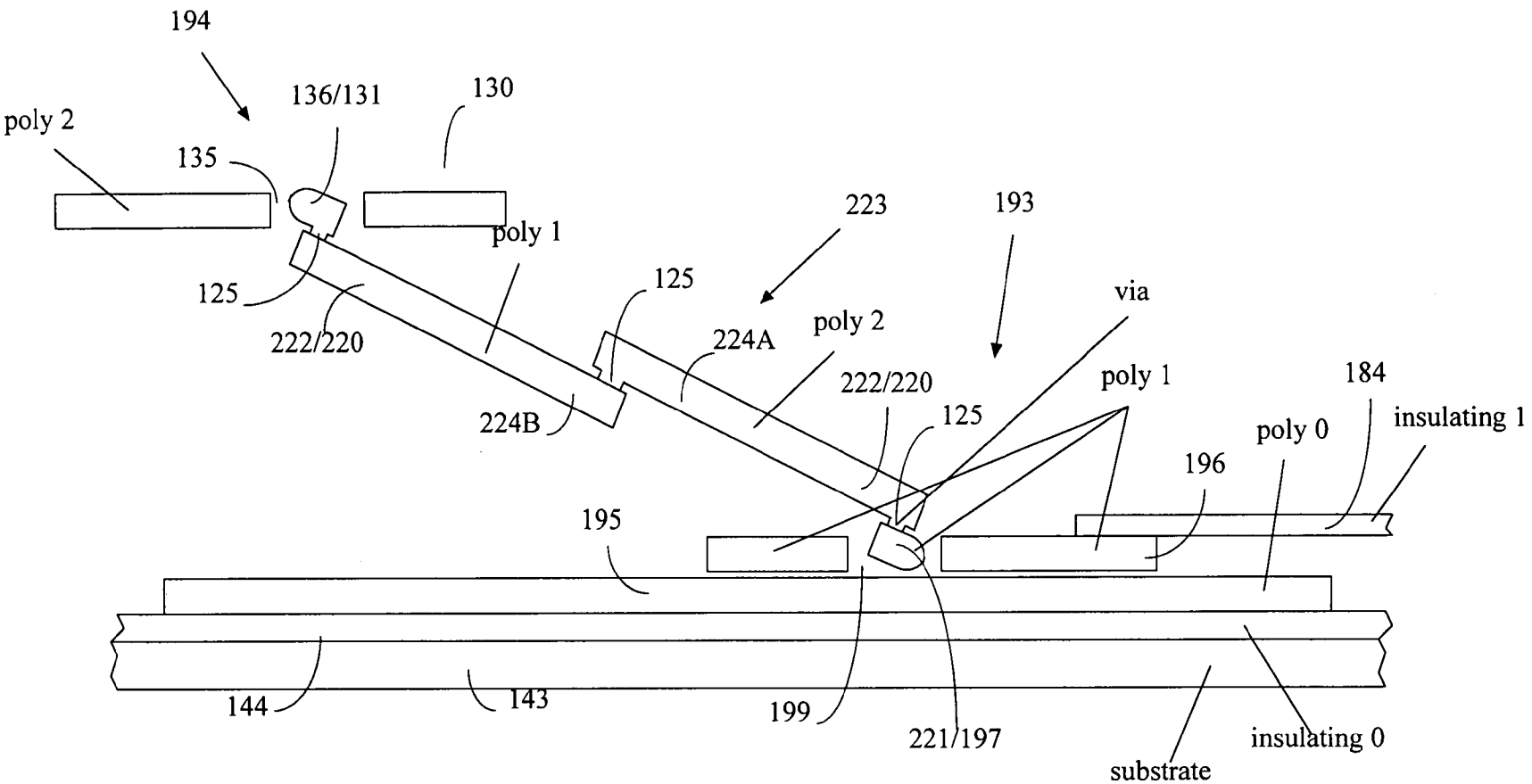
Figure 28B:
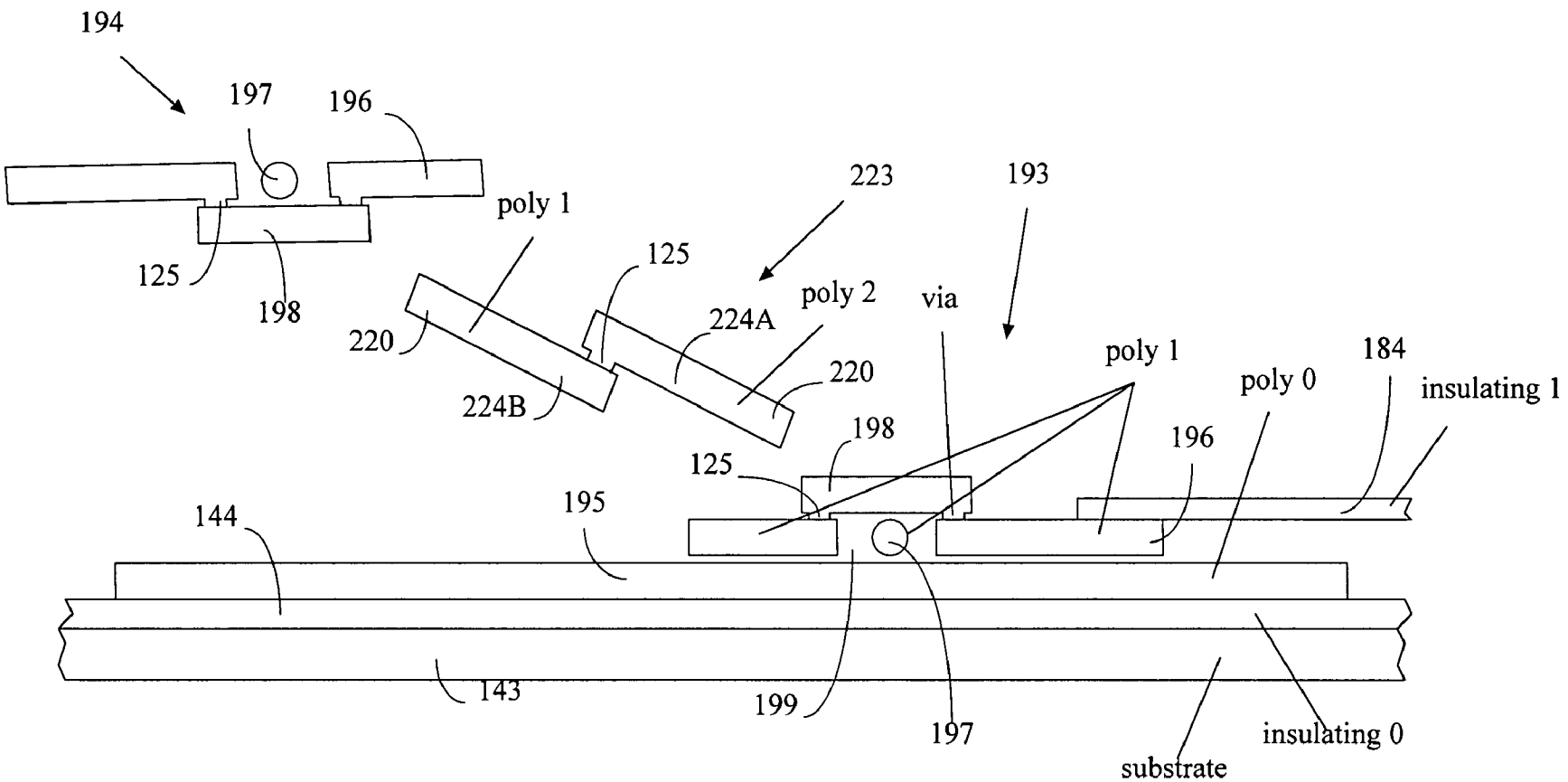
Figure 29:
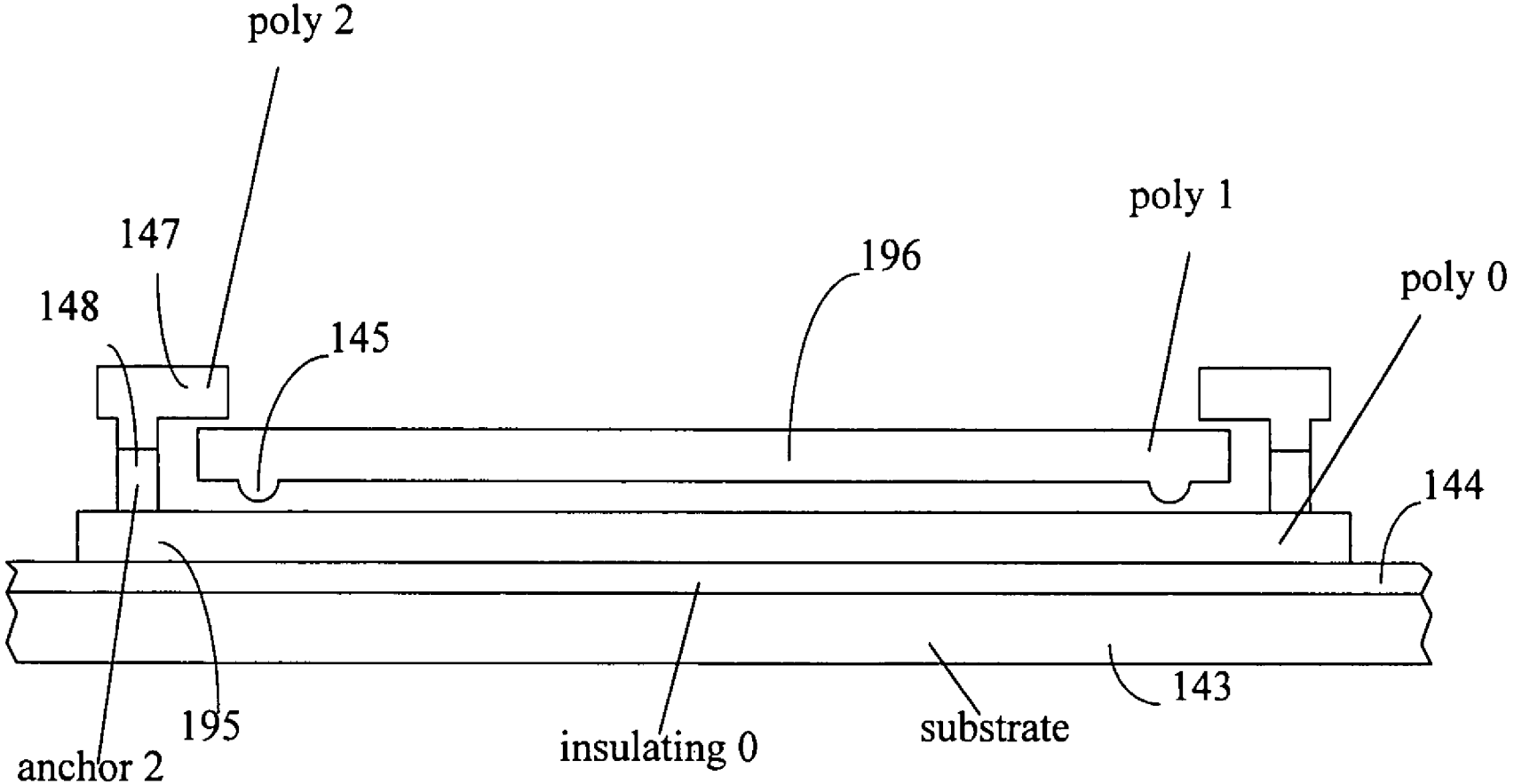

FIGS. 27 to 29 show the configuration of each hinge assembly 185 used to moveably couple a corresponding actuator mechanism 123 to an end of the moveable planar conductor 182. Each hinge assembly 185 comprises corresponding micro-mechanical hinges 193 and 194 and a corresponding support arm 223. This end of the moveable planar conductor 182 is moveably coupled to the corresponding actuator mechanism 123 by the hinges 193 and 194 and the support arm 223. More specifically, the hinge 193 pivotally couples a corresponding end of the support arm 223 to the actuator mechanism 123 so that the support arm 223 can pivot about the rotation axis $R_1$ of the hinge 193. The hinge 194 has a rotation axis $R_2$ and pivotally couples the corresponding opposite end of the support arm 223 to the insulating attachment bridge 186 that is fixedly coupled to this end of the moveable planar conductor 182. This enables the support arm 223 to also pivot about the rotation axis $R_2$ of the hinge 194. The rotation axes $R_1$ and $R_2$ of the hinges 193 and 194 are parallel. As a result, the hinges 193 and 194 and the support arm 223 cooperatively translate the lateral movement of the actuator mechanism 123 into vertical movement of this end of the moveable planar conductor 182.

More specifically, each support arm 223 comprises a corresponding first support strip 224A, a corresponding second support strip 224B, and a corresponding via 125. The first and second support strips 224A and 224B are fixedly coupled to each other by the via 125.

The hinge 193 comprises a first hinge plate 196, a hinge pin 197 with attachment arms 221, a locking arm 198, a second hinge plate 220 with attachment arms 222, and vias 125. The hinge 193 also comprises a guide plate 195 that is stationary and fixedly coupled to the insulating layer 144. The hinge plate 196 laterally slides on the guide plate 195. The hinge 193 also comprises guiding overhangs 147 and anchors 148 for the guiding overhangs 147.

Each guiding overhang 140 is fixedly coupled to the guide plate 139 by a corresponding anchor 148. Each anchor 148 extends up from the guide plate 195 along the outer surface of the hinge plate 196 and the guiding overhang extends over the upper surface of the hinge plate 130. Together, these guiding overhangs 147 guide the hinge plate 196 as it moves laterally on the guide plate 195.

The hinge plate 196 comprises contact rails 145 to enable the hinge plate 130 to laterally slide on the guide plate 139 with minimal friction and stiction. Each rail 145 may be continuous or may comprise a row of protrusions or bumps.

The hinge pin 197 is disposed and rotates in an opening 199 of the hinge plate 196 along the rotation axis $R_1$ of the hinge 193. The locking arm 198 is fixedly coupled to the hinge plate 196 with vias 125 and extends over the opening 199. The opposite ends of the hinge pin 197 include the attachment arms 221 while the hinge plate 220 also includes corresponding attachment arms 222. Each attachment arm 221 is fixedly coupled to a corresponding attachment arm 222 with a corresponding via 125. The end of each attachment arm 222 extends over the hinge plate 196. This enables the locking arm 198 and the attachment arms 222 to cooperatively rotatably lock the hinge pin 197 in place so that the hinge pin 197 can rotate about the rotation axis $R_1$. As a result, the hinge plate 220 can correspondingly pivot about the rotation axis $R_1$.

The hinge plate 196 of the hinge 193 is fixedly coupled to an insulating attachment bridge 141 of the corresponding actuator mechanism 123. As a result, the hinge plate 196 moves laterally with the actuator when the actuator mechanism 123 is controlled to move laterally by the control circuit 109 of FIG. 1. The hinge plate 220 is fixedly coupled to one end of the support arm 223 and in fact may be integrally formed with the support strip 224A of the support arm 223 at that end. The support arm 223 is therefore pivotally coupled to the actuator mechanism 123 by the hinge 193 so that the support arm 223 can pivot about the rotation axis $R_1$ of the hinge 193 when the actuator mechanism 123 is controlled to move laterally.

The hinge 194 is configured and operates similar to the hinge 193 in that it also comprises a first hinge plate 196, a hinge pin 197 with attachment arms 221, a locking arm 198, a second hinge plate 220 with attachment arms 222, and vias 125. However, the configuration of the hinge 194 is upside down from that of the hinge 193 and the hinge plate 220 pivots about the rotation axis $R_2$ of the hinge 194. As in the hinge 193, the locking arm 198 and the attachment arms 222 of the hinge plate 220 cooperatively rotatably lock the hinge pin 197 in place within the opening 199 of the hinge plate 196. This enables the hinge pin 197 to rotate about the rotation axis $R_2$ and the hinge plate 220 to correspondingly pivot about the rotation axis $R_2$ The hinge plate 220 of the hinge 194 is fixedly coupled to the insulating attachment bridge 186. Furthermore, the hinge plate 220 of the hinge 194 is fixedly coupled to the support strip 224A. The hinge plate 220 may be integrally formed with the support strip 153 of the support arm 119 at that end. As a result, the support arm 223 is also pivotally coupled to the insulating attachment bridge 186 so that the support arm 223 can also pivot about the rotation axis $R_2$ of the hinge 194.

Referring also to FIG. 24, as mentioned earlier, each end of the moveable planar conductor 182 is moveably coupled to corresponding actuator mechanisms 123. More specifically, at each end of the moveable planar conductor 182, the opposite longitudinal edges of the moveable planar conductor 182 are moveably coupled to corresponding actuator mechanisms 123. This is done with corresponding moveable hinge assemblies 185 and corresponding insulating attachment bridges 184 and 186.

In doing so, each actuator mechanism 123 is fixedly coupled to a corresponding hinge assembly 185 by a corresponding insulating attachment bridge 184. The insulating attachment bridge 184 is fixedly coupled to the locking arm 198 of the corresponding hinge assembly 185 and, in the manner described earlier for the insulating attachment bridges 164 of the transmission line element 160 of FIG. 17, to the corresponding actuator mechanism 123. Since the locking arm 198 is fixedly coupled to the hinge plate 196 of the lower hinge 193 of the hinge assembly 185, the hinge plate 196 can be moved laterally inward or outward by the actuator mechanism 123.

Furthermore, each of the opposite edges near each end of the moveable coplanar conductor 182 are fixedly coupled to a corresponding hinge assembly 185 by a corresponding insulating attachment arm 186. Each insulating attachment arm 186 is fixedly coupled to the locking arm 198 of the upper hinge 194 and to the corresponding edge of the moveable coplanar conductor 182. This is done in the same manner described earlier for fixedly coupling the insulating attachment bridges 164 of the transmission line element 160 to the moveable coplanar conductors 162.

The rotating hinge plate 220 of the lower hinge 193 forms one end of the support arm 223 that is laterally moveably and rotatably coupled to the corresponding actuator mechanism 123 via the lower hinge 193 and the insulating attachment bridge 184. The rotating hinge plate 220 of the upper hinge 194 forms the other end of the support arm 223. This end is vertically moveably and rotatably coupled to the corresponding end of the moveable planar conductor 182 via the upper hinge 193 and the insulating attachment bridge 186.

Referring back to FIG. 24, each end of the moveable planar conductor 182 can be moved individually up or down by appropriately controlling the corresponding actuator mechanisms 123 at that end to move laterally forward or backward. This movement of the actuator mechanisms 123 is done under the control of the control circuit 109 of FIG. 1 in the same manner described earlier for the actuator mechanisms 123 of the antenna 104 of FIG. 1. Thus, when an actuator mechanism 123 moves forward, this causes the end of the corresponding support arm 223 at the lower hinge 193 to also move forward via the lower hinge 193. At the same time, the other end of the support arm 223 at the upper hinge 194 moves up via the upper hinge 194 and pushes up the corresponding end of the moveable planar conductor 182. Conversely, when the actuator mechanism 123 moves backward, this causes the end of the corresponding support arm 202 at the lower hinge 193 to also move backward via the lower hinge 193 while the other end of the support arm 223 at the upper hinge 194 moves down via the upper hinge 194. This pulls down the corresponding end of the moveable planar conductor 182.

As also mentioned earlier, each end of the moveable planar conductor 182 is moveably coupled and electrically connected to a corresponding coplanar conductor 113 of the corresponding CPS transmission line end 161 by a corresponding moveable hinge assembly 185. This is done in the same manner in which each end of the moveable planar conductor 182 is moveably coupled to corresponding actuator mechanisms 123, except for the differences discussed next.

First, the hinge plate 196 of the hinge 194 of each of these hinge assemblies 185 is fixedly coupled and electrically connected to the transverse edge at the corresponding end of the moveable planar conductor 182. In fact, the hinge plate 196 may be integrally formed with the moveable planar conductor 182. Second, the guide plate 195 of each hinge assembly 185 is fixedly coupled and electrically connected to the semiconductor strip 132 of the corresponding coplanar conductor 113 of the corresponding CPS transmission line end 161. Third, the hinge plate 196 of the lower hinge 193 of each hinge assembly 185 freely moves on the guide plate 195 without being connected to an actuator mechanism 123. Since the guide plate 195, the hinge plates 196, the guiding overhangs 147, the locking arms 198, the hinge plates 220, and the hinge pins 197 of each hinge assembly 185 are all conductive, the corresponding end of the moveable planar conductor 182 is electrically connected to the corresponding coplanar conductor 113.

The impedance z of the transmission line element 180 at each end is based on the gap spacing s between the moveable and stationary planar conductors 182 and 183 at that end and the width w and height h of the moveable planar conductor 182. More specifically, the impedance z is given by:

$$z = \frac{z_0}{\sqrt{\epsilon_{eff}}} \quad \text{Eq. (9)}$$

where:

$$z_0 = 60 - \ln\left(\frac{8h}{w} + \frac{w}{4h}\right) \text{ for } \frac{w}{h} \le 1 \quad \text{Eq. (10)}$$

$$z_0 = 120\pi\left(\frac{w}{h} + 2.42 - .44\frac{h}{w} + \left(1\frac{h}{w}\right)^6\right)^{-1} \text{ for } \frac{w}{h} \ge 1 \quad \text{Eq. (11)}$$

in which w is the width of the moveable planar conductor 182. Here, $\epsilon_{eff}$ is approximately 1 since there is no dielectric material and the thickness of the moveable planar conductor 182 is negligible compared to its width.

As alluded to earlier, the corresponding actuator mechanisms 123 at each end of the moveable planar conductor 182 can be controlled to move that end up or down. In other words, the gap spacing s at the end can be controllably reduced or increased. Since the impedance z of the microstrip transmission line element 180 at each end is dependent on the gap spacing s, changing the gap spacing s in the manner just described changes the impedance z at each end. In this way the impedance z of the microstrip transmission line element 180 can be selectively adjusted to provide an adjustable impedance matcher for matching the impedances of the portions of the CPS main transmission line 103 electrically connected to the microstrip transmission line element 180. Or, the microstrip transmission line element 180 can simply be used as an adjustable impedance tuner for adjusting the impedance of the CPS main transmission line 103.

Alternative Embodiments for Transmission Line Elements

As those skilled in the art will recognize, alternative embodiments do exist for the impedance tuners 150 and 250 and the transmission line elements 160, 260, 170, 270, and 180. Furthermore, those skilled in the art will also recognize that the impedance tuners 150 and 250 and the transmission line elements 160, 260, 170, 270, and 180 and the alternative embodiments just described can be used in applications other than in RF transceivers 100 and 200 of FIGS. 1 and 2. Specifically, they can be used in any application where high frequency electrical transmission is needed. For example, the microstrip transmission line element 180 can be used in any microstrip circuit.

CPS MEMS Derrick Switch

Figure 30:
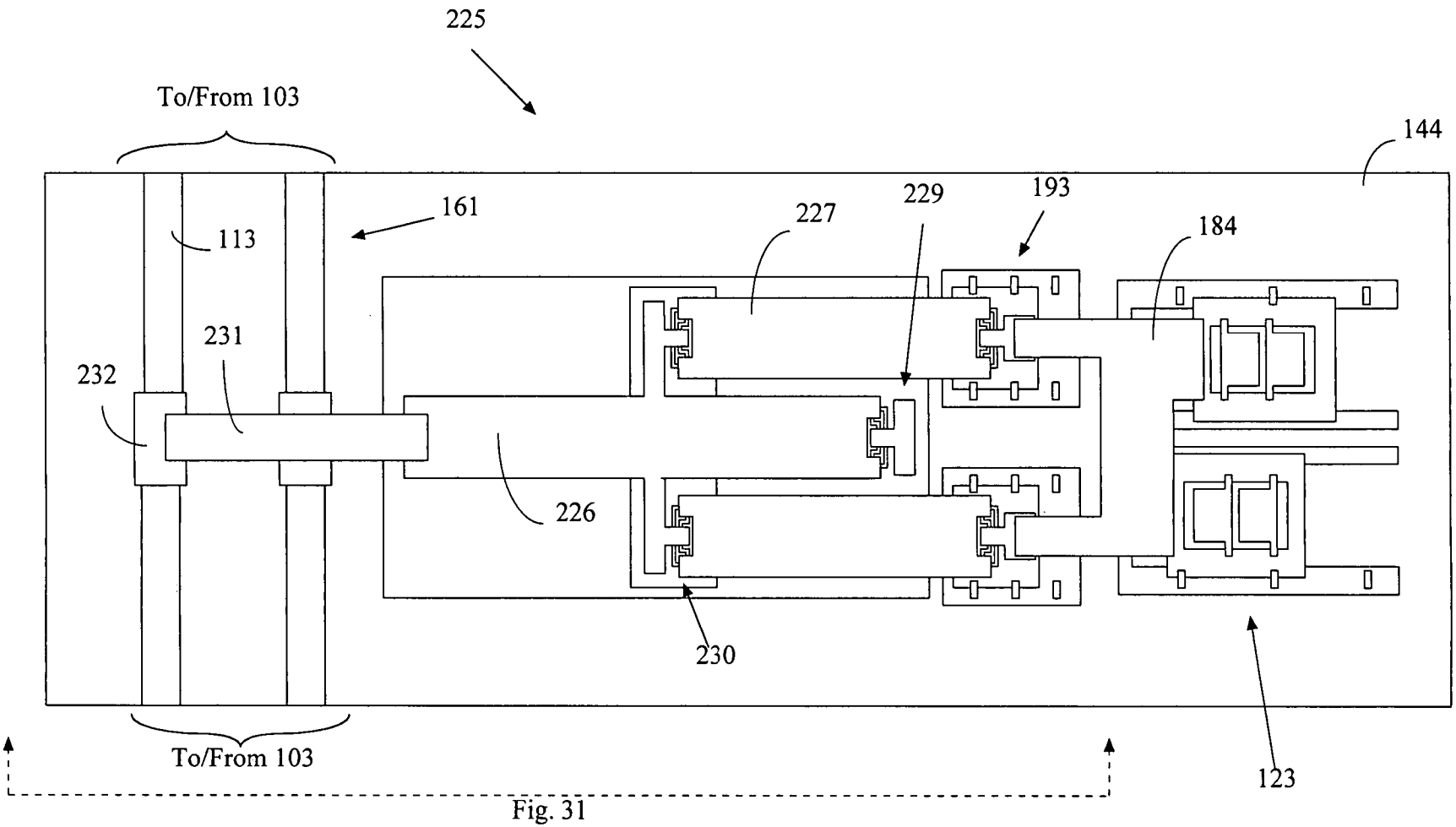
FIGS. 30 and 31 show a CPS MEMS derrick switch of the transceiver of FIG. 1 and various components thereof.

Turning to FIG. 30, the CPS MEMS switches 106 of FIG. 1 may include one or more CPS MEMS Derrick switches 225. In the transceiver 100 of FIG. 1, each Derrick switch 225 can be electrically connected in series with and between two portions of the CPS main transmission line 103.

Figure 31:
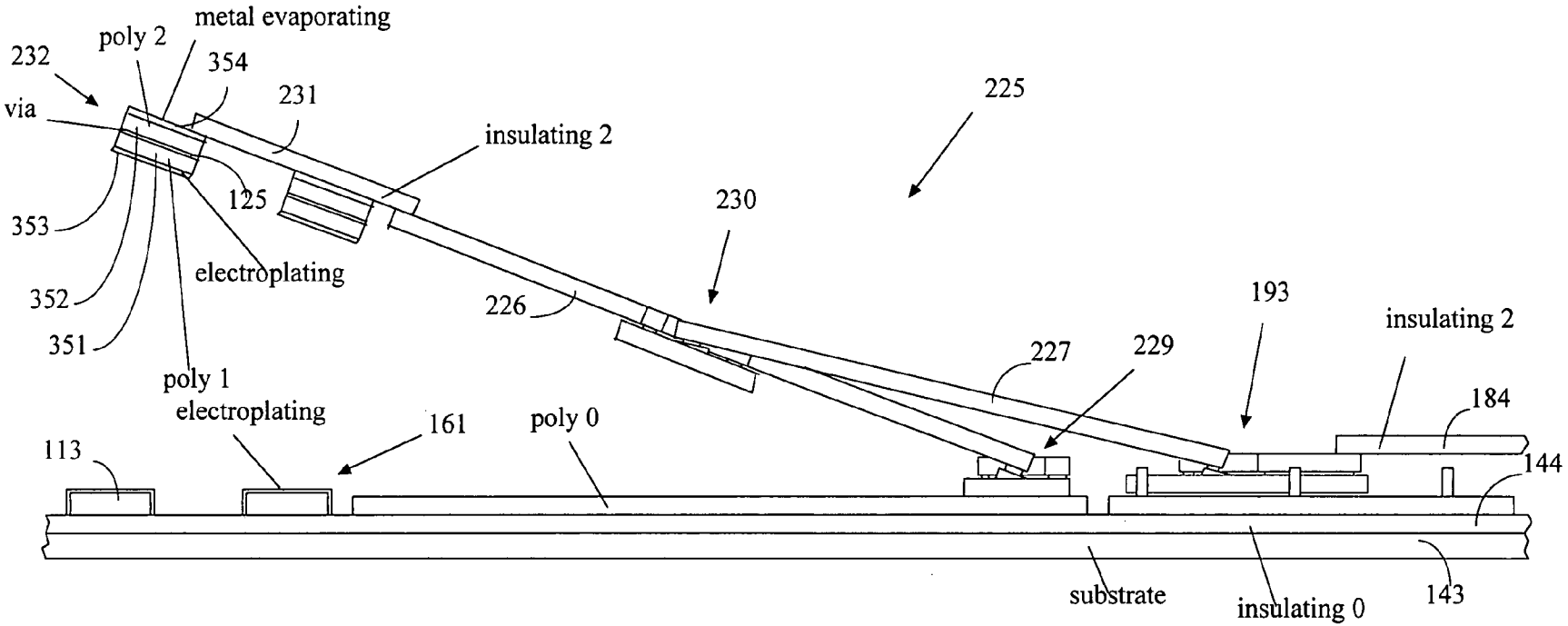

Each Derrick switch 225 comprises CPS transmission line ends 161 on opposite sides of the Derrick switch 225, a pivot arm 226, support arms 227, hinges 193, 229, and 230, an actuator mechanism 123, an insulating attachment bridge 184, an insulating attachment arm 231, and electrical contacts 232. As shown in FIG. 31, each Derrick switch 225 also comprises the substrate 143 and the insulating layer 144 of the MEMS chip 101 of FIG. 1.

Referring now to both FIGS. 30 and 31, the CPS transmission line ends 161 are located on opposite sides of the Derrick switch 225 and are electrically connected to corresponding portions of the CPS main transmission line 103 of FIG. 1. The CPS transmission line ends 161 are configured like those of the CPS transmission line element 160 of FIG. 17. Thus, the coplanar conductors 113 of each CPS transmission line end 161 are each electrically connected to a corresponding coplanar conductor of the corresponding portion of the CPS main transmission line 103.

One end of the pivot arm 226 is rotatably coupled to the insulating material 144 by the hinge 229. The hinge 229 is configured similar to the moveable lower hinge 193 of each hinge assembly 185 of FIGS. 27 to 29, except for a few differences. First, the hinge plate 196 is fixedly coupled to a stationary base 195 by anchors 350. The hinge plate 220 is fixedly coupled to one end of the pivot arm 226 and may be integrally formed with it.

The other end of the pivot arm 226 is fixedly coupled to the insulating attachment arm 231. The insulating attachment arm 231 fixedly couples and electrically isolates each of the electrical contacts 232 from each other and the pivot arm 226. For each of the electrical contacts 232, there is one corresponding coplanar conductor 113 from each of the transmission line ends 161.

Each electrical contact 232 comprises lower and upper semiconductor strips 351, a via 125, and lower and upper metal strips 353 and 354. The lower and upper semiconductor strips 351 and 352 are fixedly coupled by a via 125. The lower metal strip 353 is formed on the underside of the lower semiconductor strip 351 while the upper metal strip 354 is formed on the topside of the upper semiconductor strip 352. The upper metal strip 354 is also fixedly coupled to the insulating attachment arm 231.

One end of each support arm 227 is laterally moveably and rotatably coupled to the actuator mechanism 123 with a corresponding moveable hinge 193 and the insulating attachment bridge 184. Referring to FIGS. 27 to 29, this is done in the same manner in which the moveable lower hinge 193 of each hinge assembly 185*b* and a corresponding insulating attachment bridge 184 laterally moveably and rotatably couples one end of a corresponding support arm 223 to a corresponding actuator mechanism 123. Thus, this end of the support arm 227 comprises the rotating hinge plate 220 of the hinge 193.

The other end of each support arm 227 is rotatably coupled to the pivot arm 226 with a corresponding hinge 230. The hinge 230 is also configured similar to the moveable lower hinge 193 of each hinge assembly 185*b* of FIGS. 27 to 29, except for a few differences. First, it does not include a stationary base plate 195 and guiding overhangs 147. Second, a portion of the pivot arm 226 at one end of the pivot arm 226 comprises the hinge plate 196. Third, one end of the support arm 227 comprises the rotating hinge plate 220 of the hinge 230.

In order to close the Derrick switch 225, the actuator mechanism 123 can be controlled to move forward so as to push on the support arms 227 until the pivot arm 226 lays each of the electrical contacts 232 down on the corresponding coplanar conductors 113 of the transmission line ends 161 so that they are in contact. As a result, the corresponding coplanar conductors 113 for each electrical contact 232 are electrically connected. Conversely, the actuator mechanism 123 can be controlled to move backward so as to pull on the support arms 227. This causes the pivot arm to lift each of the electrical contacts 232 up from the corresponding coplanar conductors 113 so that they are no longer in contact. As a result, the corresponding coplanar conductors 113 for each of the electrical contacts 232 are no longer electrically connected.

The movement of the actuator mechanisms 123 is done under the control of the control circuit 109 of FIG. 1 in the same manner described earlier for the actuator mechanisms 123 of the antenna 104 of FIG. 1. In doing so, the control circuit 109 controls the operation of the derrick switches 225 for properly switching between receiving RF signals for processing by the receive IC 108*a* of FIG. 1 and generating RF signals by the transmit IC 108*b* of FIG. 1 for transmission.

CPW MEMS Derrick Switch

Figure 32:
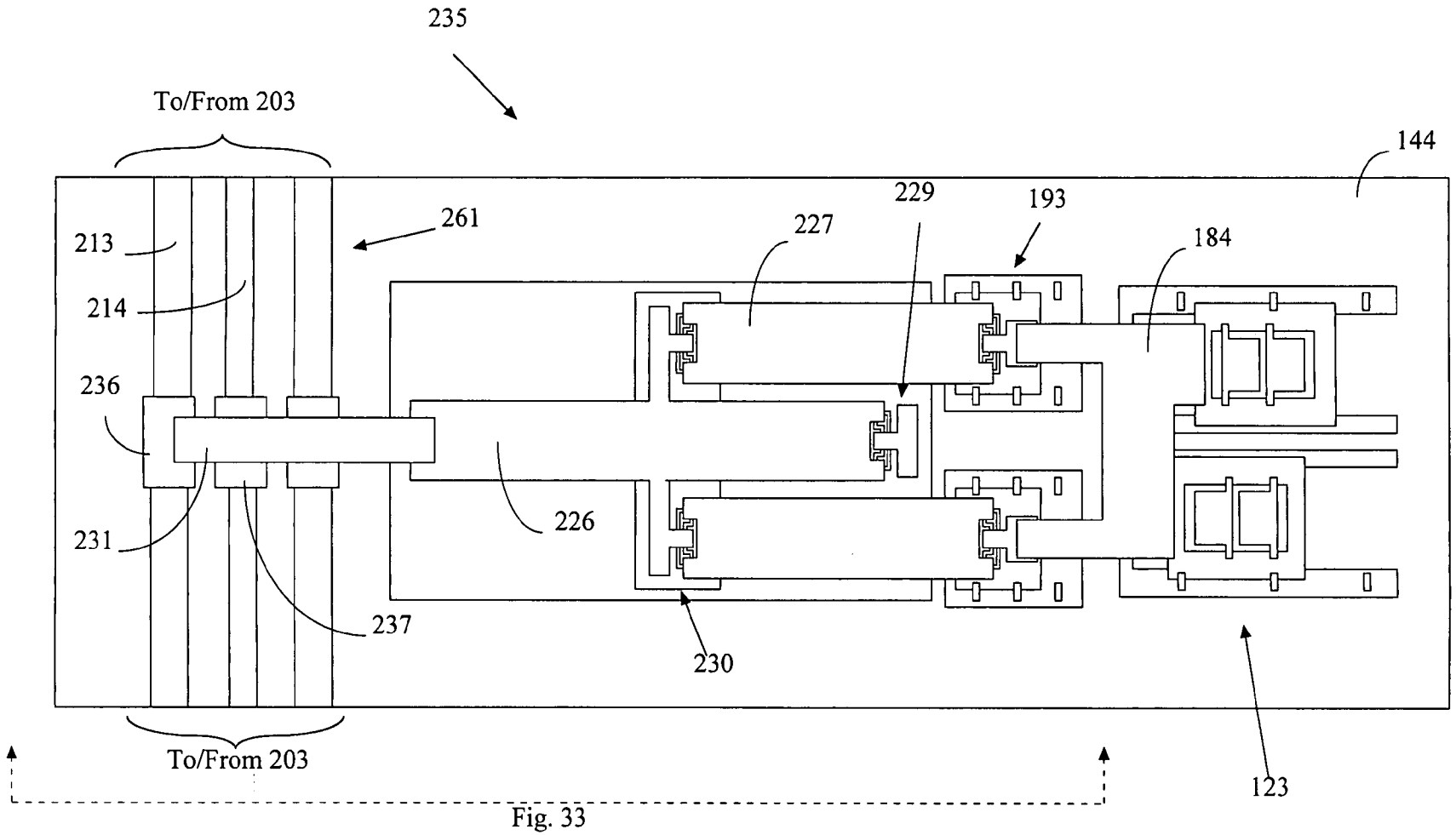
FIGS. 32 and 33 show a CPW MEMS derrick switch of the transceiver of FIG. 2 and various components thereof.
Figure 33:
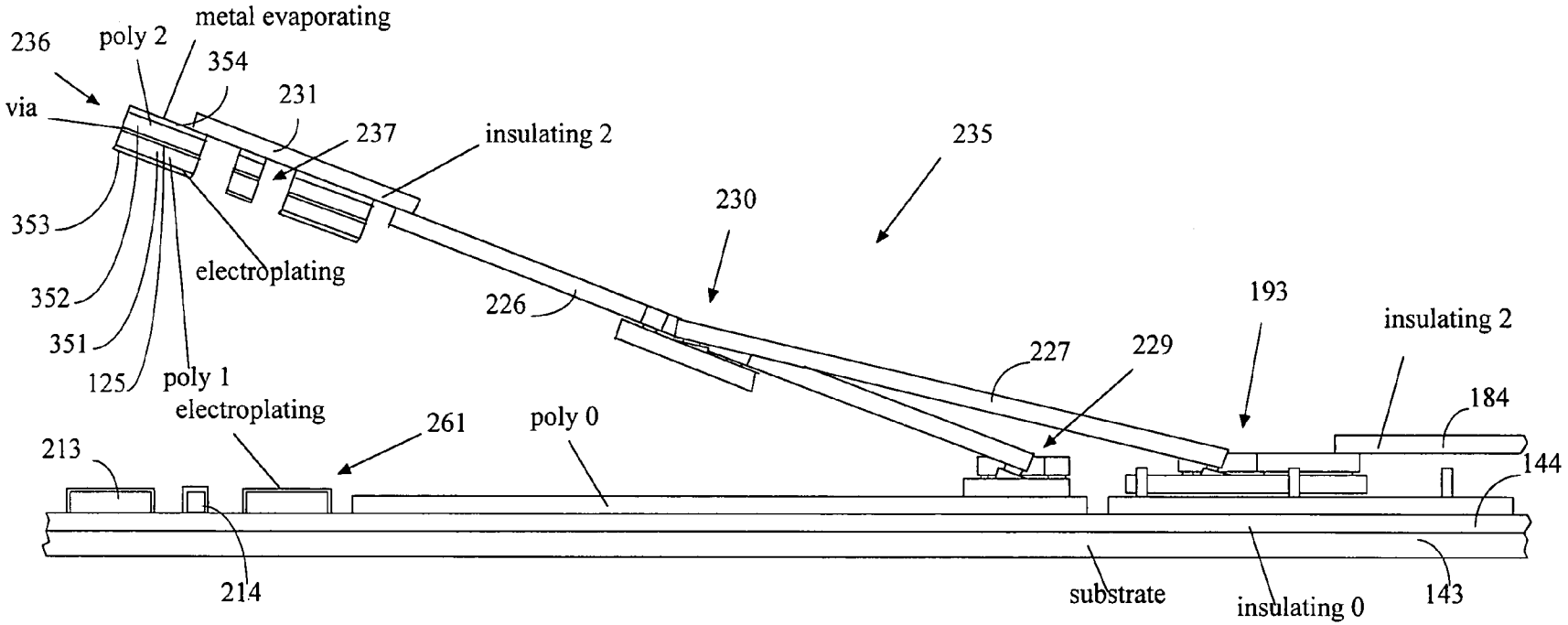

Turning to FIGS. 32 and 33, the CPW MEMS switches 206 of FIG. 2 may include one or more CPW MEMS Derrick switches 235. Each Derrick switch 235 can be electrically connected in series with and between two portions of the CPW main transmission line 203 of the transceiver 200 of FIG. 2. Each Derrick switch 235 is configured and operates similar to each Derrick switch 225 of FIGS. 30 and 31, except that it comprises CPW transmission line ends 261 and ground plane electrical contacts 236 and a center electrical contact 237.

The CPW transmission line ends 261 are located on opposite sides of the Derrick switch 235 and are electrically connected to corresponding portions of the CPW main transmission line 203 of FIG. 2. Each transmission line end 261 is configured like each of those of the transmission line element 260 of FIG. 20 in that it comprises ground plane conductors 213 and a center conductor 214.

The insulating attachment arm 231 fixedly couples and electrically isolates each of the electrical contacts 236 and 237 from each other and the pivot arm 226. For each of the ground plane electrical contacts 236, there is one corresponding ground plane conductor 213 from each of the transmission line ends 261. Similarly, for the center electrical contact 237, there is one corresponding center conductor 214 from each of the transmission line ends 261.

The Derrick switch 235 can be opened and closed in a similar manner to that of the Derrick switch 225 of FIGS. 30 and 31 with only a few differences. Specifically, when closing, each of the ground plane electrical contacts 236 is laid down on and contacts the corresponding ground plane conductors 213 of the transmission line ends 261 and the center electrical contact 237 is laid down and contacts the center conductors 214 of the transmission line ends 261. And, when opening, each of the ground plane electrical contacts 236 is lifted up from and no longer contacts the corresponding ground plane conductors 213 and the center electrical contact 237 is lifted up from and no longer contacts the center conductors 214.

The movement of the actuator mechanisms 123 is done under the control of the control circuit 209 of FIG. 2 in the same manner described earlier for the actuator mechanisms 123 of the antenna 104 of FIG. 1. In doing so, the control circuit 209 controls the operation of the derrick switches 235 for properly switching between receiving RF signals for processing by the receive IC 208*a* of FIG. 2 and generating RF signals by the transmit IC 208*b* of FIG. 2 for transmission.

Alternative Embodiments for CPS and CPW MEMS Derrick Switches

As those skilled in the art will recognize, alternative embodiments do exist for the Derrick switches 225 and 235. Furthermore, those skilled in the art will also recognize that the Derrick switches 225 and 235 and the alternative embodiments just described can be used in applications other than in RF transceivers 100 and 200. Specifically, they can be used in any application where electrical switching is needed.

For example, one or more pivot arms 226, one or more support arms 227, one or more hinges 193, one or more hinges 229, and one or more hinges 230 may be used in various combinations to achieve the result of opening and closing the Derrick switches 225 and 235 in the manner just described. As another example, one or more electrical contacts 232 may be used in the Derrick switch 225. In this case, the Derrick switch 225 would have a correspondingly pair of conductors 113 for each electrical contact 232. Similarly, one or more electrical contacts 236 and/or 237 may be used in the Derrick switch 235. In this case, the Derrick switch 235 would also have a correspondingly pair of conductors 213 and/or 214 for each electrical contact 236 and/or 237.

CPS MEMS Docking Switch

Figure 34:
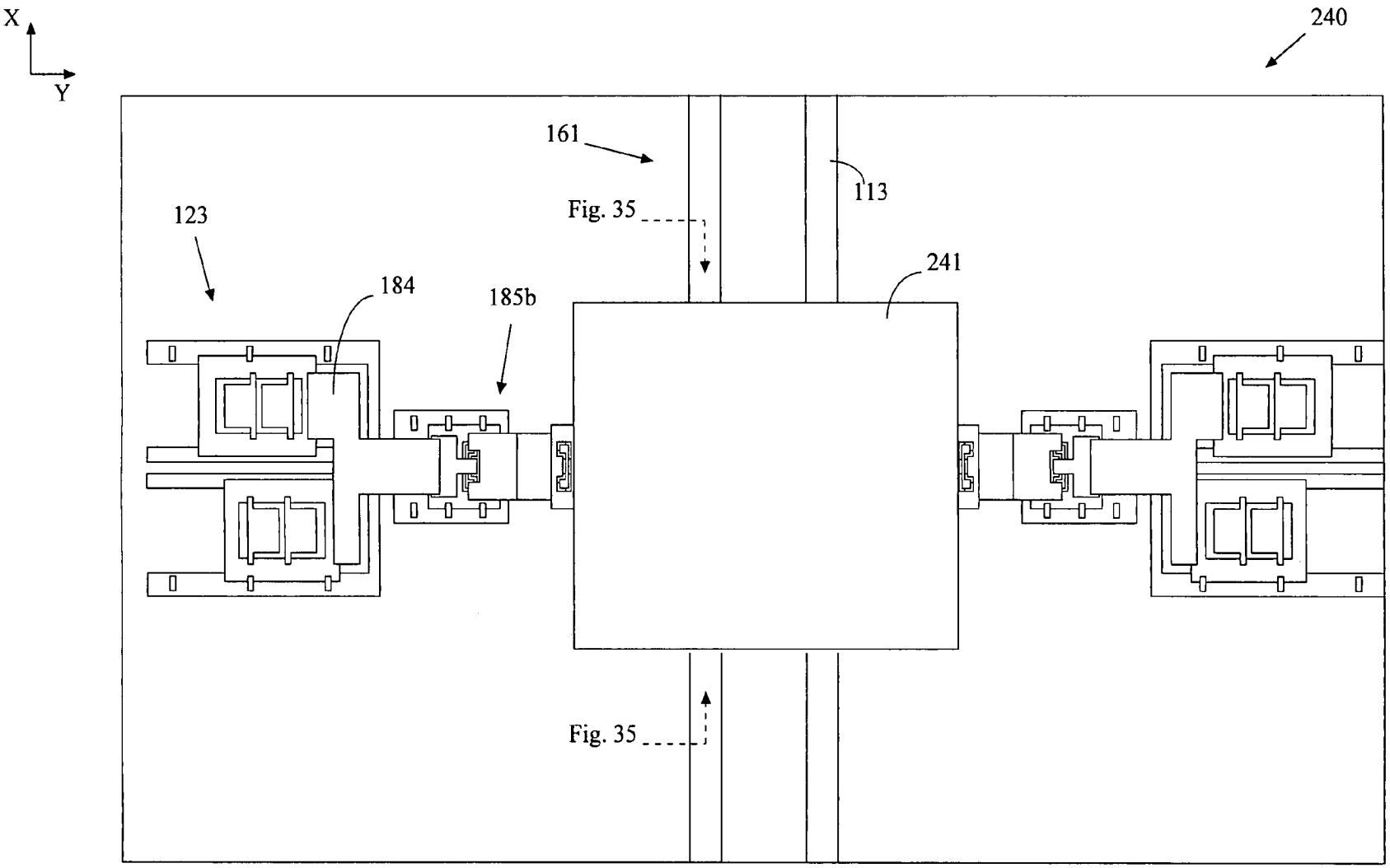
FIGS. 34 and 35 show a CPS MEMS docking switch of the transceiver of FIG. 1 and various components thereof.

The CPS switches 106 of FIG. 1 may also include one or more CPS MEMS docking switches 240 of the type shown in FIG. 34. In the transceiver 100 of FIG. 1, each docking switch 240 would be electrically connected in series with and between two portions of the CPS main transmission line 103. The docking switches 240 could be used instead of or in conjunction with the derrick switches 225 of FIG. 30 in the transceiver 100.

As shown in FIG. 34, each docking switch 240 comprises CPS transmission line ends 161, a moveable insulating plate 241, insulating attachment bridges 184, micro-mechanical moveable hinge assemblies 185*b*, and actuator mechanisms 123. And, as shown in FIG. 35, each docking switch 240 additionally comprises electrical contacts 242 and the substrate 143 and insulating layer 144 of the MEMS chip 101 of FIG. 1.

Figure 35:
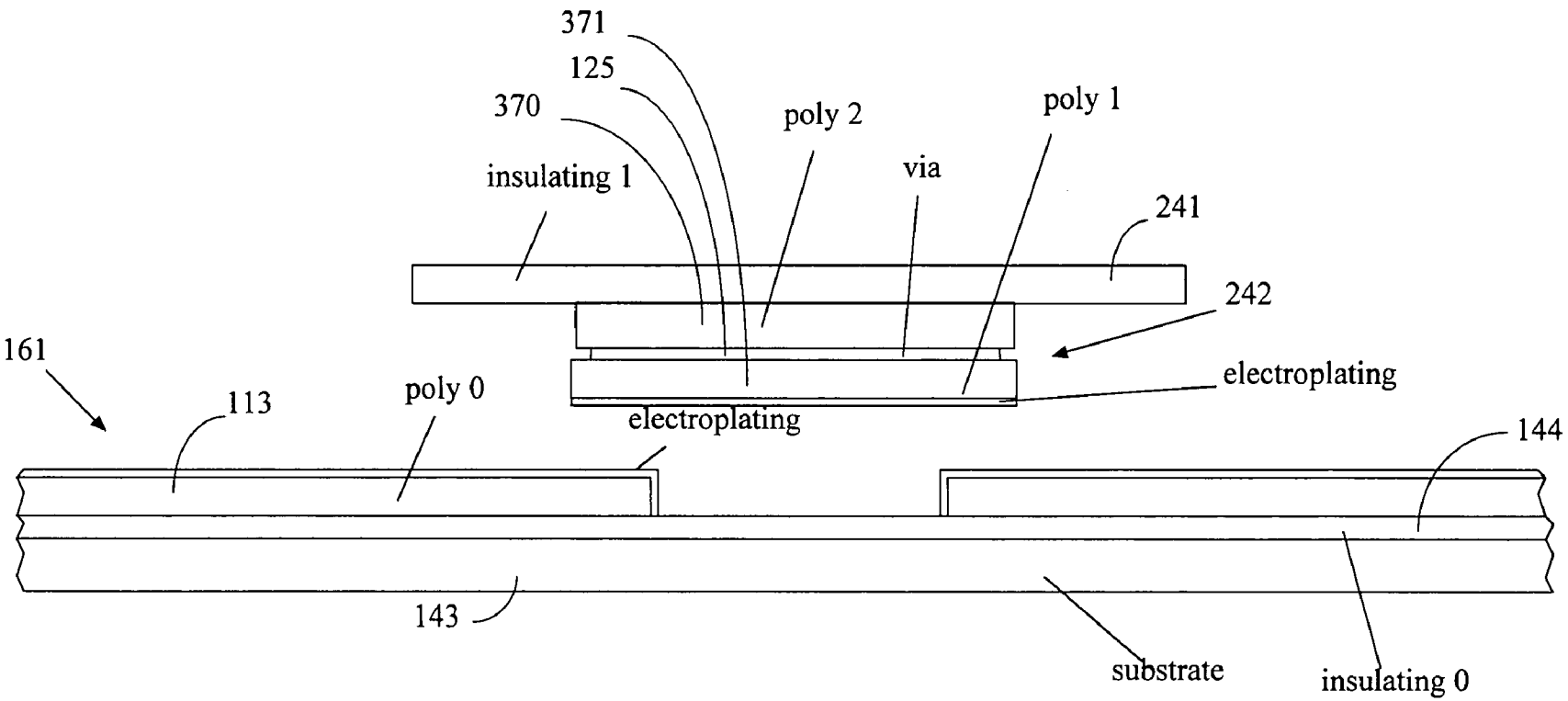

Referring to both FIGS. 34 and 35, the CPS transmission line ends 161 are located on opposite sides of the docking switch 240 and are electrically connected to corresponding portions of the CPS main transmission line 103 of FIG. 1.

The CPS transmission line ends 161 are configured like those of the CPS transmission line element 160 of FIG. 17. Thus, the coplanar conductors 113 of each CPS transmission line end 161 are each electrically connected to a corresponding coplanar conductor of the corresponding portion of the CPS main transmission line.

The moveable insulating plate 241 has opposite edges extending along the Y direction. Each edge extends in the Y direction over a corresponding transmission line end 161. Fixedly coupled to the underside of the moveable insulating plate 241 are the electrical contacts 242. The moveable insulating plate 241 electrically isolates the electrical contacts 242 from each other and the actuator mechanisms 123. For each electrical contact 242, there is a corresponding coplanar conductor 113 from each of the transmission line ends 161. Furthermore, like each coplanar conductor 113, each electrical contact 242 extends along the X direction.

Each electrical contact 242 comprises lower and upper semiconductor strips 370 and 371, a via 125, and a metal strip 372. The lower and upper semiconductor strips 351 and 352 are fixedly coupled by the via 125. The metal strip 372 is formed on the underside of the lower semiconductor strip 370. The upper semiconductor strip 372 is also fixedly coupled to the moveable insulating plate 241.

The moveable insulating plate 241 also has opposite edges extending along the X direction. Each edge is moveably coupled to a corresponding actuator mechanism 123 by a corresponding moveable hinge assembly 185 and a corresponding insulating attachment bridge 184. This is done in a similar manner as that described earlier for the moveable hinge assembly 185 of FIGS. 27 to 29, except that the moveable insulating plate 241 replaces the insulting attachment bridge 186. The moveable hinge assembly 185 translates the lateral forward and backward movement of the actuator mechanism 123 into vertical up and down movement of that edge of the moveable insulating plate 241.

In order to close the docking switch 240, the actuator mechanisms 123 can be controlled to move backward so that the hinge assemblies 185 pull the moveable insulating plate 241 down until each of the electrical contacts 242 is laid down on and contacts the corresponding coplanar conductors 113 of the transmission line ends 161. As a result, the corresponding coplanar conductors 113 for each electrical contact 242 are electrically connected. Conversely, the actuator mechanism 123 can be controlled to move forward so that the hinge assemblies 185 push the moveable insulating plate 241 up until each of the electrical contacts 242 is lifted up and no longer contacts the corresponding coplanar conductors 113. As a result, the corresponding coplanar conductors 113 for each electrical contact 242 are no longer electrically connected.

The movement of the actuator mechanisms 123 is done under the control of the control circuit 109 of FIG. 1 in the same manner described earlier for the actuator mechanisms 123 of the antenna 104 of FIG. 1. In doing so, the control circuit 109 controls the operation of the docking switches 240 for properly switching between receiving RF signals for processing by the receive IC 108*a* of FIG. 1 and generating RF signals by the transmit IC 108*b* of FIG. 1 for transmission.

CPW MEMS Docking Switch

Figure 36:
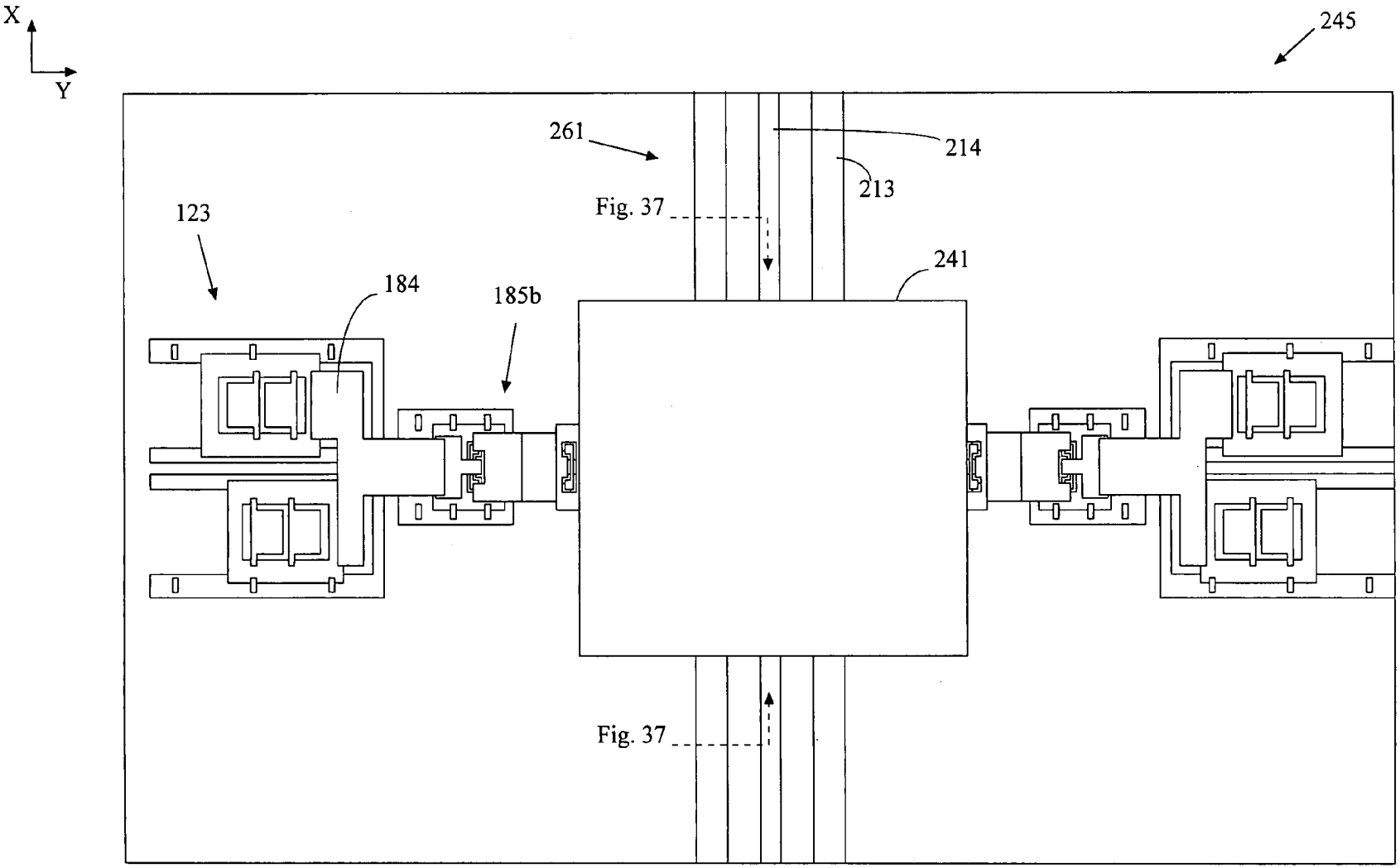
FIGS. 36 and 37 show a CPW MEMS docking switch of the transceiver of FIG. 2 and various components thereof.
Figure 37:
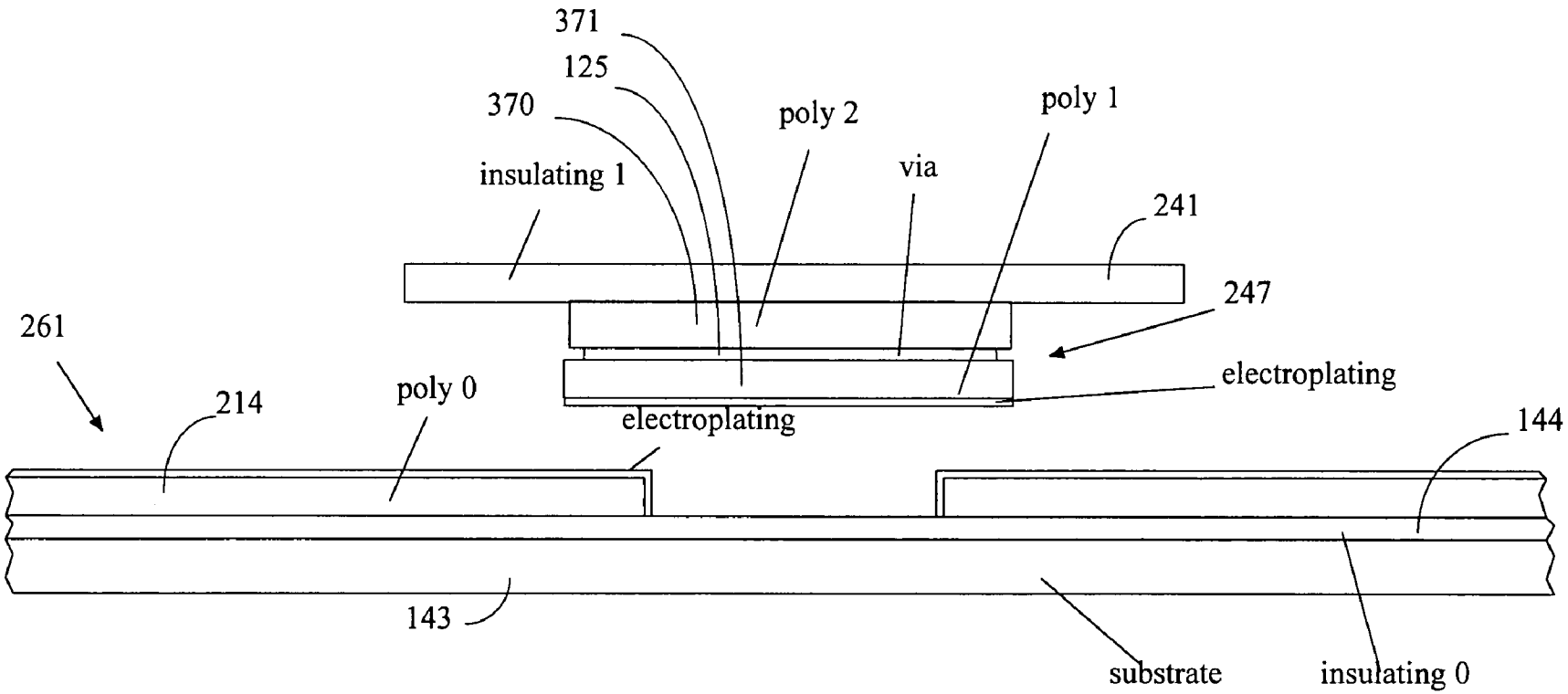

Turning to FIGS. 36 and 37, the CPW switches 206 of FIG. 2 may include one or more CPW MEMS docking switches 245. Each docking switch 245 can be electrically connected in series with and between two portions of the CPW main transmission line 203 of the transceiver 200 of FIG. 2. Each docking switch 245 is configured and operates similar to each docking switch 240 of FIGS. 34 and 35, except that it comprises CPW transmission line ends 261 and ground plane electrical contacts 246 and a center electrical contact 247.

The CPS transmission line ends 261 are located on opposite sides of the docking switch 245 and are electrically connected to corresponding portions of the CPW main transmission line 203 of FIG. 2. Each transmission line end 261 is configured like each of those of the transmission line element 260 of FIG. 20 in that it comprises ground plane conductors 213 and a center conductor 214.

The electrical contacts 246 and 247 are electrically isolated from each other and fixedly coupled to the underside of the moveable insulating plate 241. For each of the ground plane electrical contacts 246, there is one corresponding ground plane conductor 213 from each of the transmission line ends 261. Similarly, for the center electrical contact 247, there is one corresponding center conductor 214 from each of the transmission line ends 261.

The docking switch 245 can be opened and closed in a similar manner to that of the docking switch 240 of FIGS. 34 and 35 with only a few differences. Specifically, when closing, each of the ground plane electrical contacts 246 is laid down on and contacts the corresponding ground plane conductors 213 of the transmission line ends 261 and the center electrical contact 247 is laid down and contacts the center conductors 214 of the transmission line ends 261. And, when opening, each of the ground plane electrical contacts 246 is lifted up from and no longer contacts the corresponding ground plane conductors 213 and the center electrical contact 247 is lifted up from and no longer contacts the center conductors 214.

The movement of the actuator mechanisms 123 is done under the control of the control circuit 209 of FIG. 2 in the same manner described earlier for the actuator mechanisms 123 of the antenna 104 of FIG. 1. In doing so, the control circuit 209 controls the operation of the docking switches 245 for properly switching between receiving RF signals for processing by the receive IC 208*a* of FIG. 2 and generating RF signals by the transmit IC 208*b* of FIG. 2 for transmission.

Alternative Embodiments for CPS and CPW MEMS Docking Switches

As those skilled in the art will recognize, alternative embodiments do exist for the docking switches 240 and 245. Furthermore, those skilled in the art will also recognize that the Derrick switches 240 and 245 and the alternative embodiments just described can be used in applications other than in RF transceivers 100 and 200. Specifically, they can be used in any application where electrical switching, multiplexing, or demultiplexing is needed.

For example, one or more electrical contacts 242 may be used in the docking switch 240. In this case, the docking switch 240 would have a correspondingly pair of conductors 113 for each electrical contact 232. Similarly, one or more electrical contacts 246 and/or 247 may be used in the docking switch 245. In this case, the docking switch 245 would also have a correspondingly pair of conductors 213 and/or 214 for each electrical contact 246 and/or 247.

Figure 38A:
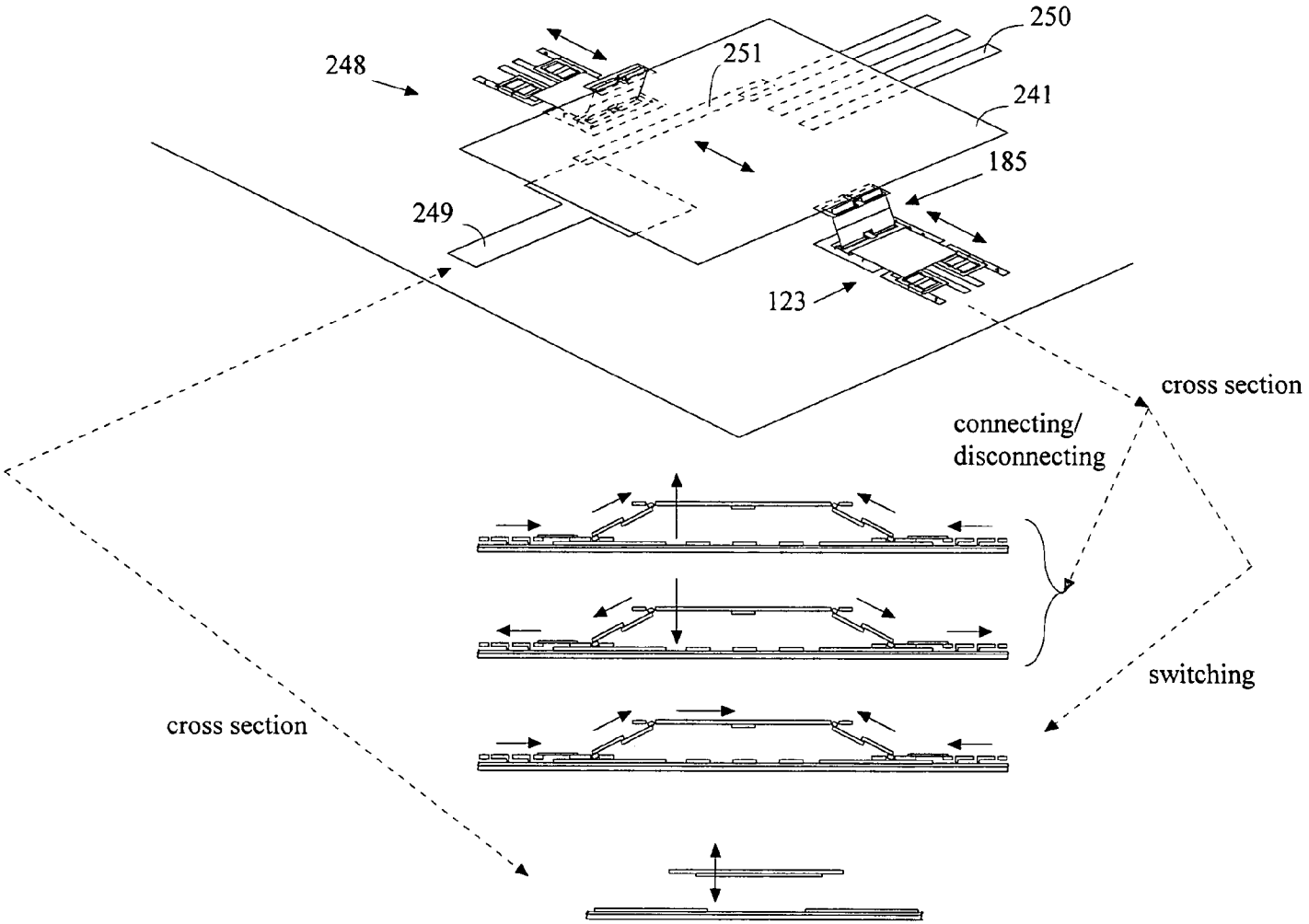
FIGS. 38*a* and 38*b* show variations of the CPS MEMS and CPW docking switches of FIGS. 34 to 37.

Furthermore, FIG. 38*a* shows a docking switch 248 that is a variation of the docking switches 240 and 245. This docking switch 248 can be used for multiplexing and/or demultiplexing. Since the configuration of the docking switch 248 is similar to the docking switches 240 and 245, only the significant differences will be discussed next.

In order to perform the multiplexing and/or demultiplexing functions, the docking switch 248 comprises a single contact 251 on the underside of the moveable insulating plate 241, one conductor 249 on the insulating layer 144 on one side of the docking switch, and multiple conductors 250 on the insulating layer 144 on the opposite side. The contact 251 is configured like the contacts 242, 246, and/or 247 of the docking switches 240 and 245 and extends along the X direction. Each conductor 250 extends along the X direction and is configured like each conductor 113 of the transmission line ends 161 of the docking switch 240 since it comprises a semiconductor strip 252 and a metal plating 253 formed on the semiconductor strip. The conductor 249 is T shaped and has one portion under the moveable insulating plate 241 that extends in the Y direction. The conductor 249 has another portion that extends in the X direction out from under the moveable insulating plate 241. Similar to each conductor 250, the conductor 249 comprises a T shaped semiconductor strip 254 and a T shaped metal plating 255 formed on the semiconductor strip 254.

When the docking switch 248 is being used for multiplexing, then the conductor 249 is used to provide the output signal and the conductors 250 are used to provide the input signals. Conversely, when the docking switch 248 is being used for demultiplexing, then the conductor 249 is used to provide the input signal and the conductors 250 are used to provide the output signals.

To perform multiplexing or demultiplexing, the docking switch 248 must be used to switch an existing electrical connection between the conductor 249 and a corresponding conductor 250 to a new electrical connection between the conductor 249 and a corresponding conductor 250. In doing so, the docking switch 248 is first opened so as to disconnect the conductor 249 and the corresponding conductor 250 for the existing electrical connection. This is done by appropriately controlling the actuator mechanisms 123 in the same manner described earlier for opening the docking switches 240 and 245. Then, the actuator mechanisms 123 are controlled to move in the same direction (one moves forward while the other moves backward) so as to align the contact 251 over the corresponding conductor 250 for the new electrical connection. The docking switch 248 is then closed so as to connect the conductor 249 and the corresponding conductor 250 for the new electrical connection. This is also done by appropriately controlling the actuator mechanisms 123 in the same manner described earlier for closing the docking switches 240 and 245. The movement of the actuator mechanisms 123 is done under the control of the control circuit 109 of FIG. 1 in the same manner described earlier for the actuator mechanisms 123 of the antenna 104 of FIG. 1.

Figure 38B:
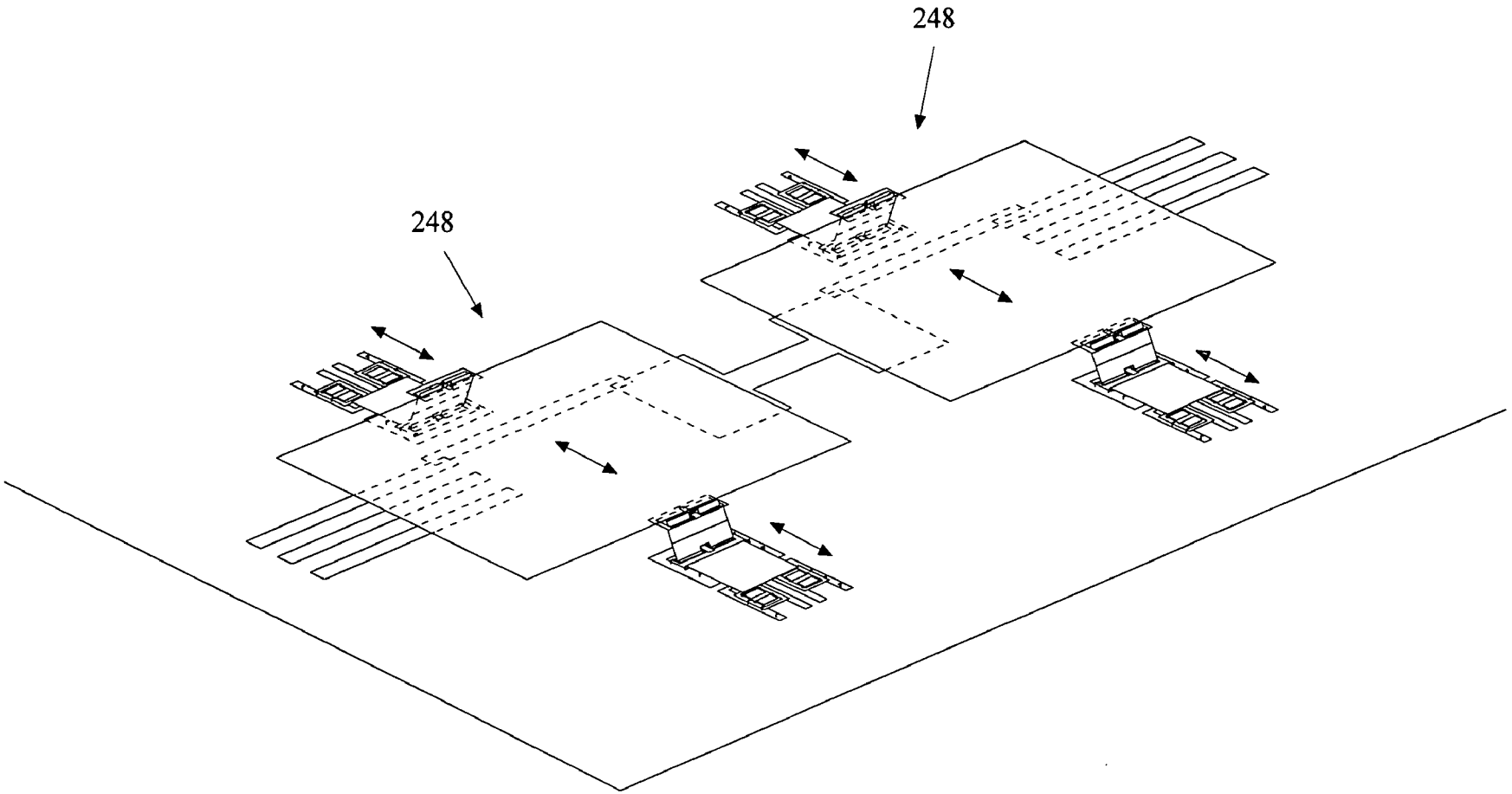

The configuration of the docking switch 248 shown in FIG. 38*a* provides 3×1 multiplexing or 1×3 demultiplexing. However, those skilled in the art will recognize, the configuration of the docking switch 248 may be modified to provide other multiplexing or demultiplexing combinations by including appropriate numbers of the conductors 249 and 250. Furthermore, multiple docking switches 248 can be used to create other multiplexing or demultiplexing combinations. For example, as shown in FIG. 38*b*, two docking switches 248 can be used to provide a 3×3 switch 256.

CPS MEMS See-Saw Switch

Figure 39:
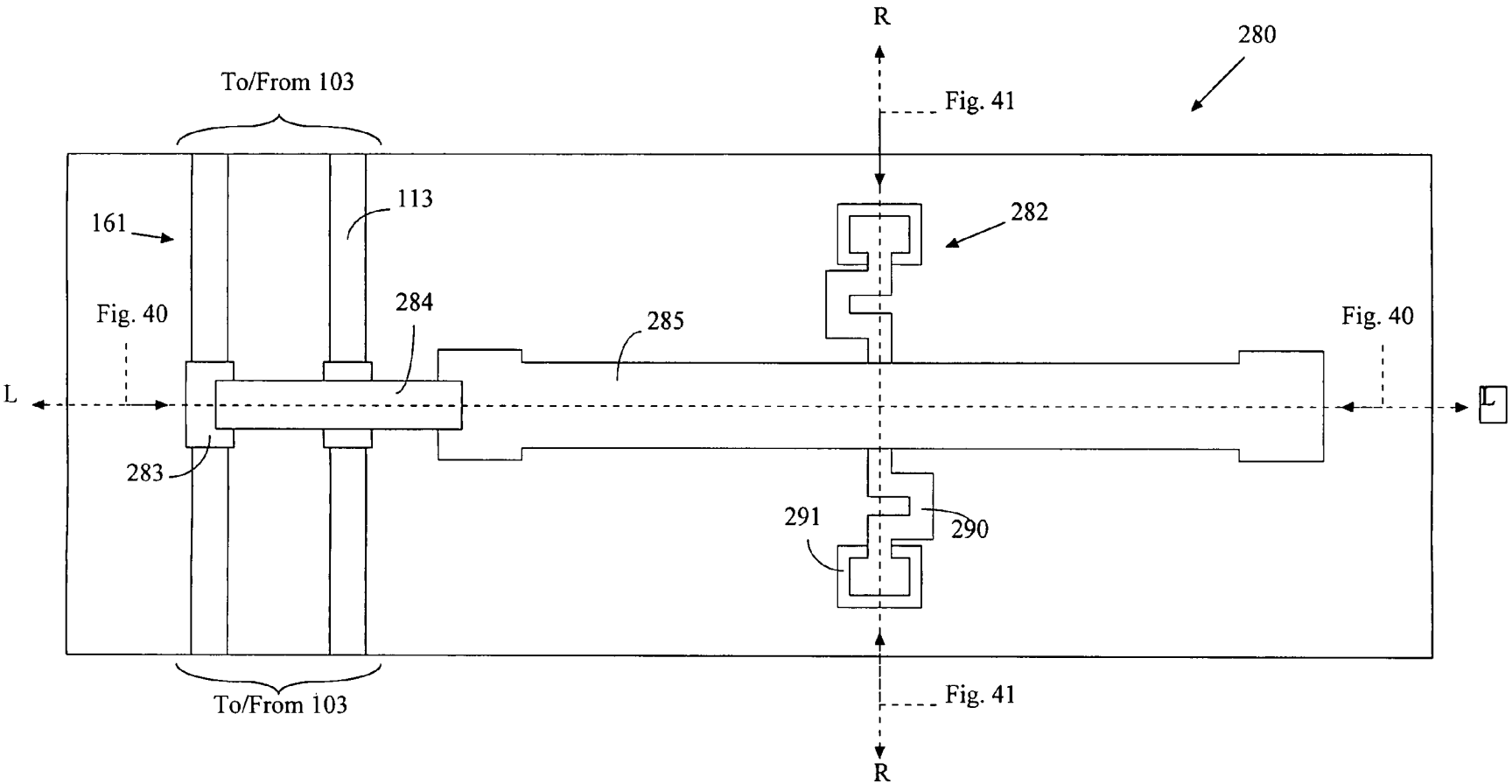
FIGS. 39 to 41 show a CPS MEMS see-saw switch of the transceiver of FIG. 1 and various components thereof.

The CPS switches 106 of FIG. 1 may also include one or more CPS MEMS see-saw switches 280 of the type shown in FIG. 39. In the transceiver 100 of FIG. 1, each see-saw switch 280 would be electrically connected in series with and between two portions of the CPS main transmission line 103. The see-saw switches 280 could be used instead of or in conjunction with the derrick switches 225 of FIG. 30 and/or the docking switches 240 of FIG. 34 in the transceiver 100.

As shown in FIG. 39, each see-saw switch 280 comprises CPS transmission line ends 161, a micro-mechanical spring hinge 282, electrical contacts 283, an insulating attachment arm 284, a pivot arm (or bar) 285, and electrodes 286 and 287. Furthermore, as shown in FIGS. 40 and 41, each see-saw switch 280 also comprises the substrate 143 and insulating layer 144 of the MEMS chip 101 of FIG. 1.

Figure 41:
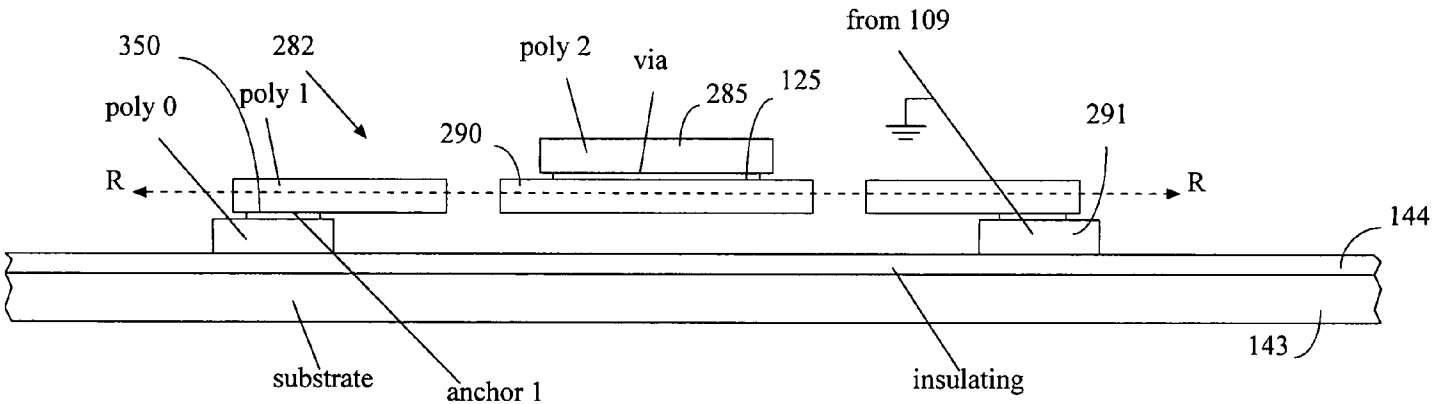
Figure 40:
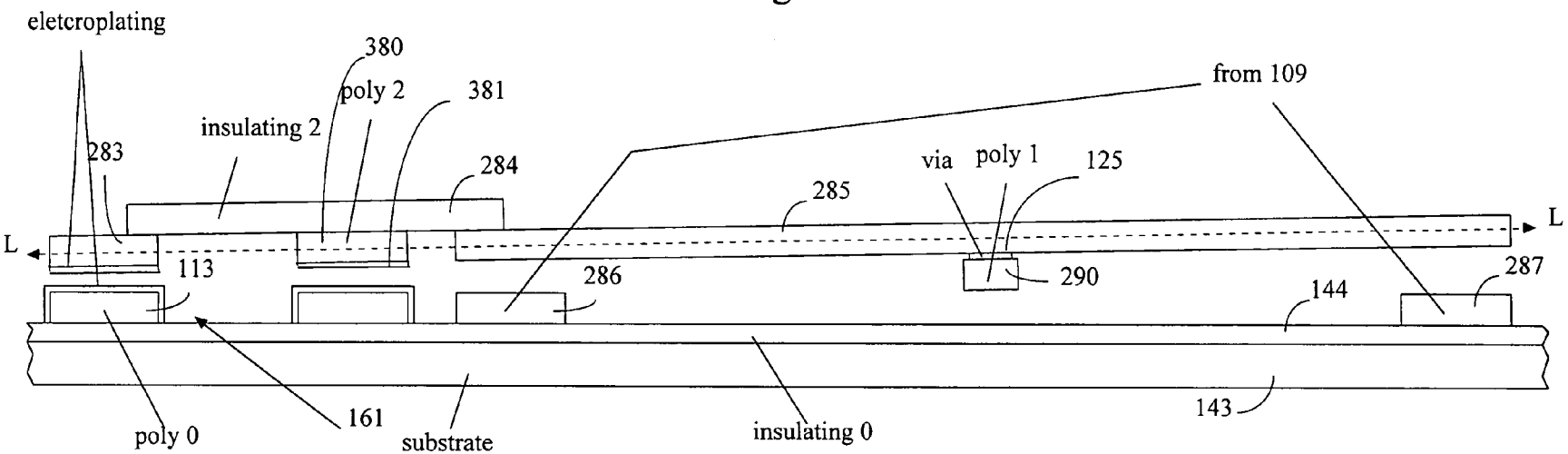

Referring now to FIGS. 39 to 41, the CPS transmission line ends 161 are located on opposite sides of the see-saw switch 280 and are electrically connected to corresponding portions of the CPS main transmission line 103 of FIG. 1. The CPS transmission line ends 161 are configured like those of the CPS transmission line element 160 of FIG. 17. Thus, the coplanar conductors 113 of each CPS transmission line end 161 are each electrically connected to a corresponding coplanar conductor of the corresponding portion of the CPS main transmission line.

One end of the pivot arm 285 is fixedly coupled to the insulating attachment arm 284. The insulating attachment arm 284 fixedly couples and electrically isolates each of the electrical contacts 283 from each other and the pivot arm 285. For each of the electrical contacts 283, there is one corresponding coplanar conductor 113 from each of the transmission line ends 161.

The electrodes 286 and 287 are fixedly coupled to the insulating layer 144 and are located underneath opposite ends of the pivot arm 285. Thus, there is a corresponding end of the pivot arm 285 for each electrode 286 and 287.

The spring hinge 282 pivotally couples the center of the pivot arm 285 to the insulating layer 144 so that both ends of the pivot arm 285 can pivot about a rotation axis R of the pivot arm 285 at the center of the pivot arm 285. The spring hinge 282 comprises spring arms 290 and two support bases 291. The pivot arm 285 extends between the support bases 291 along a longitudinal axis L of the pivot arm 285 that is transverse (i.e., perpendicular) to the rotation axis R. The spring arms 290 extend out from the center of the pivot arm 285 in opposite directions along the rotation axis R. Each spring arm 290 has one end fixedly coupled to the center of the pivot arm 285 with a via 125. These ends of the spring arms 290 may in fact be integrally formed and joined together. The other end of each spring arm 290 is fixedly coupled to a corresponding support base 291 with an anchor 350. The spring arms 290 suspend the pivot arm 285 over the insulating layer 144 and the electrodes 286 and 287. Moreover, the spring arms 290 are patterned (i.e., configured) to provide the spring hinge 282 with the same spring constant for both clockwise and counterclockwise pivoting by the ends of the pivot arm 285. As a result, the ends of the pivot arm 285 can pivot about the rotation axis R. Furthermore, the support bases 291, the spring arms 290, and the pivot arm 285 are all conductive. The spring arms 190 could be simply be straight and serve as torsion bars.

Each electrical contact 283 comprises a semiconductor strip 380 and a metal plating 381. The metal plating 381 is formed on the underside of the semiconductor strip 380.

In order to close the see-saw switch 280, a voltage is applied across at least one of the support bases 291 and the electrode 286. Since the pivot blocks 290 and the pivot arm 285 are all conductive, this voltage appears between the electrode 286 and the corresponding end of the pivot arm 285. The resulting electrostatic force overcomes the spring force of the spring hinge 282 due to the spring constant and causes the corresponding end to pivot via the pivot hinge 282 about the rotation axis R. The corresponding end is therefore pulled down toward the electrode 286 until each of the electrical contacts 283 is laid down on and contacts the corresponding coplanar conductors 113 of the transmission line ends 161. As a result, the corresponding coplanar conductors 113 for each electrical contact 283 are electrically connected. Conversely, a voltage is applied across at least one of the support bases 291 and the electrode 287 to open the see-saw switch 280. This voltage appears between the electrode 287 and the corresponding end of the pivot arm 285. The resulting electrostatic force overcomes the spring force of the spring hinge 282 and causes the corresponding end to pivot via the pivot hinge 282 about the rotation axis R. The corresponding end is pulled down toward the electrode 287 until each of the electrical contacts 283 is lifted up from and no longer contacts the corresponding coplanar conductors 113 of the transmission lire ends 161. As a result, the corresponding coplanar conductors 113 for each electrical contact 283 are no longer electrically connected.

The control circuit 109 of FIG. 1 is electrically connected to at least one of the pivot blocks 290 and to both of the electrodes 286 and 287 of each see-saw switch 280. Thus, the application of the voltages for opening and closing each see-saw switch 280 is done under the control of the control circuit 109. As with the docking switches 240 of FIG. 30 and the Derrick switches 245 of FIG. 34, the control circuit 109 controls the operation of the see-saw switches 280 for properly switching between receiving RF signals for processing by the receive IC 108*a* of FIG. 1 and generating RF signals by the transmit IC 108*b* of FIG. 1 for transmission.

CPW MEMS See-Saw Switch

Figure 42:
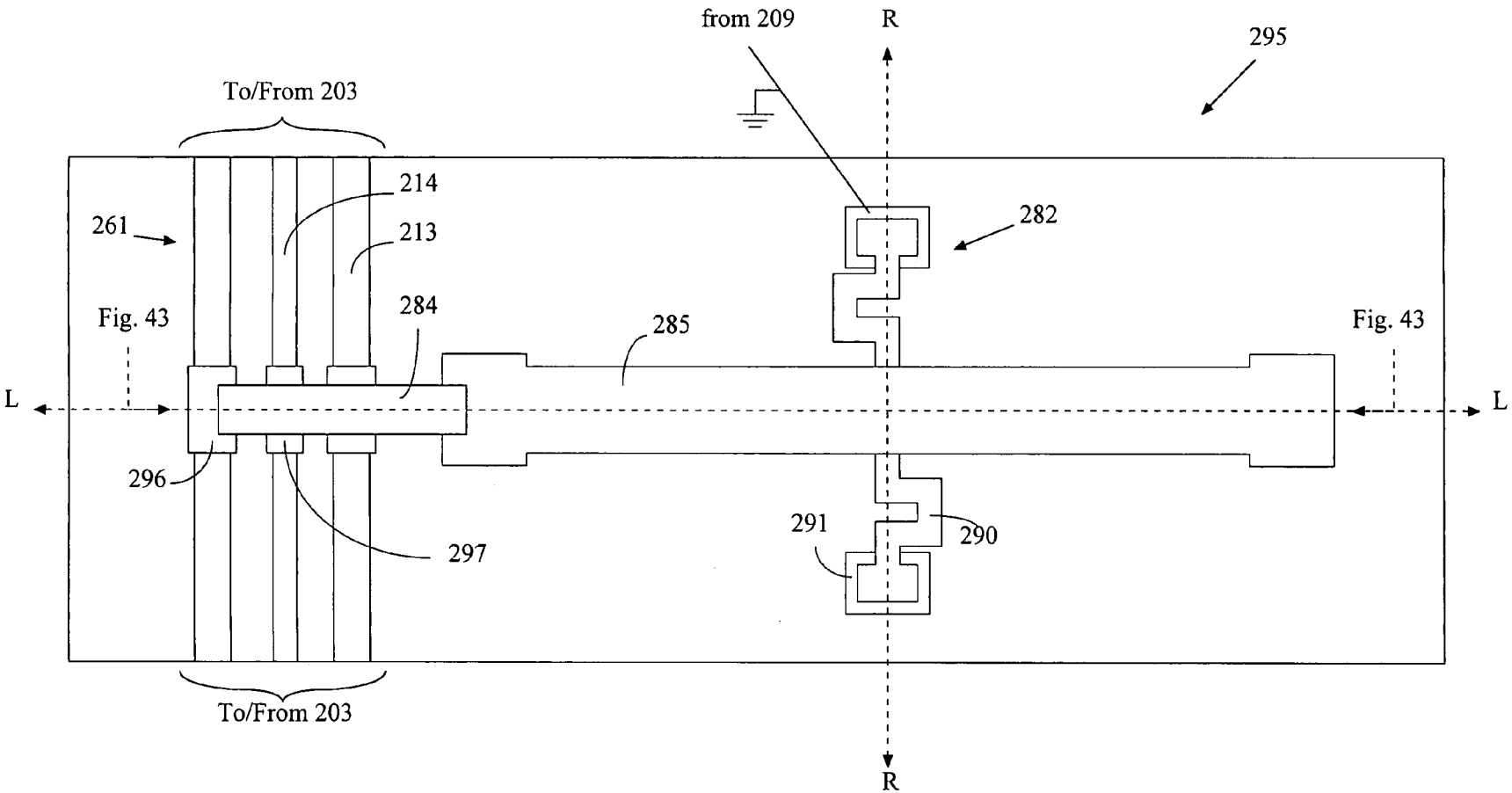
FIGS. 42 and 43 show a CPW MEMS see-saw switch of the transceiver of FIG. 2 and various components thereof
Figure 43:
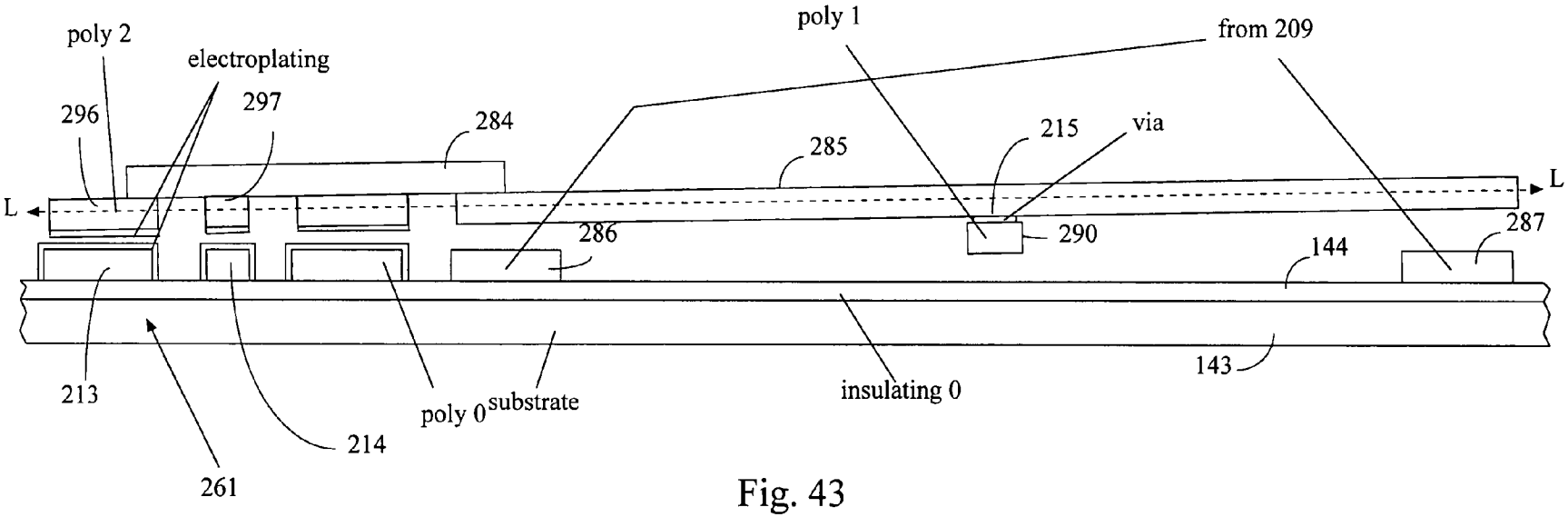

Turning to FIGS. 42 and 43, the CPW switches 206 of FIG. 2 may include one or more CPW MEMS see-saw switches 295. Each see-saw switch 295 can be electrically connected in series with and between two portions of the CPW main transmission line 203 of the transceiver 200 of FIG. 2. Each see-saw switch 295 is configured and operates similar to each see-saw switch 280 of FIGS. 39 and 40, except that it comprises CPW transmission line ends 261 and ground plane electrical contacts 296 and a center electrical contact 297.

The CPW transmission line ends 261 are located on opposite sides of the docking switch 295 and are electrically connected to corresponding portions of the CPW main transmission line 203 of FIG. 2. Each transmission line end 261 is configured like each of those of the transmission line element 260 of FIG. 20 in that it comprises ground plane conductors 213 and a center conductor 214.

The electrical contacts 296 and 297 are electrically isolated from each other and fixedly coupled to the insulating attachment arm 184. For each of the ground plane electrical contacts 296, there is one corresponding ground plane conductor 213 from each of the transmission line ends 261. Similarly, for the center electrical contact 297, there is one corresponding center conductor 214 from each of the transmission line ends 261.

The see-saw switch 295 can be opened and closed in a similar manner to that of the docking switch 280 of FIGS. 39 and 40 with only a few differences. Specifically, when closing, each of the ground plane electrical contacts 296 is laid down on and contacts the corresponding ground plane conductors 262 of the transmission line ends 261 and the center electrical contact 297 is laid down and contacts the center conductors 262 of the transmission line ends 261. And, when opening, each of the ground plane electrical contacts 296 is lifted up from and no longer contacts the corresponding ground plane conductors 262 and the center electrical contact 297 is lifted up from and no longer contacts the center conductors 262.

This is all done under the control of the control circuit 209 of FIG. 2 in the same manner described earlier for each see-saw switch 280 of FIGS. 39 and 40. In doing so, the control circuit 209 controls the operation of the see-saw switches 295 for properly switching between receiving RF signals for processing by the receive IC 208*a* of FIG. 2 and generating RF signals by the transmit IC 208*b* of FIG. 2 for transmission.

Alternative Embodiments for CPS and CPW MEMS See-Saw Switches

As those skilled in the art will recognize, alternative embodiments do exist for the see-saw switches 280 and 295. Furthermore, those skilled in the art will also recognize that the see-saw switches 280 and 295 and the alternative embodiments just described can be used in applications other than in RF transceivers 100 and 200. Specifically, they can be used in any application where electrical switching is needed.

For example, one or more electrical contacts 283 may be used in the see-saw switch 280. In this case, the see-saw switch 280 would have a correspondingly pair of conductors 113 for each electrical contact 283. Similarly, one or more electrical contacts 296 and/or 297 may be used in the see-saw switch 295. In this case, the see-saw switch 295 would also have a correspondingly pair of conductors 213 and/or 214 for each electrical contact 236 and/or 237.

MEMS Reconfigurable Capacitor with Vertically Moveable Upper Plate

Figure 44:
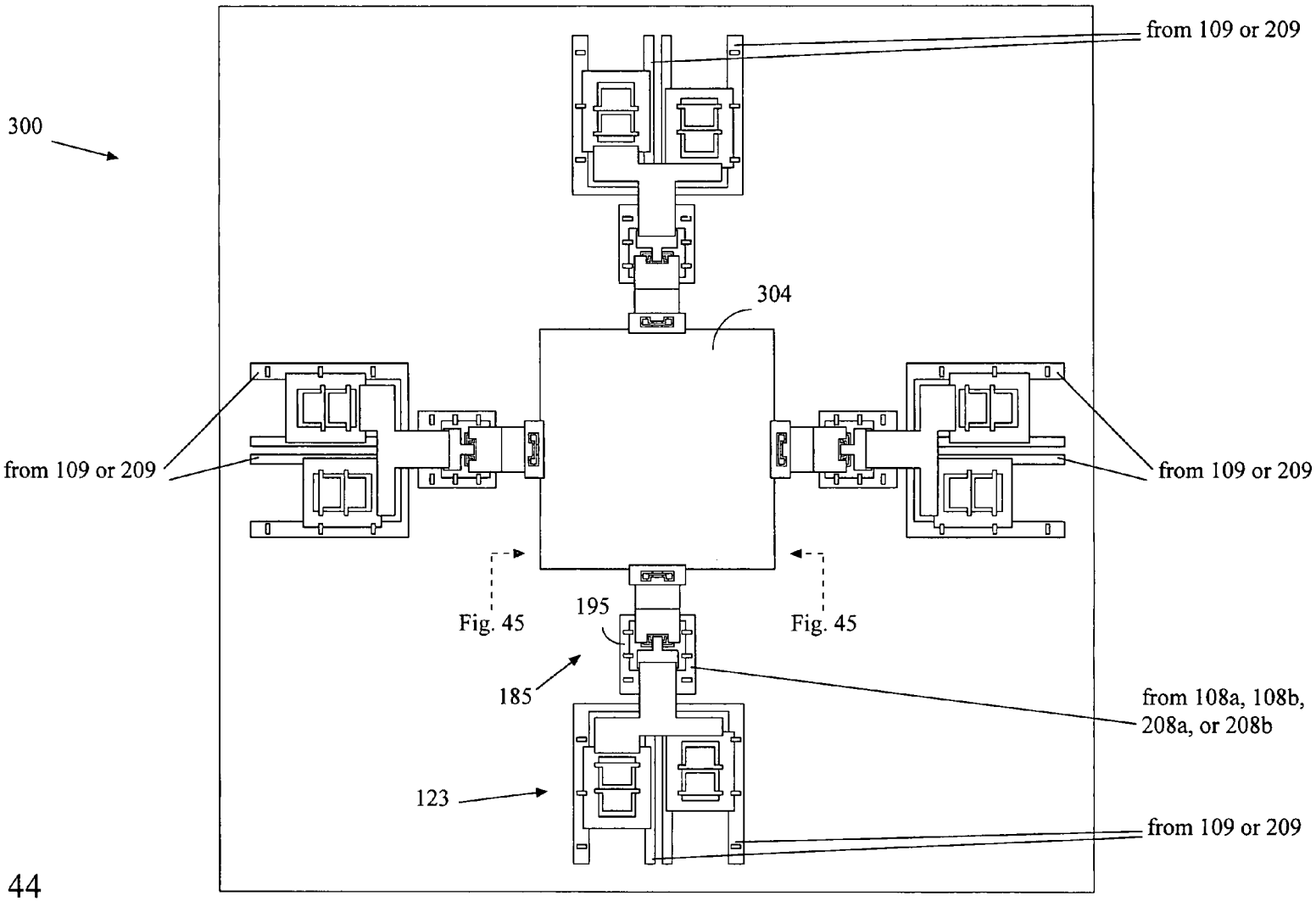
FIGS. 44 and 45 show a MEMS reconfigurable capacitor with a vertically moveable upper plate of the transceivers of FIGS. 1 and 2 and various components thereof
Figure 45:
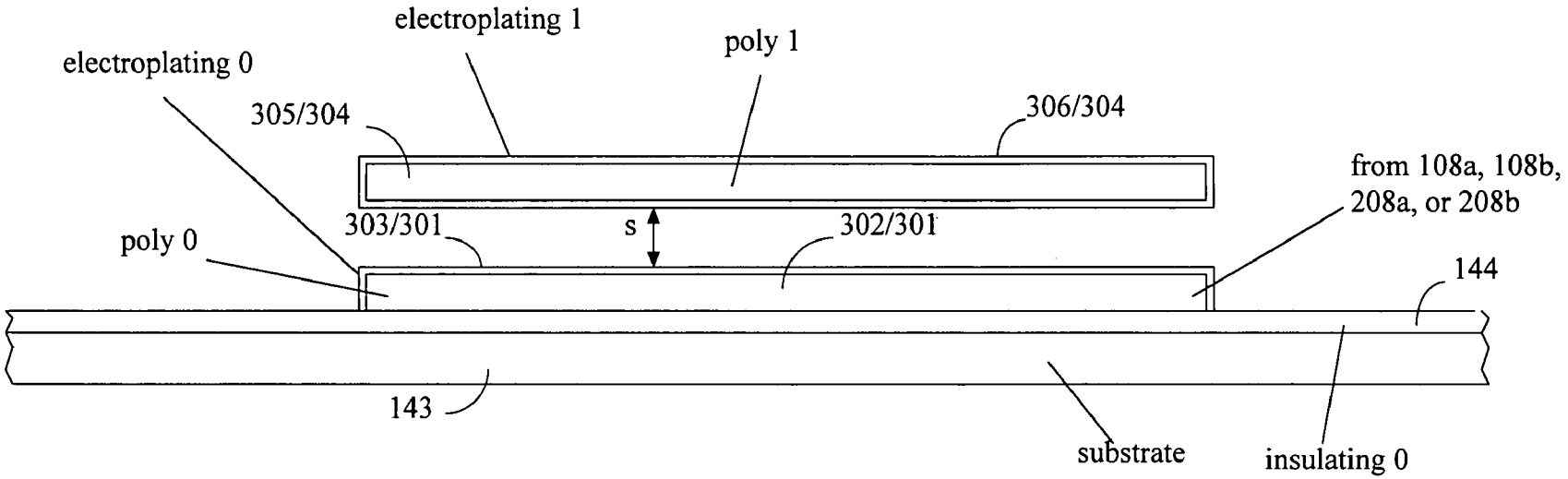

The MEMS reconfigurable circuit components 107 of FIG. 1 may include one or more MEMS reconfigurable capacitors 300 of the type shown in FIGS. 44 and 45. Each capacitor 300 is configured and operates similar to the microstrip transmission line element 180 of FIG. 24, except for the notable differences discussed next.

The capacitor 300 comprises a conductive stationary lower plate 301. The lower plate 301 is configured like the stationary planar conductor 183 of the microstrip transmission line element 180 since it comprises a semiconductor plate 302 and a metal plating 303 on the semiconductor plate 302.

The capacitor 300 also comprises a conductive vertically moveable upper plate 304. The upper plate 304 is configured similar to the moveable planar conductor 182 of the microstrip transmission line element 180 of FIG. 24 since it comprises a semiconductor plate 305 and a metal plating 306 on the semiconductor plate 305. Each edge of the upper plate 304 is moveably coupled to a corresponding actuator mechanism 123 of the capacitor 300 with a corresponding hinge assembly 185 and a corresponding insulating attachment bridge 184. More specifically, each edge of the upper plate 304 is fixedly coupled to the corresponding hinge assembly 185 in the same manner in which each transverse edge of the moveable planar conductor 182 is fixedly coupled to a corresponding hinge assembly 185. And, the corresponding actuator mechanism 123 is fixedly coupled to the corresponding hinge assembly 185 by the corresponding insulating attachment bridge 184 in the same manner in which each actuator mechanism 123 of the microstrip transmission line element 180 is fixedly coupled to a corresponding hinge assembly 185. However, as those skilled in the art will recognize, it would suffice to moveably couple the upper plate 304 to the actuator mechanisms 123 in this manner only at opposite edges of the upper plate 304.

In view of the configuration of the capacitor 300 just described, the capacitance C of the capacitor 300 is given by:

$$C=\epsilon_0 A/s+c_p \quad (12)$$

where A is the overlapping area of the lower and upper plates 301 and 304, s is the gap spacing between the lower and upper plates 301 and 304, $\epsilon_0$ to is the dielectric constant of air, and $c_p$ is the parasitic capacitance. The capacitance C is variable because the gap spacing s can be changed to reconfigure the capacitor 300. For example, the actuator mechanisms 123 can be controlled to move backward or forward so as to decrease or increase the gap spacing s. This is done in the same manner that the gap spacing s at each end of the moveable planar conductor 182 of FIG. 24 is changed. Furthermore, the movement of the actuator mechanisms 123 is done under the control of the control circuit 109 of FIG. 1 in the same manner described earlier for the actuator mechanisms 123 of the antenna 104 of FIG. 1.

As mentioned earlier, it would suffice to moveably couple the upper plate 304 to the actuator mechanisms 123 only at opposite edges of the upper plate 304. In this case, the capacitance C could be made variable because both the area A and/or the gap spacing s can be changed to reconfigure the capacitor 300. The gap spacing s would be changed in the manner just described. The area A would be changed by controlling the actuator mechanisms 123 to move in the same direction (i.e., respectively backward and forward or respectively forward and backward) so that the overlapping area A between the lower and upper plates 301 and 304 is increased or decreased.

As alluded to earlier, the receive and transmit ICs 108*a*, 208*a*, 108*b*, and 208*b* of FIGS. 1 and 2 use the capacitors 300 for processing and generating RF signals received and transmitted by the transceivers 100 and 200 of FIGS. 1 and 2. Referring back to FIGS. 44 and 45, for each capacitor 300, the corresponding IC 108*a*, 208*a*, 108*b*, or 208*b* applies a voltage between the stationary base plate 195 of one of the hinge assemblies 185 of the capacitor 300 and the lower plate 301 of the capacitor 300. This voltage appears between the upper plate 304 and the lower plate 301 since the hinge assembly 185 is electrically connected to the upper plate 304. This occurs for the same reason discussed earlier that each end of the moveable planar conductor 182 of FIG. 24 is electrically connected to a corresponding coplanar conductor 113 by a corresponding hinge assembly 185.

However, as those skilled in the art will also recognize, only one hinge assembly 185 is needed to be electrically connect to the upper plate 304. Thus, the other hinge assemlies could be fixedly coupled but electrically isolated from the upper plate 304 in the same manner as is done for some of the hinge assemblies in the microstrip transmission line element 180 of FIG. 24. This in fact would reduce parasitic capacitances from the hinge assemblies 185.

MEMS Reconfigurable Capacitor with Rotatably Moveable Upper Plate

Figure 46:
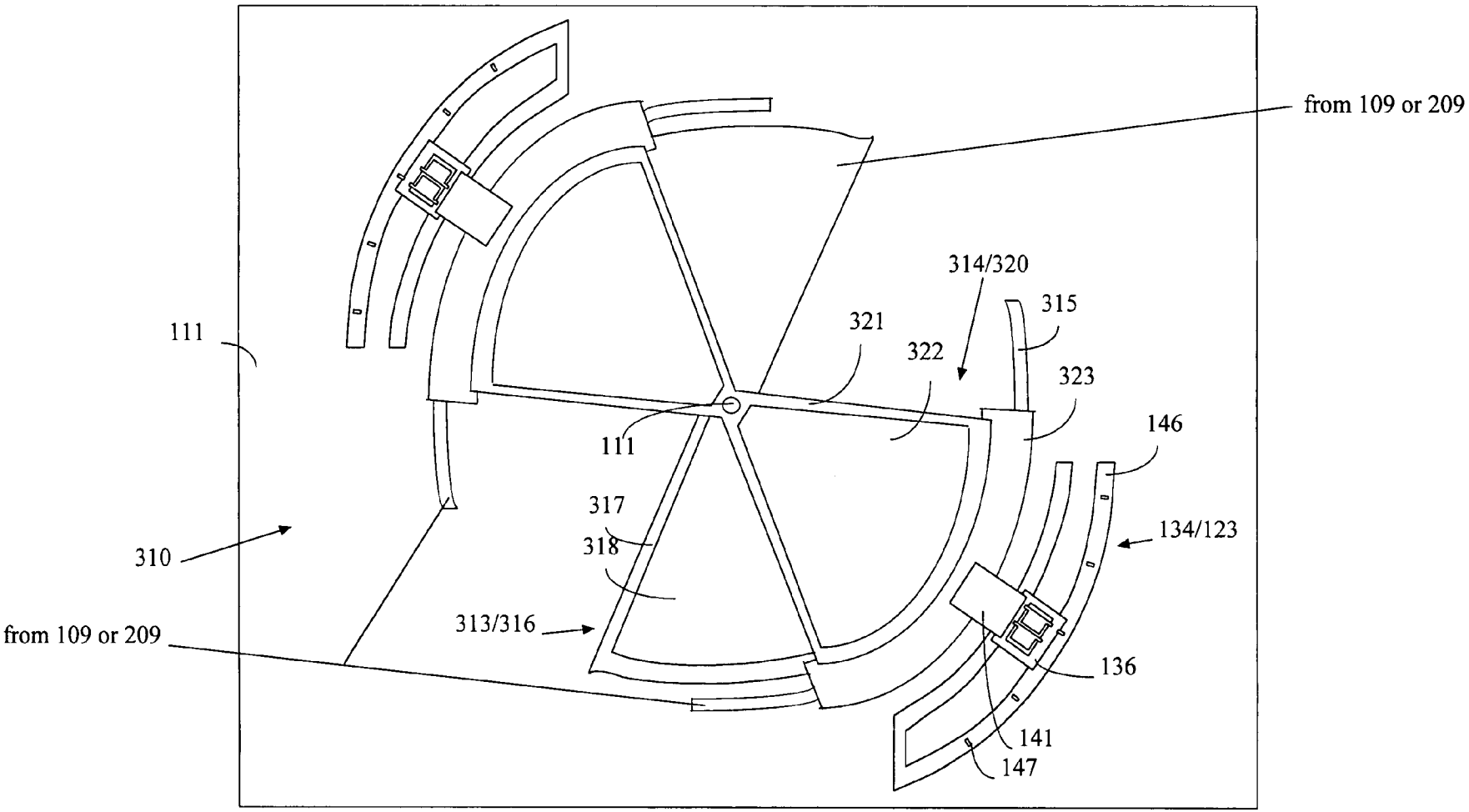
FIGS. 46 to 48 show a MEMS reconfigurable capacitor with a rotatably moveable upper plate of the transceivers of FIGS. 1 and 2 and various components thereof.

The MEMS reconfigurable passive circuit components 107 of FIG. 1 may include one or more MEMS reconfigurable capacitors 310 of the type shown in FIG. 46. Each capacitor 310 comprises an actuator mechanism 123, insulating attachment bridges 141, a conductive stationary lower plate 313, a conductive rotatably moveable upper plate 314, contact lines 315, and a hinge 111.

Figure 47:
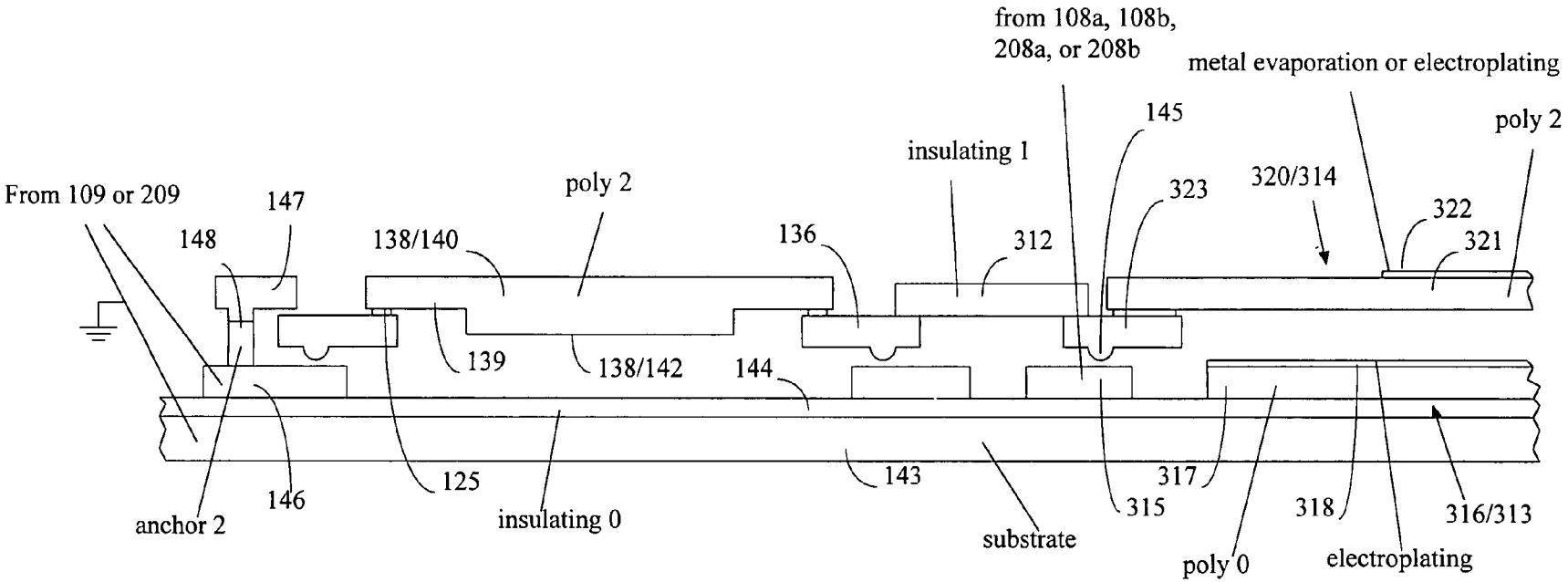
Figure 48:
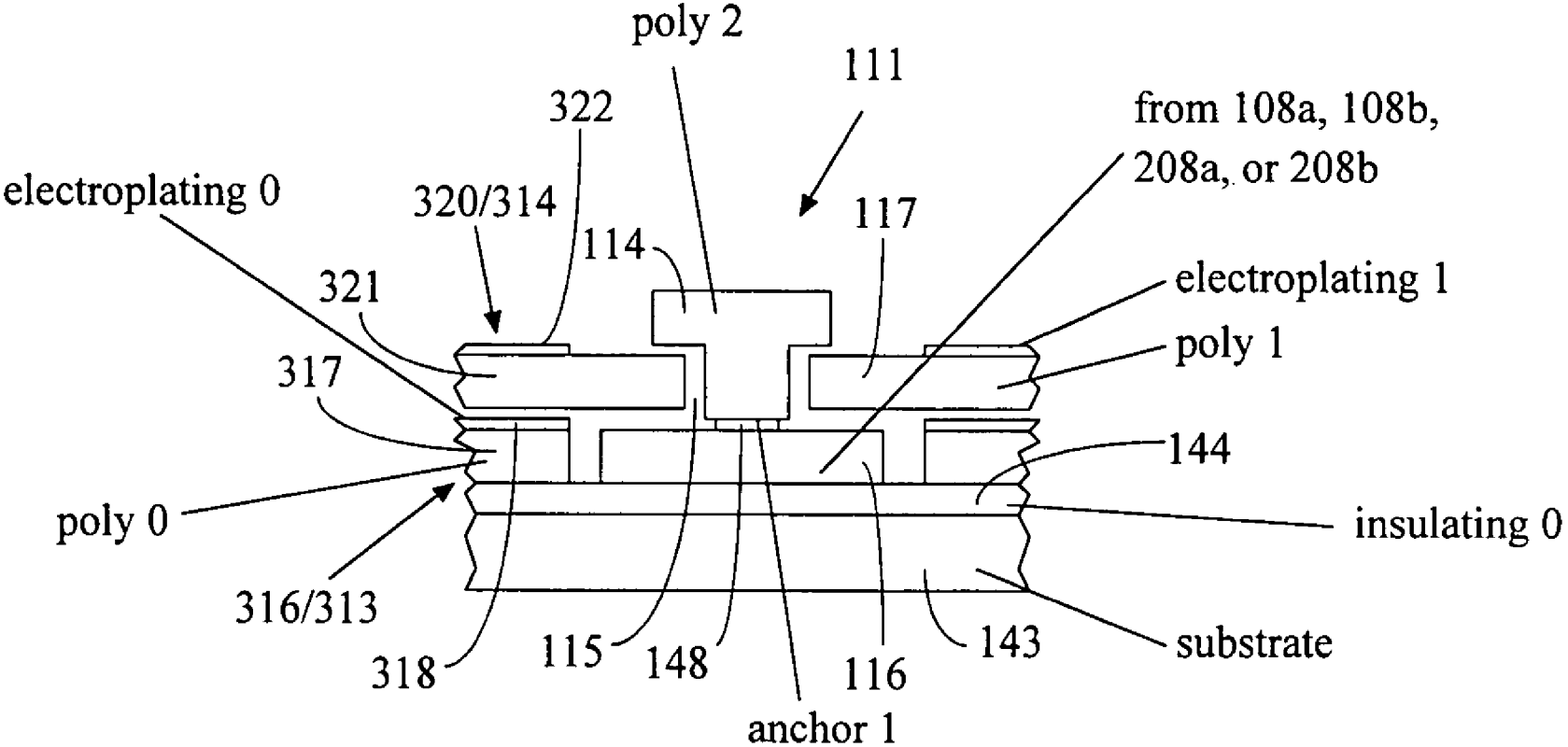

The lower plate 313 is butterfly shaped because it comprises two pie slice shaped portions 316. Referring to FIGS. 47 and 48, each portion 316 comprises a semiconductor plate 317 and a metal plating 318 on the semiconductor plate 317. The semiconductor plates 317 are electrically connected and may be fixedly coupled and integrally formed together around the lower bracket 116 of the hinge 111.

Each contact line 315 is fixedly coupled to the insulating layer 144 and is arc shaped. Furthermore, each contact line 315 lies between the inner bias line 146 of a corresponding actuator mechanism 134 and a corresponding portion 316 of the lower plate 313.

As shown in FIG. 46, the upper plate 314 is also butterfly shaped because it comprises two pie slice shaped portions 320. Referring back to FIGS. 47 and 48, each portion 320 comprises a conductive semiconductor plate 321 and a metal plating 322 on the semiconductor plate 321. Each semiconductor plate 321 is electrically connected and fixedly coupled to the middle section 116 of the hinge 111 by a corresponding via 125. Each portion 320 also comprises an arc shaped support frame 323 that is fixedly coupled and electrically connected to the semiconductor plate 321 by a corresponding via 125. This support frame 323 is also fixedly coupled to the support frame 136 of a corresponding actuator sub-mechanism 134 of the actuator mechanism 123 by an insulating attachment bridge 141. The support frame 323 comprises an arc shaped contact rail 145 that may be integrally formed with the support frame 323. The arc shape of the contact rail 145 matches that of the corresponding contact line 315 so that it can slide on and electrically contact this contact line 315. The rail 145 may be continuous or may comprise a row of protrusions or bumps. Since the support frame 323, the via 125, and the semiconductor plate 321 are conductive, the metal plate 321 is electrically connected to the contact line 315 by the support frame 323, the via 125, and the semiconductor plate 321.

The hinge 111 is configured and operates like each hinge 111 of the antenna 104 of FIG. 3. Since the semiconductor plates 321 of the portions 320 of the upper plate 314 are fixedly coupled to the middle section 116 of the hinge 111, the semiconductor plates 321 (and therefore the entire upper plate 314) can be rotated about the rotation axis R of the hinge 111. Furthermore, the upper bracket 117, the lower bracket 114, the middle section 116, and the anchor 148 of the hinge 111 are all conductive. This means that the semiconductor plates 321 (and therefore the entire upper plate 314) are electrically connected to the lower bracket 116 (and therefore the hinge 111).

Referring again to FIG. 46, the actuator mechanism 123 is configured similar to the actuator mechanism 123 of the impedance tuner 150 of FIG. 14. Thus, only the significant differences will be discussed next.

Each actuator sub-mechanism 134 of the actuator mechanism 123 is configured for movement along an arc so that the upper plate 314 can be rotated clockwise and counterclockwise about the rotation axis R. More specifically, one of the actuator mechanisms 314 is configured for clockwise movement and the other is configured for counterclockwise movement. Furthermore, each actuator sub-mechanism 134 is configured for movement along the arc so that the contact rail 145 for the corresponding support frame 323 slides on and electrically contacts the corresponding contact line 315. Thus, the bias lines 146 and the contact rails 145 of each actuator sub-mechanism 134 are all arc shaped.

The capacitance C of the capacitor 310 is also given by Eq. (12), but where A is the overlapping area of the lower and upper plates 313 and 314, s is the gap spacing between the lower and upper plates 313 and 314. The capacitance C is variable because the area A can be changed to reconfigure the capacitor 310. For example, the actuator sub-mechanism 134 configured for clockwise movement can be controlled to move clockwise so as to rotate the upper plate 314 clockwise and increase the area A. Conversely, the actuator sub-mechanism 134 configured for counterclockwise movement can be controlled to move counterclockwise so as to rotate the upper plate 314 counterclockwise and decrease the area A. In both cases, a corresponding change in the capacitance C occurs as a result. The movement of the actuator sub-mechanisms 134 is done under the control of the control circuit 109 or 209 of FIG. 1 or 2 in the same manner described earlier for the actuator sub-mechanisms 134 of the impedance tuner 150 of FIG. 14.

Like the capacitors 300, the receive and transmit ICs 108*a*, 208*a*, 108*b*, and 208*b* of FIGS. 1 and 2 use the capacitors 310 for processing and generating RF signals received and transmitted by the transceivers 100 and 200 of FIGS. 1 and 2. Referring back to FIGS. 47 and 48, for each capacitor 310, the corresponding IC 108*a*, 208*a*, 108*b*, or 208*b* applies a voltage between the lower component 116 of the hinge 111 of the capacitor 310 and the lower plate 313 of the capacitor 310. This voltage then appears between the upper plate 314 and the lower plate 313 since, as discussed earlier, the hinge 111 is electrically connected to the upper plate 314.

Fabrication Process

The RF devices 100 and 200 of FIGS. 1 and 2 may be fabricated using a three polysilicon layer process. This of course also means that the RF transmission components 104, 105, and 106 and circuit components 107 of FIG. 1 and the RF transmission components 204, 205, and 206 and circuit components 107 of FIG. 2 may each be formed with this same three polysilicon layer process. RF transmission components 104, 105, 106, 204, 205, and 206 and the circuit components 107 are identified in FIGS. 1 to 48 and therefore will not be specifically identified here.

In this process, a first insulting layer identified as insulating layer 144 in FIGS. 1 to 48 is first deposited on a semiconductor substrate identified as substrate 143 in FIGS. 1 to 48. The substrate may comprise silicon and the insulating layer may comprise silicon nitride.

Then, a first polysilicon layer (poly 0) is deposited on the first insulating layer. This polysilicon layer is selectively patterned on the insulating layer to form the elements identified as being poly 0.

A first sacrificial layer, such as a PSG (phosphorous silicate glass) like silicon dioxide, is then deposited on the first insulating layer and the patterned first polysilicon layer. This sacrificial layer is then selectively etched down to form openings for the formation of the elements identified as anchor 1 and 2. This sacrificial layer is also selectively etched to form dimples in it for the formation of contact rails.

A second polysilicon layer (poly 1) is then deposited on the first sacrificial layer and in the openings and dimples just mentioned. This polysilicon layer is then selectively patterned to form the elements identified as poly 1 and anchor 1 and the lower portions of the elements identified as anchor 2.

A second insulating layer (insulating 1) is then deposited on the first sacrificial layer and the patterned second polysilicon layer. Like the first insulating layer, this insulating layer may comprise silicon nitride. The second insulating layer is then selectively patterned to form the elements identified as insulating 1.

A second sacrificial layer that is of the same material as the first sacrificial layer is then deposited on the first sacrificial layer, the patterned second polysilicon layer, and the patterned second insulating layer. The second sacrificial layer is selectively etched down to the lower portions of the elements identified as anchor 2 for the formation of the upper portion of these elements. The second sacrificial layer is also selectively etched to provide openings for the formation of the elements identified as via. The second sacrificial layer is further selectively etched to form dimples in the second sacrificial layer for the formation of bushings of SDAs.

A third polysilicon layer (poly 2) is then deposited on the second sacrificial layer and in the openings and dimples just mentioned. This polysilicon layer is then selectively patterned to form the upper portions of the elements identified as anchor 2 and the elements identified as poly 2.

A third insulating layer (insulating 2) is then deposited on the second sacrificial layer and the patterned third polysilicon layer. Like the first and second insulating layers, this insulating layer may comprise silicon nitride. The third insulating layer is then selectively patterned to form the elements identified as insulating 2.

A third sacrificial layer is then deposited on the second sacrificial layer, the patterned third polysilicon layer, and the patterned third insulating layer. This third sacrificial layer is of the same material as the first and second sacrificial layers. This sacrificial layer is then selectively etched down to form openings for metal evaporation deposition of a metal layer, such as gold, on any of the elements identified as being poly 2 for which this is desired. Then, this metal layer is deposited to form the elements identified as being metal evaporation or for any elements for which this is desired.

Then, the first second, and third sacrificial layers are selectively etched to expose any elements identified as poly 0, poly 1, poly 2 for metal electroplating deposition of a metal layer, such as gold, on any of these elements for which it is desired and for those of the elements that are identified as electroplating. This is done by placing the entire MEMS chip 101 or 201 in a solution containing the metal and then applying an appropriate voltage to the exposed element.

Finally, the first, second, and third sacrificial layers are entirely removed. This frees all of the moving elements for movement in the manner described earlier.

CONCLUSION

As those skilled in the art will recognize, the MEMS RF transmission components and circuit components and their elements disclosed herein could be used in any RF device. Moreover, some of the components and elements described herein can be used for other applications than in an RF device. For example, the hinges 111, 193, 194, and 229 and the switches can be used in optical device and quasi-optical systems, as disclosed in copending PCT Patent Applications Ser. Nos. PCT/US00/16023 and PCT/US00/16024, with respective titles MEMS OPTICAL COMPONENTS and RECONFIGURABLE QUASI-OPTICAL UNIT CELLS, and filed on Jun. 9, 2000. These copending applications are hereby incorporated by reference.

Finally, while the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A MEMS reconfigurable vee antenna comprising:

a transmission line end comprising conductors;

antenna arms, each of the antenna arms being rotatably coupled to a corresponding one of the conductors;

actuator mechanisms;

support arms, each of the support arms having one end rotatably coupled to a corresponding one of the antenna arms and the other end rotatably coupled to a corresponding one of the actuator mechanisms;

first micro-mechanical hinges, each of the first micro-mechanical hinges rotatably coupling one of the antenna arms to a corresponding one of the conductors;

second micro-mechanical hinges, each of the second micro-mechanical hinges rotatably coupling one end of a corresponding one of the support arms to a corresponding one of the antenna arms; and third micro-mechanical hinges, each of the third micro-mechanical hinges rotatably coupling one end of a corresponding one of the support arms to a corresponding one of the actuator mechanisms;

wherein, for each of the actuator mechanisms, when the actuator mechanism is controlled to move linearly forward, the corresponding support arm pushes on the corresponding antenna arm so as rotate the corresponding antenna arm inward, and when the actuator mechanism is controlled to move linearly backward, the corresponding support arm pulls on the corresponding antenna arm so as rotate the corresponding antenna arm outward.

2. The MEMS reconfigurable vee antenna of claim 1 wherein the transmission line end comprises a CPS transmission line end and the conductors comprise a pair of coplanar conductors.

3. The MEMS reconfigurable vee antenna of claim 1 wherein the transmission line comprises a CPW transmission line end and the conductors comprise a pair of ground plane conductors and a center conductor.

4. The MEMS reconfigurable vee antenna of claim 1 wherein each first micro-mechanical hinge comprises:

a first component;

a second component;

a third component with an opening in a plane;

a pin that is normal to the plane and sized to closely fit within the opening;

the first and second components being fixedly coupled to corresponding opposite ends of the pin on opposite sides of the third component and having dimensions within the plane that are greater than the size of the opening so that movement of the third component relative to the first component, the second component, and the pin is limited to rotation in the plane.

5. The MEMS reconfigurable vee antenna of claim 4 wherein each first micro-mechanical hinge further comprises:

an anchor that fixedly couples the first component to the corresponding opposite end of the pin; and a via that fixedly couples the second component to the corresponding opposite end of the pin.

6. The MEMS reconfigurable vee antenna of claim 5 wherein for each first micro-mechanical hinge:

the first, second, and third components are respectively formed from first, second, and third major layers of polysilicon;

the anchor is formed from a first intermediate layer of polysilicon between the first and second major layers of polysilicon; and the via is formed from a second intermediate layer of polysilicon between the second and third major layers of polysilicon.

7. The micro-mechanical hinge of claim 4 wherein the opening and the pin are round, the size comprises a diameter, and the dimensions comprise cross sections.

8. The MEMS reconfigurable vee antenna of claim 1 wherein each second and third micro-mechanical hinge comprises:

a base ring;

a rotation ring disposed within the base ring;

a hinge pin disposed within the rotation ring;

one or more attachment arms that fixedly couple the hinge pin to the base ring and guide the rotation ring as it rotates about the hinge pin's axis and within the base ring; and a support arm having (a) a first end fixedly coupled to the rotation ring, and (b) a second end that rotates about the hinge pin's axis when the rotation ring rotates.

9. The MEMS reconfigurable vee antenna of claim 8 wherein each second and third micro-mechanical hinge further comprises:

first vias that fixedly couple the one or more attachment arms to the hinge pin and the base ring; and second vias that fixedly couple the first end of the support arm to the rotation ring.

10. The MEMS reconfigurable vee antenna of claim 9 wherein for each second and third micro-mechanical hinge:

the base ring, the rotation ring, and the hinge pin are all formed from a first major layer of polysilicon;

the attachment arms and the support arm are all formed from a second major layer of polysilicon; and the vias are formed from an intermediate layer of polysilicon between the first and second major layers of polysilicon.

* * * * *